US007490496B2

(12) United States Patent
Kim et al.

(10) Patent No.: US 7,490,496 B2
(45) **Date of Patent: *Feb. 17, 2009**

(54) DRUM WASHING MACHINE WITH VERTICALLY OPENABLE AND CLOSABLE DOOR

(75) Inventors: Dong Won Kim, Kwangmyung-si (KR); Jae Won Chang, Kunpo-si (KR)

(73) Assignee: LG Electronics Inc., Seoul (KR)

( * ) Notice: Subject to any disclaimer, the term of this patent is extended or adjusted under 35 U.S.C. 154(b) by 667 days.

This patent is subject to a terminal disclaimer.

(21) Appl. No.: 11/247,359

(22) Filed: Oct. 12, 2005

(65) Prior Publication Data

US 2006/0086155 A1 Apr. 27, 2006

(30) Foreign Application Priority Data

Oct. 22, 2004 (KR) ..... 10-2004-0084900
Oct. 22, 2004 (KR) ..... 10-2004-0084902
Oct. 22, 2004 (KR) ..... 10-2004-0084903
Oct. 22, 2004 (KR) ..... 10-2004-0084904
Oct. 22, 2004 (KR) ..... 10-2004-0084905
Oct. 22, 2004 (KR) ..... 10-2004-0084906

(51) Int. Cl.
*B08B 3/00* (2006.01)
*D06B 1/00* (2006.01)

(52) U.S. Cl. ..... 68/196; 68/12.26; 68/24; 68/58; 68/140; 134/93; 134/200

(58) Field of Classification Search ..... 68/12.26, 68/23.1, 23.2, 24, 26, 58, 139, 140, 196, 68/210; 134/93, 200
See application file for complete search history.

(56) References Cited

U.S. PATENT DOCUMENTS 2,639,601 A * 5/1953 Miller ..... 68/139

(Continued)

FOREIGN PATENT DOCUMENTS

DE 20119100 5/2002

(Continued)

OTHER PUBLICATIONS

U.S. Appl. No. 11/247,223 to Kim et al., filed Oct. 12, 2005.

(Continued)

*Primary Examiner*—Michael Barr
*Assistant Examiner*—Rita R Patel
(74) *Attorney, Agent, or Firm*—Greenblum & Bernstein, P.L.C.

(57) ABSTRACT

A drum washing machine has a cabinet including an opening formed at a front wall of the cabinet to allow laundry to be put into or taken out of the cabinet, a door to open or close the opening of the cabinet, and an opening/closing guide mechanism connected between the cabinet and the door to guide the door downwardly when opening the door such that a front surface of the door is upwardly directed, and to guide the door upwardly moved when closing the door such that the door is vertically openable and closable. The door of the drum washing machine can be easily opened even where the washing machine is installed in a limited space. The door can also be used as a laundry holder in an opened state.

23 Claims, 85 Drawing Sheets

U.S. PATENT DOCUMENTS

| | | | | |
|---|---|---|---|---|
| 2,960,780 | A * | 11/1960 | Stilwell, Jr. | 38/2 |
| 5,253,433 | A * | 10/1993 | Frey | 34/603 |
| 5,548,978 | A * | 8/1996 | Bongini et al. | 68/17 R |
| 5,570,597 | A * | 11/1996 | Bongini et al. | 68/17 R |
| 6,237,374 | B1 * | 5/2001 | Malchow et al. | 68/139 |
| 7,350,528 | B2 * | 4/2008 | Brunswick | 134/135 |
| 2005/0056059 | A1 * | 3/2005 | Usherovich et al. | 68/12.02 |
| 2006/0086151 | A1 * | 4/2006 | Kim et al. | 68/196 |
| 2006/0086152 | A1 * | 4/2006 | Kim et al. | 68/196 |
| 2006/0086154 | A1 * | 4/2006 | Kim | 68/196 |

FOREIGN PATENT DOCUMENTS

| | | |
|---|---|---|
| EP | 1333118 | 8/2003 |
| EP | 1365056 | 11/2003 |
| EP | 1367169 | 12/2003 |
| EP | 1389643 | 2/2004 |
| EP | 1408150 | 4/2004 |
| WO | 02/12613 | 2/2002 |

OTHER PUBLICATIONS

U.S. Appl. No. 11/247,275 to Kim et al., filed Oct. 12, 2005.
U.S. Appl. No. 11/247,270 to Kim et al., filed Oct. 12, 2005.
U.S. Appl. No. 11/247,282 to Kim, filed Oct. 12, 2005.
U.S. Appl. No. 11/247,206 to Kim et al., filed Oct. 12, 2005.

* cited by examiner

DRUM WASHING MACHINE WITH VERTICALLY OPENABLE AND CLOSABLE DOOR

CROSS-REFERENCE TO PRIORITY DOCUMENTS

This application claims the benefit of priority to Korean Patent Applications Nos. 10-2004-084900, 10-2004-084902, 10-2004-084903, 10-2004-084904, 10-2004-084905 and 10-2004-084906, each of which was filed in the Korean Patent Office on Oct. 22, 2004, and each of which is incorporated herein by reference in its entirety.

BACKGROUND OF THE INVENTION

1. Field of the Invention

The present invention relates to a drum washing machine which includes a door which is openable and closable in a vertical direction (herein referred to as a "vertically-openable/closable door" or "door") and which may be used as a laundry holder in a downwardly opened state.

Further, the present invention relates to a drum washing machine with a basket on a door, in which the laundry may be taken out of the drum washing machine, and then put into the basket while the door of the drum washing machine is opened downwardly, and in which the basket may be separated from the door so as to transfer the laundry.

The present invention also relates to a maintaining apparatus of a drum washing machine having a vertically-openable/closable door, which is capable of maintaining the vertically-openable/closable door in a fully opened or closed state, the door being opened when it moves downwardly and being closed when it moves upwardly.

Also, the present invention further relates to a drum washing machine which may include an automatically vertically-openable/closable door to be usable as a laundry holder in a downwardly opened state, and an electric power supply apparatus for the door of the drum washing machine.

The present invention also relates to a drum washing machine which includes an automatically vertically openable/closable door to be usable as a laundry holder when opened downwardly.

Further, the present invention also relates to a variable support apparatus of a door of a drum washing machine, which supports the door so that the door is usable as a laundry holder when opened downwardly, and which may be varied when an external force of very high strength is applied to the door, thereby providing a stable support structure for the door of the drum washing machine.

2. Description of the Related Art

Referring to FIG. 1 for example, a related art version of a washing machine 4 is illustrated including a cabinet 2, in which a tub and a drum are installed extending horizontally. An opening 3 is formed at a front wall of the cabinet 2 to communicate with the tub and drum. A door 5 is mounted to the cabinet 2 to open and close the opening 3.

The door 5 is hingably mounted, at one side thereof, to a portion of the cabinet 2 corresponding to one side of the opening 3 by a hinge mechanism 7. A handle (not shown) is provided at the other side portion of the door 5. In accordance with this structure, the door 5 is hingably movable when the user pulls the handle to open the opening 3 or pushes the handle to close the opening 3.

The door 5 includes an annular door rim 5*a*, and a door window 5*b* surrounded by the annular door rim 5*a*. The door window 5*b* is made of a transparent glass material, and has a convex structure protruding into the interior of the washing machine and coming into contact with a gasket 9 mounted in the cabinet 2.

However, the above-mentioned related art washing machine 4 has a problem in that the door 5 cannot be fully opened where the related art washing machine 4 is installed close to a wall W, as shown in FIG. 2, for example, because the door 5 opens in a horizontal direction corresponding to the side-mounted hinge mechanism 7. When the door 5 is partially opened, the convex door window 5*b* is positioned toward the opening 3, and there may be an inconvenience because the convex door window 5*b* may obstruct laundry when the laundry is put into or taken out of the related art washing machine 4 through the opening 3.

After completion of a laundry washing process, the user takes the laundry out of the related art washing machine 4. In the process of taking the laundry out of the related art washing machine 4, however, the user may drop the laundry to the floor because the laundry is entangled. Such a situation occurs frequently. In this case, there is a problem in that the dropped laundry must be washed again.

Also, the user may remove items of laundry, one by one, from the related art washing machine 4, and shake the removed items of laundry to separate foreign matter, for example, lint, which is attached to the laundry. After shaking one item of laundry, the user may put the shaken laundry into a conventional laundry basket (which is typically a separate object with no particular connection to the washing machine 4), and then shake another item of laundry. In this pattern of use, the necessity to use the conventional laundry basket may cause the user inconvenience when taking the laundry out of the related art washing machine 4.

Further, when the laundry is to be taken out of the related art washing machine 4 after the laundry washing process is completed, the user may put some items of laundry into an additional laundry container (such as the conventional laundry basket, not shown), and then take other items of laundry out of the washing machine while the already-removed laundry is stored in the conventional laundry basket, in order to complete the process of taking the laundry out of the related art washing machine 4. Because it is necessary to use the additional laundry container, the user may be inconvenienced when taking the laundry out of the related art washing machine 4.

SUMMARY OF THE INVENTION

Therefore, it is an object of the present invention to provide a drum washing machine which includes a vertically-openable/closable door movable between an open position having a generally horizontal orientation and a closed position having a generally vertical orientation, and usable as a laundry holder in the open position, thereby capable of making it easy to open the door, and of making the laundry loading or unloading process convenient, even where the washing machine is installed in a limited space, and thus, improving the convenience of the drum washing machine to the user.

It is another object of the present invention to provide a drum washing machine which includes a vertically-openable/closable door in which the entire door is vertically openable, and a portion of the door is horizontally hingably openable, thereby achieving a more convenient door opening operation in accordance with a selection by the user.

In accordance with one aspect, the present invention may provide a drum washing machine having a cabinet including an opening at a front wall of the cabinet to allow laundry to be put into or taken out of the cabinet; a door to open or close the opening of the cabinet; and an opening/closing guide mechanism connected between the cabinet and the door to guide the door downwardly as the door is opened, such that a front surface of the door is directed upwardly. Further, the opening/closing guide mechanism may guide the door upwardly as the door is closed, such that the door may be opened or closed along a substantially vertical direction.

The door may include a door frame mounted to a front wall of the cabinet, and a container-shaped door window mounted to the door frame, the door window having a convex structure extending into the opening of the cabinet when the door is closed.

The door window may be hingably mounted to the door frame by a hinge mechanism so that the door window may be hingably opened or closed with respect to the door frame.

The opening/closing guide mechanism may include a vertical guide mechanism to guide an upper end of the door vertically along a front wall of the cabinet, and a door support mechanism to support the door as the door is opened.

The vertical guide mechanism may include vertical guides at opposite side portions of the cabinet extending vertically, respectively, and guide couplers respectively protruding from opposite side portions of the door, which can move vertically along the vertical guides.

The door support mechanism may include at least one support rod having two opposite ends, one of which is hingably connected to the cabinet and the other of which is hingably connected to the door, respectively.

Also, the door support mechanism may include two support rods each connected between an intermediate position of an associated one of at least two opposite side portions in the door and a bottom wall of the cabinet.

The drum washing machine may further include at least one handle at the front wall of the door below where the support rods are connected to the door, respectively.

In accordance with another aspect, the present invention may provide a drum washing machine having a cabinet including an opening formed at a front wall of the cabinet to allow laundry to be put into or taken out of the cabinet, a door to open or close the opening of the cabinet, a vertical guide mechanism connected between an upper end of the door and the cabinet to guide the upper end of the door substantially vertically along a front wall of the cabinet as the door is opened or closed, and a door support mechanism connected between the door and the cabinet to guide a lower end of the door substantially horizontally as the door is opened or closed, such that the door is vertically openable and/or closable.

The drum washing machine with the vertically-openable/closable door according to the present invention may allow the user to conveniently load and/or unload laundry at either side of the drum washing machine, because the door is movable vertically to be opened or closed. Moreover, the door can be easily opened even where the washing machine is installed in a limited space. Also, the door can be used as a laundry holder when the door is completely opened. Accordingly, the advantage of improved convenience for the user may be achieved.

It is another object of the present invention to provide a drum washing machine with a basket on a door in which the door may be moved downward such that the door is opened in a substantially horizontal orientation, in which the basket is attached to the door such that the laundry may be taken out of the drum washing machine and then put into the basket. Accordingly, the laundry may easily be taken out of the drum washing machine after the washing process has been completed, and the laundry may be conveniently transferred to a desired location without having to use an additional laundry container (other than the basket of the door).

In accordance with another aspect, the present invention provides a drum washing machine having a cabinet including an opening at a front wall of the cabinet to allow the laundry to be put into or taken out of the cabinet, a door to open or close the opening of the cabinet, the door having a container-shaped basket detachably attached to the door such that the laundry may be put in the basket, and an opening or closing guide mechanism connected between the cabinet and the door to guide the door downwardly as the door is opened, such that a front surface of the door is directed upwardly. Further, the opening/closing guide mechanism may guide the door upwardly as the door is closed, such that the door may be opened or closed along a substantially vertical direction.

The door may include a door frame mounted to the front wall of the cabinet, and a container-shaped door window mounted to the door frame, the door window having a convex structure extending into the opening of the cabinet when the door is closed. Also, a basket may be detachably attached to the door window.

Both the door window and the basket may be at least partially made of transparent materials.

The door may be provided with a locking mechanism to prevent the basket from being separated from the door window.

The basket may also be provided with at least one handle, and the locking mechanism may cooperate with the handle of the basket.

The locking mechanism may include a locking release lever disposed inside the handle such that the locking release lever may be moved linearly, a locking pin disposed in the basket such that the locking pin extends toward the door window for cooperating with the locking release lever, and a locking spring to provide an elastic force to the locking release lever and/or the locking pin such that the locking pin may be urged toward a locking position.

The door window may be provided with a locking hole, the locking pin being inserted in the locking hole.

According to another preferred embodiment of the present invention, the door may include a door frame mounted to the front wall of the cabinet, and a container-shaped door window detachably attached to the door frame such that the door window may be used as the basket, the door window having a convex structure extending into the opening of the cabinet when the door is closed.

The door window may be at least partially made of a transparent material.

The door may be provided with a locking mechanism to prevent the door window from being separated from the door frame.

According to yet another preferred aspect of the present invention, the door may be provided with a locking mechanism to prevent the basket from being separated from the door, and the locking mechanism may include a locking release lever disposed at the door, a locking pin linearly movable by operation of the locking release lever, the locking pin being connected between the basket and the door, and a locking spring to provide an elastic force to the locking pin such that the locking pin may be urged toward a locking position.

In the drum washing machine with the basket on the door according to at least one aspect of the present invention, the door may be moved downward such that the door is opened in a substantially horizontal orientation, the basket may be attached to the door such that the laundry may be taken out of the drum washing machine and put into the basket, and the basket may be separated from the door so as to transfer the laundry put into the basket, such that the door may be fully opened even where the washing machine is installed in a limited space. As a result, the laundry may be easily taken out of the drum washing machine after a washing process has been completed, and the laundry may be conveniently transferred to a desired place using the basket, without having to use an additional laundry container other than the basket of the drum washing machine. Consequently, the laundry loading and/or unloading process may be made more convenient, and the convenience of the laundry washing process may be improved for the user.

Further, it is another object of the present invention to provide a maintaining apparatus of a drum washing machine (hereinafter referred to as a "door-opened/closed state maintaining apparatus") having a vertically-openable/closable door, which is capable of maintaining the vertically-openable/closable door in either one or both of a fully opened or a fully closed state (the door being opened when it moves downwardly and being closed when it moves upwardly, respectively) and preventing the door from being undesirably or inadvertently opened or closed, and thus, being capable of improving the reliability of opening or closing the door.

In accordance with at least one further aspect of the present invention, the above-discussed and other objects can be accomplished by, for example, a door-opened/closed state maintaining apparatus of a drum washing machine including a cabinet having an opening formed at a front wall of the cabinet to allow the laundry to be put into or taken out of the cabinet, a door to open or close the opening of the cabinet, and an opening/closing guide mechanism connected between the cabinet and the door to guide the door downwardly when opening the door, such that when the door is opened, a front surface of the door is directed upwardly. The opening/closing guide mechanism may also guide the door upwardly when closing the door, and the door-opened/closed state maintaining apparatus may include a latch mechanism disposed at the cabinet and the door for maintaining the door in either a fully opened or fully closed state.

The latch mechanism may include a protrusion disposed at either the cabinet or the door (or both) such that the protrusion extends toward either the cabinet or the door respectively corresponding thereto; and a latch disposed at either the cabinet or the door (or both) such that the protrusion is latched by the latch when the protrusion is extended.

According to a further aspect of the present invention, a drum washing machine may include an automatically vertically-openable/closable door which is automatically openable and/or closable, using a motor mounted to the door, and a rotating member movable vertically along a vertical guide while being rotated by a drive force from the motor, thereby being capable of achieving an improvement in user convenience.

In accordance with a further aspect of the present invention, an electrical power supplying apparatus for a door of a drum washing machine is provided, in which an electrical wire extends through a support rod which supports the door such that the door is horizontally and hingably opened, so that electrical power can easily be supplied to various electrical power consuming elements, such as, for example, a motor, mounted to the door.

In accordance with at least one further aspect of the present invention, a drum washing machine may include a cabinet including an opening formed at a front wall of the cabinet to allow laundry to be put into or taken out of the cabinet, a door to the opening of the cabinet, a vertical guide mechanism connected between an upper end of the door and the cabinet to guide the upper end of the door to be moved substantially vertically along a front wall of the cabinet when opening or closing the door, a door support mechanism connected between the door and the cabinet to guide the door to be opened substantially horizontally when opening the door, and an automatic opening/closing mechanism to move the door substantially vertically along the vertical guide mechanism automatically, and thus, to automatically open or close the door. Therefore, the door may be vertically openable or closable.

The vertical guide mechanism may include vertical guides respectively provided at opposite side portions of the cabinet extending vertically, and guide couplers respectively protruding from opposite side portions of the door to move vertically along the vertical guides.

The automatic opening/closing mechanism may include a rotating power generator provided at the door to generate rotating power, at least one rotating member to be rotated along an associated one of the vertical guides by the rotating power generator, and at least one rotation/linear movement converting member provided at the associated vertical guide to be moved vertically while in contact with the rotating member in accordance with a rotation of the rotating member.

The rotating power generator may include at least one electric motor.

The rotating member may be a pinion which is rotated by the rotating power generator, and the rotation/linear movement converting member may be a rack provided at the associated vertical guide.

Alternatively, the rotating member may be a frictional roller which is rotated by the rotating power generator, and the rotation/linear movement converting member may be a frictional member provided at the associated vertical guide.

The associated vertical guide may be provided with a guide groove to receive the rotating member, and the rotation/linear movement converting member may be provided at one side portion of the guide groove.

The associated vertical guide may have, at the other side portion thereof, a surface to minimize a friction generated when the rotating member comes into contact with the other side portion of the vertical guide.

The door support mechanism may allow at least one wire for supplying electric al power to the automatic opening/closing mechanism to pass through the door support mechanism.

The door support mechanism may include at least one hollow support rod having opposite ends hingably connected to the cabinet and the door, respectively. The automatic opening/closing mechanism may include a rotating power generator provided at the door to generate a rotating power, using electrical power applied to the rotating power generator.

At least one electrical wire may pass through the support rod to supply electrical power to the rotating power generator.

The drum washing machine may further include a device (or devices) which consumes electrical power hereinafter referred to as an "electrical power consuming device" installed on the door. In this case, at least one electrical wire may pass through the door support mechanism to supply electrical power to the device which consumes electrical power.

The automatic opening/closing mechanism may include an automatic opening/closing operating unit provided at an outer surface of the cabinet to generate a door opening signal or a door closing signal in response to an operation performed by a user, a rotating power generator to generate a drive power for a vertical movement of the door by an electrical power supplied in response to an operation of the automatic opening/closing operating unit, and a door moving mechanism provided at the vertical guide mechanism to move the door vertically, using the drive power generated from the rotating power generator.

In accordance with another aspect of the present invention, an electrical power supplying apparatus for a door of a drum washing machine may include: a cabinet including an opening formed at a front wall of the cabinet to allow laundry to be put into or taken out of the cabinet, a door to the opening of the cabinet, a vertical guide mechanism connected between an upper end of the door and the cabinet to guide the upper end of the door vertically along a front wall of the cabinet when opening or closing the door, a door support mechanism connected between the door and the cabinet to guide the door toward a substantially horizontal opened position when opening the door, an electrical power consuming device installed on the door, and at least one wire connected to the electrical power consuming device through the door support mechanism in the cabinet to supply electrical power to the electrical power consuming device.

The door support mechanism may include at least one hollow support rod having two opposite ends hingably connected to the cabinet and the door, respectively, and at least one electrical wire may pass through the support rod.

The electric power supplying apparatus for the door of the drum washing machine according to the present invention can supply electrical power to power consuming devices provided at the door of the drum washing machine through the support rods which support the door to be substantially vertically closed or horizontally opened because electrical wires (which supply the electrical power) may pass through the support rods.

It is another object of the present invention to provide a drum washing machine which includes an automatically vertically openable/closable door in which support rods for supporting the door are automatically vertically opened and/or closed using a motor, thereby enhancing the convenience of opening door for the user.

In accordance with the present invention, the above and other objects can be accomplished by the provision of a drum washing machine with an automatically vertically openable/closable door including: a cabinet including an opening formed at a front wall of the cabinet to allow the laundry to be put into or taken out of the cabinet; a door to open or close the opening of the cabinet; a vertical guide unit connected between an upper end of the door and the cabinet for guiding the upper end of the door to be moved vertically along a front wall of the cabinet when the door is opened and/or closed; a door support unit connected to the door and the cabinet for supporting the when opening the door; and an automatic opening/closing unit for vertically rotating the door support unit to automatically open and/or close the door.

Further, the automatic opening/closing unit may include an automatic opening/closing operation unit provided on the external surface of the cabinet for generating door-opening/closing signals in response to manipulation, by a user, for example; and one or more rotary force generation units for supplying electrical power to the door support unit according to the manipulation of the automatic opening/closing operation unit so that the door moves vertically.

The rotary force generation units may be electric motors installed at the cabinet; and a shaft of each of the electric motors may be connected to an end of a corresponding support rod for transferring rotary force generated by the electric motor to the support rod.

Elastic members for supplying an elastic force to facilitate the vertical movement of the door may be respectively interposed between the upper end of the door and a lower portion of at least one door-movement route on the cabinet.

Further, elastic members for supplying an elastic force to facilitate the vertical movement of the door may be respectively interposed between the upper end of the door and an upper portion of at least one door-movement route on the cabinet.

Also, the vertical guide unit may include vertical guides provided at opposite side portions of the cabinet extending vertically, respectively, and guide couplers respectively protruding from opposite side portions of the door to move vertically along the vertical guides; and ends of the elastic members may be connected to corresponding guide couplers.

The automatic opening/closing operation unit may include at least one of an automatic door-opening portion or an automatic door-closing portion, or both.

The drum washing machine with the automatically vertically openable/closable door according to the present invention can allow a user to conveniently load or unload laundry at either side of the drum washing machine because the door is automatically movable vertically to be opened or closed. Further, because the door may be automatically opened or closed, a more convenient door opening operation by the user may be provided.

It is a further object of the present invention to provide a variable support apparatus of a door of a drum washing machine, which supports the door so that the door is opened along an approximately vertical path to be usable as a laundry holder, and varies the door or members for supporting the door, when an external force of an excessively high strength (that is, an external force exceeding a particular threshold) is applied to the horizontally-opened door so that the door or the members for supporting the door are not damaged, thus being capable of providing a stable supporting structure.

In accordance with another aspect of the present invention, the above and other objects can be accomplished by the provision of a variable support apparatus of a door of a drum washing machine including a cabinet including an opening formed at a front wall of the cabinet to allow the laundry to be put into or taken out of the cabinet; the door to open or close the opening of the cabinet; a vertical guide unit connected between an upper end of the door and the cabinet for guiding the upper end of the door to be moved vertically along a front wall of the cabinet when the door is opened or closed; and a shock absorber connected to the door and the cabinet for supporting the door when opening the door so that the door moves horizontally, and serving a shock-absorbing function when an external force is applied to the opened door.

The shock-absorber may include support rods having opposite ends hingably connected to the cabinet and the door, respectively, and the support rods may be provided with a structure (such as, for example, springs) having a shock-absorbing function.

In accordance with another aspect of the present invention, the shock-absorber varies the length of the support rods based on the external force applied to the door.

The shock-absorber may include an inner rod located at one side of the support rod; an outer rod located at the other side of the support rod, into which the inner rod is partially inserted; and an elastic member supported in the outer rod for supplying an elastic force to the inner rod.

The shock-absorber may also maintain the length of the support rod, which prevents the inner and outer rods from being separated from each other so that a designated length of the support rod is maintained.

Also, the maintaining of the lengths of the support rods may be accomplished by a linear member having a designated length, both ends of which are respectively fixed to the inner and outer rods.

In accordance with a further aspect of the present invention, the maintaining of the lengths of the support rods may be accomplished by a structure in which the inner and outer rods are engaged with each other to prevent the inner rod from being removed from the outer rod.

In accordance with another aspect of the present invention, the shock-absorber may deform the support rod in order to provide shock-absorbing function when a force exceeding a designated strength is applied to the support rod.

In accordance with a further aspect of the present invention, hinge brackets, to which the support rods are rotatably connected, may be installed on the cabinet; and the shock-absorber may be placed between the hinge bracket and the support rod.

The shock-absorber may include a slot formed in the hinge bracket for moving a portion of the hinge bracket, to which the support rod is connected; and elastic members supported by the hinge bracket or the cabinet for limiting the movement of the support rod along the slot before a force exceeding a designated strength is applied to the elastic members through the support rod.

In accordance with another aspect of the present invention, hinges, to which the corresponding support rods are rotatably connected, may be formed on the door; and the shock-absorber may be placed at the hinge between the support rod and the door.

The shock-absorber may include a slot formed in the door for moving the hinge therethrough; and elastic members supported by the door for limiting the movement of the support rod along the slot before a force exceeding a designated strength is applied to the door.

According to the aspects discussed above, the variable support apparatus of the door of the drum washing machine of the present invention supports the door so that the door is vertically opened and/or closed, and varies the door or members for supporting the door when an external force exceeding a particular strength (which may be a relatively high strength) is applied to the door when the door is completely opened and lies horizontally so that the door or the members for supporting the door are not damaged, thus capable of providing a stable supporting structure.

In any of the aspects of the present invention noted above, although the washing machine or drum washing machine is exemplified to simplify discussion of certain features of the present invention, it should be understood that the present invention is not limited only to a washing machine for washing laundry, but also contemplates washing machines for washing any appropriate item, such as dishes and/or eating utensils, medical and/or scientific instruments (e.g., an autoclave), or any other item to be washed, for example. Further, the door and/or other features of the present invention described herein may also function with any sort of cabinet or other such approximately hexahedral container (such as a filing cabinet, computer case, clothes dresser, or coal hopper, for example), and are not necessarily limited to use with washing machines or to laundry or other items to be washed, for example.

BRIEF DESCRIPTION OF THE DRAWINGS

The above objects, and other features and advantages of the present invention will become more apparent in view of the following detailed description when taken in conjunction with the drawings, in which:

FIGS. 16A and 16B are enlarged views of part "A" of FIG. 15, in which FIG. 16A is a sectional view showing the basket locked, and FIG. 6B is a sectional view showing the basket released from locking;

FIGS. 21A and 21B are schematic side views illustrating the operation of a door-opened/closed state maintaining apparatus of the drum washing machine, according to the sixth embodiment of the present invention, in which FIG. 21A illustrates the drum washing machine with the door closed, and FIG. 21B illustrates the drum washing machine with the door open;

DESCRIPTION OF THE PREFERRED EMBODIMENTS

Now, exemplary embodiments of the present invention will be described in detail with reference to the drawings discussed above.

Figure 1:
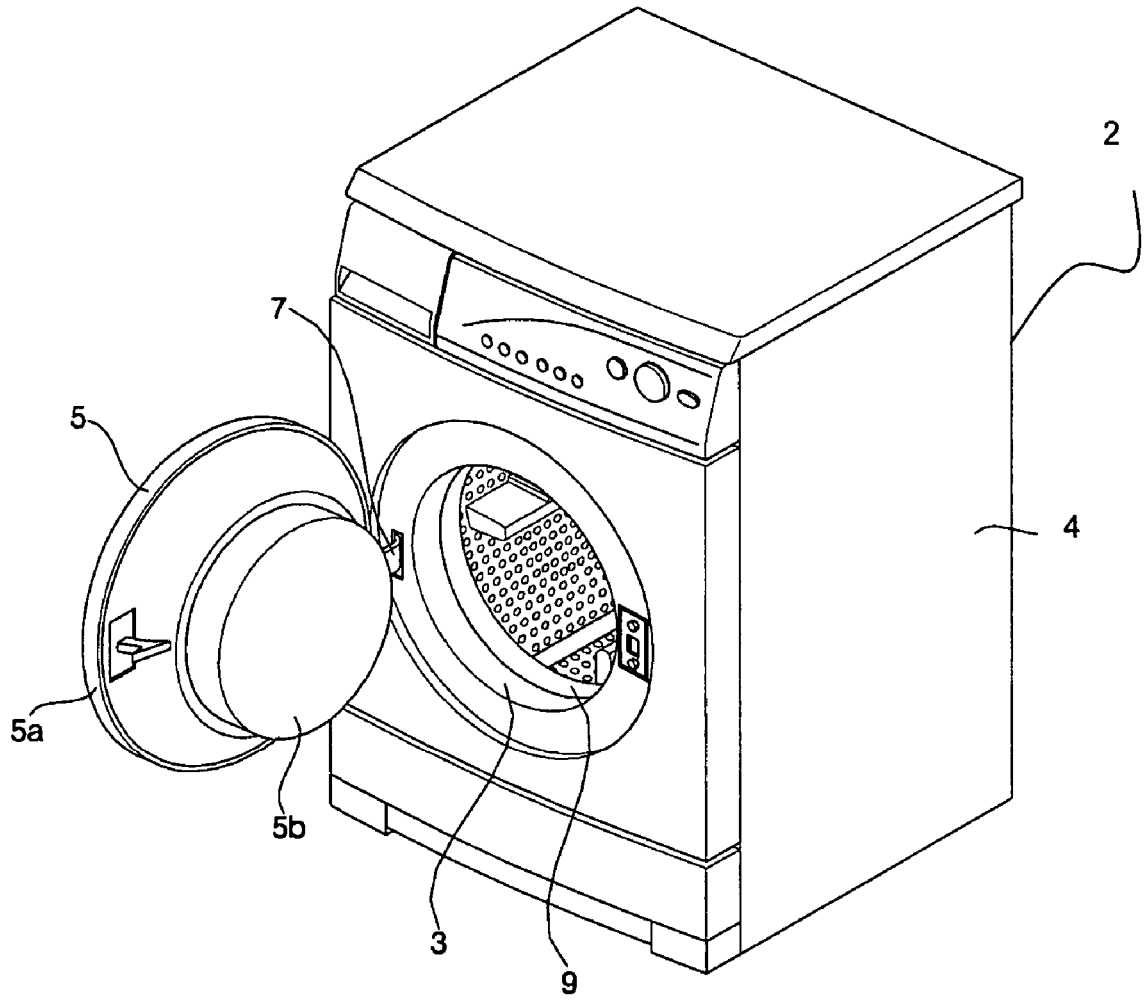
FIG. 1 (Related Art)
FIG. 1 is a perspective view illustrating a conventional drum washing machine.
Figure 2:
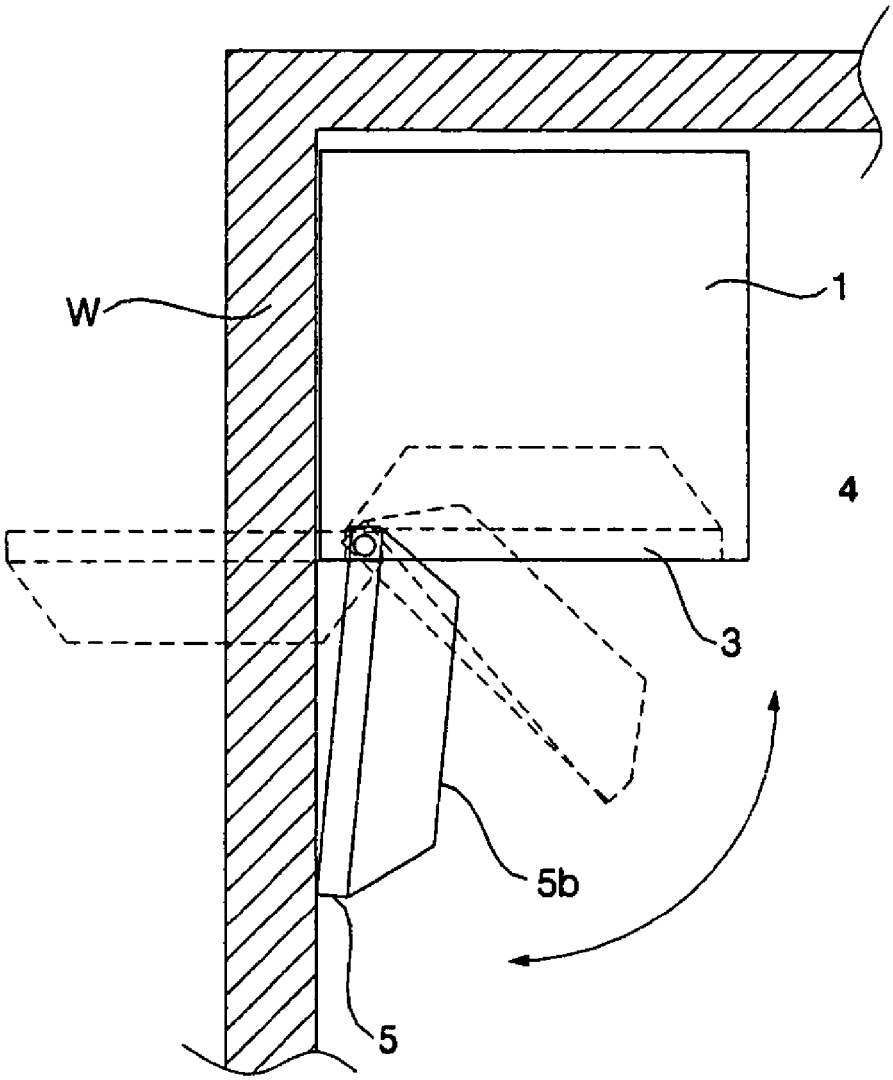
FIG. 2 (Related Art)
FIG. 2 is a schematic view illustrating a conventional drum washing machine with an open door.
Figure 3:
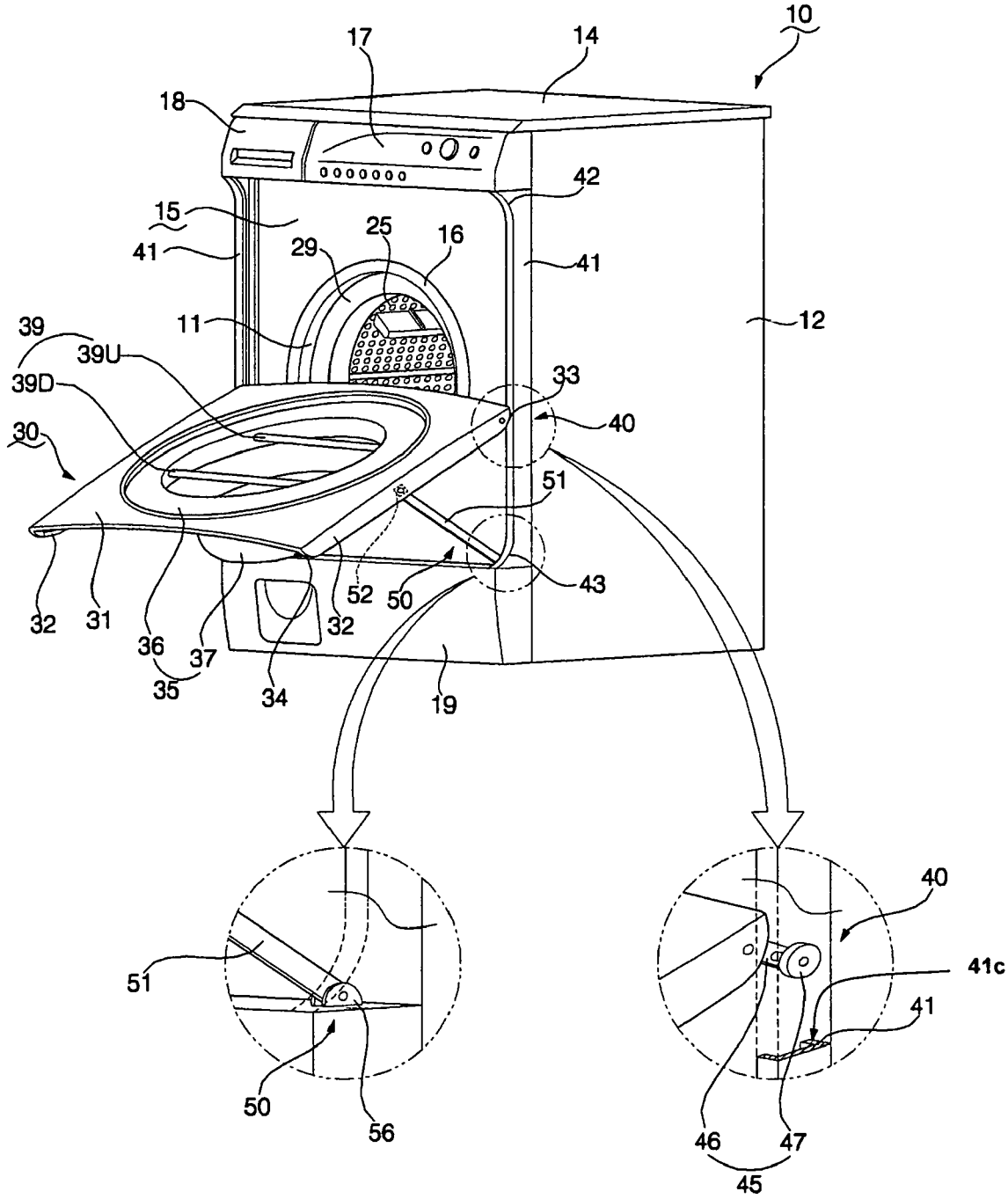
FIG. 3 is a perspective view illustrating a drum washing machine according to a first embodiment of the present invention, together with enlarged views of particular sections thereof.
Figure 4:
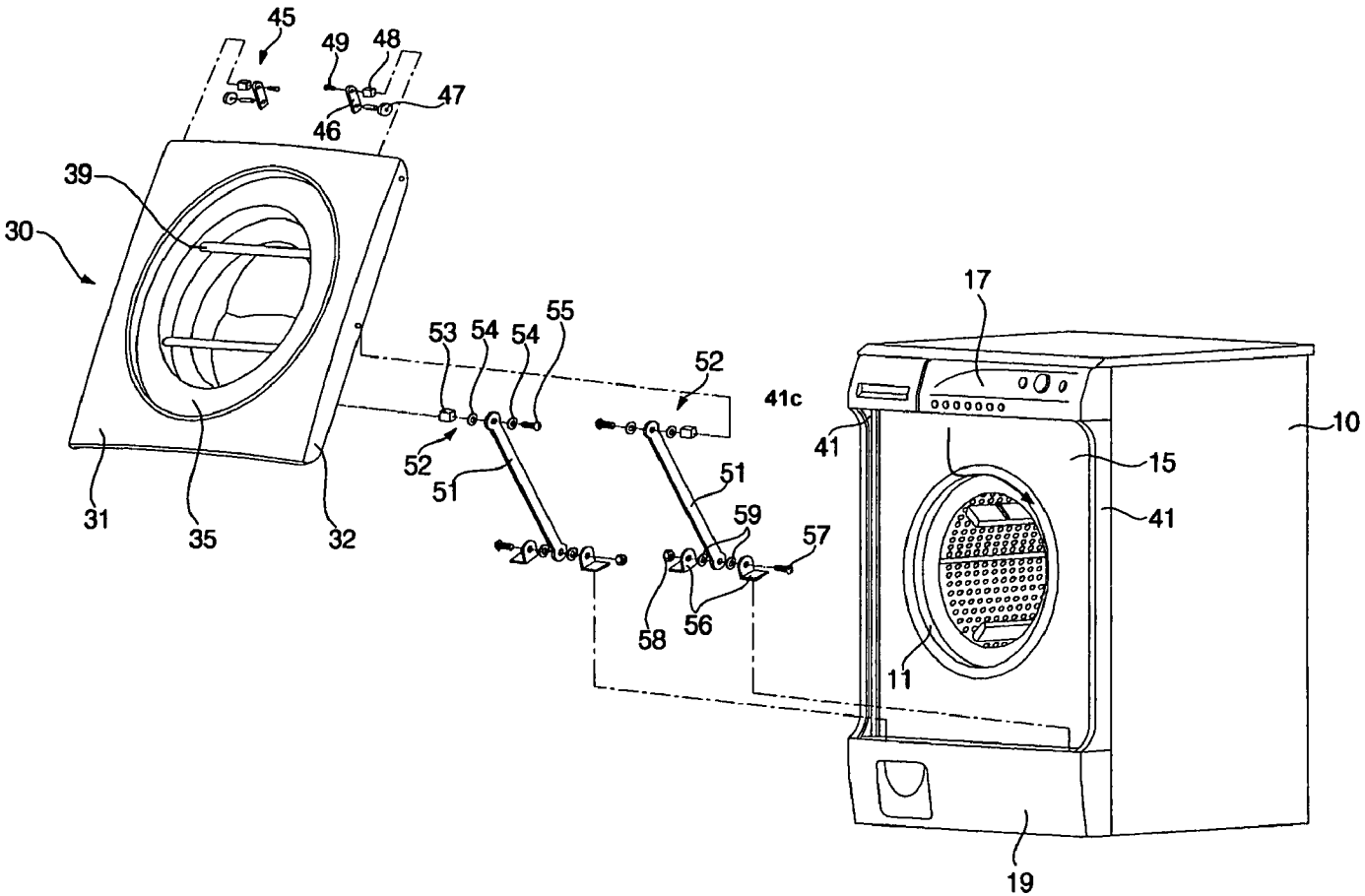
FIG. 4 is an exploded perspective view illustrating the drum washing machine according to the first embodiment of the present invention with a vertically-openable/closable door separated from the drum washing machine.

FIGS. 3 through 6 illustrate a drum washing machine according to a first embodiment of the present invention. Referring initially to FIGS. 3 and 4, for example, the drum washing machine, which is provided with a vertically-openable/closable door, includes a cabinet 10 to form an outer structure of the washing machine. An opening 11 may be provided at a front wall of the cabinet 10 to allow laundry to be put into or taken out of the washing machine.

Figure 5:
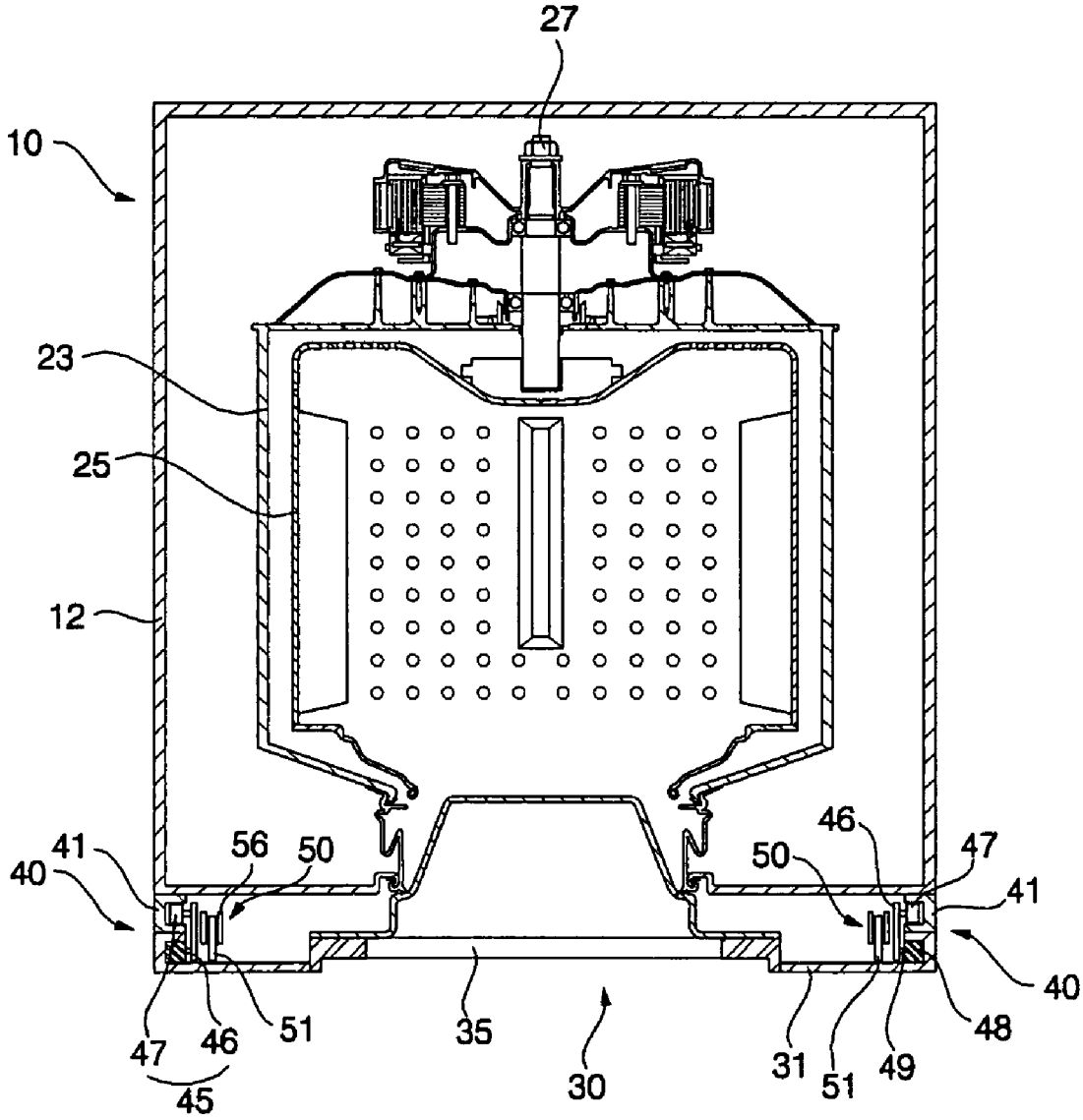
FIG. 5 is a transverse sectional view of the drum washing machine according to the first embodiment of the present invention.
Figure 6:
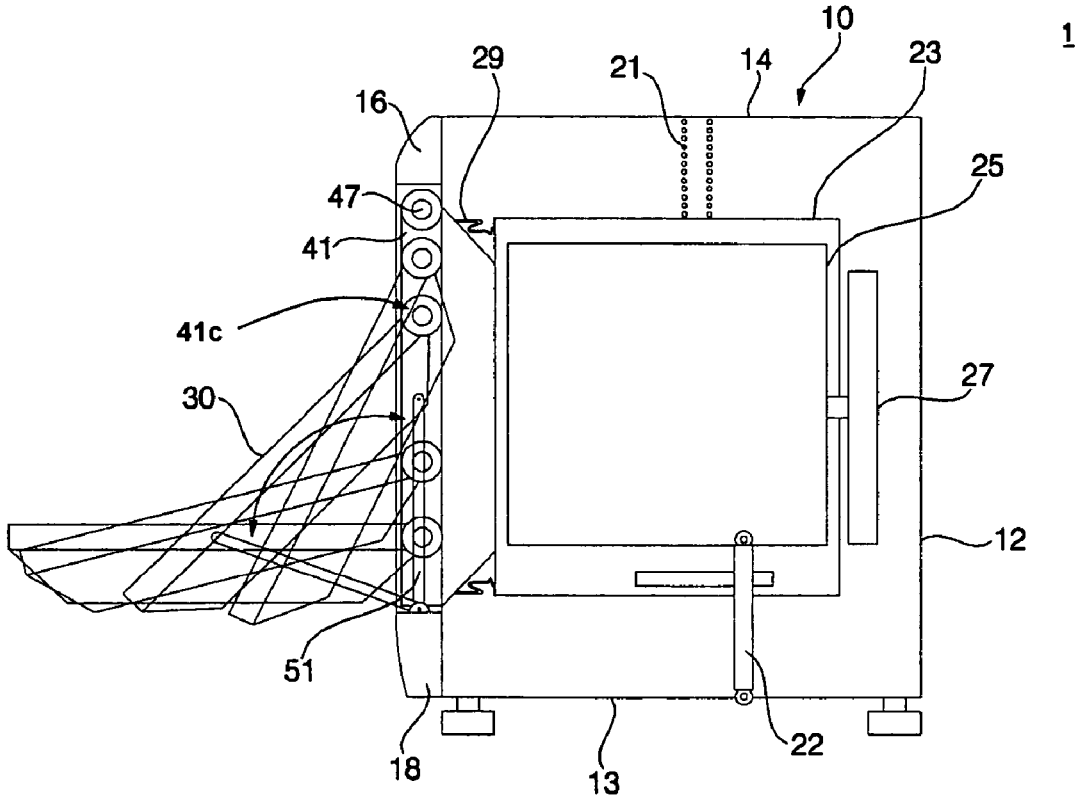
FIG. 6 is a schematic side view illustrating a door of the drum washing machine at various positions as the door opens, according to the first embodiment of the present invention.

Devices to perform a washing operation are installed in the cabinet 10. For example, as shown in FIGS. 5 and 6, the drum washing machine may include a tub 23 supported by a spring 21 and a damper 22 in the cabinet 10 to contain washing water, a drum 25 arranged in the tub 23 to wash laundry while rotating, and a drive motor 27 to rotate the drum 25.

The opening 11 of the cabinet 10 may communicate with respective openings of the tub 23 and drum 25 to allow laundry to be put into or taken out of the drum 25. A gasket 29 may be interposed between the openings of the cabinet 10 and tub 23 to prevent washing water or the like from penetrating the interior of the cabinet 10 during a washing process.

The cabinet 10 may have a substantially hexahedral structure. As shown in FIGS. 3 through 6, for example, the cabinet 10 may include a cabinet body 12 to form side walls and a rear wall of the cabinet 10, a base 13 to form a bottom wall of the cabinet 10, a top cover 14 to form a top wall of the cabinet 10, and a front cover 15 to form a front wall of the cabinet 10. The opening 11 may be formed at the front cover 15.

A control panel 17 may be arranged on a top portion of the front cover 15. The control panel 17 may include various operating switches to operate the washing machine, and a display device to display an operating state of the washing machine (using, for example, a liquid crystal display, a light-emitting diode, a cathode ray tube, and/or any other suitable display technology). Alternatively, the control panel 17 may be arranged at a position other than the above-described position in accordance with the particular design of the washing machine. For example, the control panel 17 may be arranged on the top wall of the cabinet 10, such as, for example, the top cover 14.

A slidable detergent box 18 to supply detergent may be arranged at one side of the control panel 17.

A lower cover 19 may be coupled to the cabinet body 12 and base 13 to form a lower portion of the front cover 15.

Also, a door 30, which may be provided as an example of the above-described vertically-openable/closable door in accordance with the present invention, may be mounted to an outer surface of the front cover 15 to open or close the opening 11. The front cover 15 may be coupled with the cabinet body 12, control panel 17 and lower cover 19 while being retracted into the cabinet 10 with respect to the control panel 17 and lower cover 19, so that the outer surface of the front cover 15 is flush with respective outer surfaces of the control panel 17 and lower cover 19 when the door 30 is closed.

An annular opening rim 16 may be provided at a central portion of the front cover 15 to define the opening 11. The gasket 29 may be fitted in the opening rim 16. The opening rim 16 may be formed integrally with the front cover 15 by bending a portion of the front cover 15 around the opening 11. Alternatively, the opening rim 16 may be provided in the form of a separate ring-shaped member fitted around the opening 11.

The door 30 may have a substantially quadrangular shape similar to the shape of the front cover 15. As illustrated in FIG. 3, the door 30 may have a quadrangular plate structure and include a door frame 31 having a shape conforming to the shape of the outer surface of the front cover 15, and a container-shaped door window 35 having a convex structure extending into the opening 11 of the cabinet 10 when the door 30 is closed, such that the door window 35 comes into close contact with the gasket 29.

The door frame 31 has opposite side portions 32, and each may be formed by bending a corresponding side end portion of the door frame 31 into an "L" shape. The side portions 32 form opposite side walls of the door 30, respectively. Each side portion 32 may be formed, at upper and lower ends thereof, with round surfaces 33 and 34 to prevent the side portion 32 from interfering with the lower cover 19 and vertical guides 41 (to be described hereinafter) when opening or closing the door 30.

The door window 35 may have a container structure which contacts the gasket 29 when the door 30 is closed and which may receive laundry when the door 30 is open. The door window 35 may include an annular window rim 36 mounted to the door frame 31, and a container-shaped window 37 having a concave container structure to receive laundry. The container-shaped window 37 may be fitted in the window rim 36.

The window rim 36 may be made of a metal or synthetic resin material. The container-shaped window 37 may be made of a transparent material such as glass to allow the user to view the interior of the drum 25 through the container-shaped window 37.

A handle 39 may be provided at the door 30 to allow the user to open or close the door 30 while grasping the handle 39. The handle 39 will be described in detail hereinafter.

The door 30 may be vertically movable such that it is opened by moving it downwardly, and is closed by moving it upwardly. When the door 30 is opened, the outer surface of the door 30 is upwardly directed so that, during the process of taking laundry out of the drum 25, the laundry taken out may be temporarily stored in the interior of the door 30.

For such an opening or closing operation of the door 30, an opening/closing guide mechanism may be arranged between the front cover 15 of the cabinet 10 and the door 30 at opposite sides of the door 30. The opening/closing guide mechanism may include a vertical guide mechanism 40 to guide an upper end of the door 30 to move vertically along the outer surface of the front cover 15, and a door support mechanism 50 to support the door 30 during the opening operation of the door 30 such that the door 30 is gradually opened toward a horizontal state and is substantially horizontally maintained in a completely opened state.

The vertical guide mechanism 40 may include two vertical guides 41 mounted to opposite side ends of the outer surface of the front cover 15 to extend vertically, respectively, and two pairs of guide couplers 45 each protruding from the door 30 to move vertically along an associated one of the vertical guides 41.

Each vertical guide 41 may be formed, at an inner surface thereof, with a generally "U"-shaped guide groove. The vertical guides 41 may be provided in the form of separate members so that they may be mounted to the opposite side ends of the front cover 15, respectively. Alternatively, the vertical guides 41 may be formed integrally with the front cover 15 by bending opposite side end portions of the front cover 15 into a generally "U" shape, respectively. Each vertical guide 41 may be formed with round portions 42 and 43 respectively protruding from the upper and lower ends of the vertical guide 41 to conform to the associated round surfaces 33 and 34 of the door frame 31, and respectively joined with the lower surface of the control panel 17 and the upper surface of the lower cover 19.

It is preferable that each guide coupler 45 include a roller 47 to perform a rolling movement along the associated vertical guide 41. However, each guide coupler 45 may include a member having a simple protrusion structure to be slidably received in the associated vertical guide 41, as long as the member satisfies the implementation of the guide coupler 45.

The rollers 47 may be rotatably mounted to roller brackets 46 mounted to the upper end of the door frame 31. Each roller bracket 46 may be connected to a mounting nut 48 fixed to an associated one of the side portions 32 of the door frame 31 by a bracket pin 49 such that the roller bracket 46 is hingably movable within a predetermined angle. Accordingly, when the door moves vertically, the roller bracket 46 hinges about the bracket pin 49, thereby enabling the associated roller 47 to move smoothly along the associated vertical guide 41.

The door support mechanism 50 may include an elongated support rod 51 rotatably connected to the cabinet 10 and door frame 31 at opposite ends of the support rod 51, respectively. The door support mechanism 50 may include two support rods 51 arranged at opposite sides of the door 30, respectively, as illustrated in FIG. 4, for example.

Each support rod 51 may be hingably connected, at an upper end thereof, to an associated one of the side portions 32 of the door frame 31 inside the associated side portion 32 by a hinge 52. As shown in FIG. 4, for example, the connection of each support rod 51 to the door frame 31 may be achieved using elements such as a mounting nut 53 fixed to the inner surface of the associated side portion 32 of the door frame 31 by welding or the like, washers 54 respectively arranged at opposite sides of the support rod 51, and a hinge bolt 55 to extend through the washers 54 and support rod 51 and to be threadedly coupled with the mounting nut 53. Each side portion 32 of the door frame 31 may be partially cut out at a particular region, along which the associated support rod 51 moves, to prevent the side portion 32 from interfering with the support rod 51.

Each support rod 51 may also be hingably connected, at a lower end thereof, to a hinge bracket 56 mounted to an upper end of the lower cover 19 included in the cabinet 10. The connection between the support rod 51 and the hinge bracket 56 may be achieved using elements such as a hinge bolt 57, a nut 58, and washers 59.

As described above, the handle 39 may be provided at the outer surface of the door 30 to allow the user to easily open or close the door 30. The handle 39 may have an elongated bar shape and be mounted to the window rim 36 to extend horizontally.

The washing machine may include two handles 39U and 39D arranged above and below the portion of the door frame 31 connected with the support rod 51, respectively, as illustrated in FIG. 3, for example. In this case, the user can easily open and close the door 30 by pulling the door 30 downwardly while grasping the lower handle 39D to open the door 30, or pulling the door 30 upwardly while grasping the upper handle 39U to close the door 30.

Although the handles 39 are spaced apart from an outer end of the container-shaped window 37 toward the outer surface of the door frame 31 in FIG. 3, for example, the handles 39 may be alternatively arranged at a position far from or near to the position shown in FIG. 3, as long as the implementation of the handles 39 is satisfied. For example, the handles 39 may be arranged on the window rim 36 protruding from the window rim 36.

Hereinafter, operation of the drum washing machine with the vertically-openable/closable door according to the first embodiment of the present invention will be described with reference to FIGS. 7A through 7E.

Figure 7A:
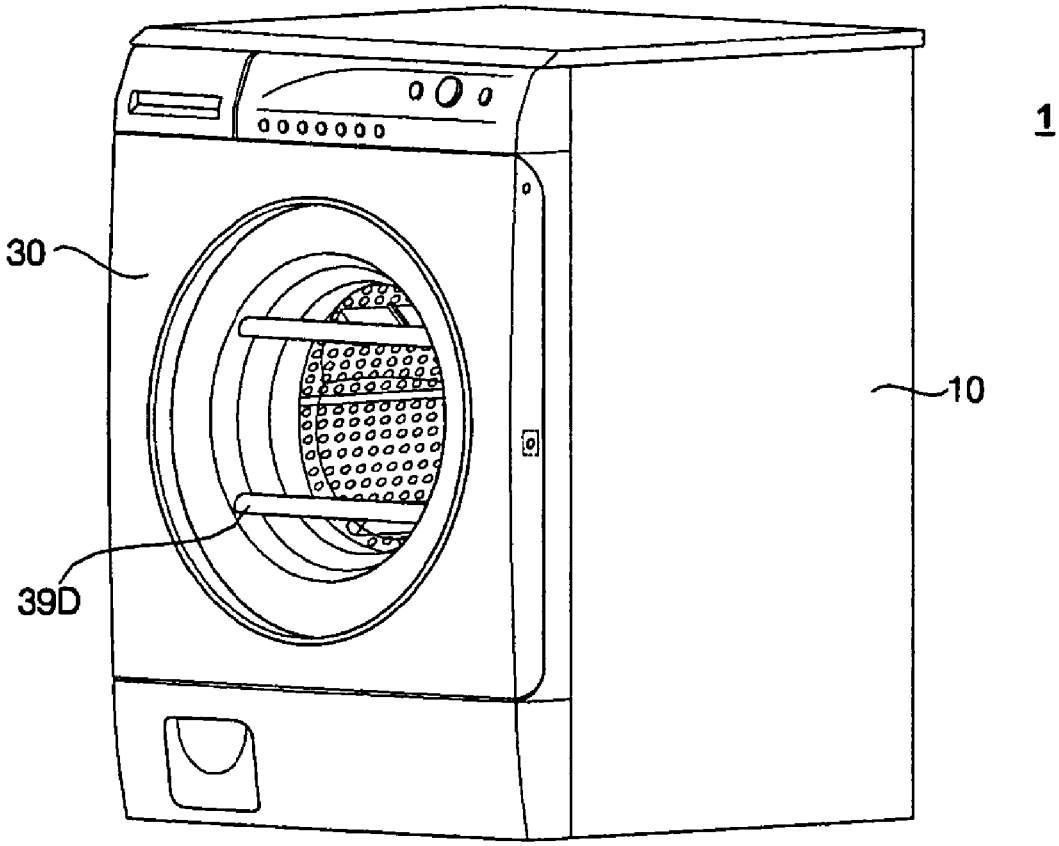
FIGS. 7A through 7E are perspective views respectively illustrating a sequence of door positions of the drum washing machine according to the first embodiment of the present invention as the door opens.
Figure 7B:
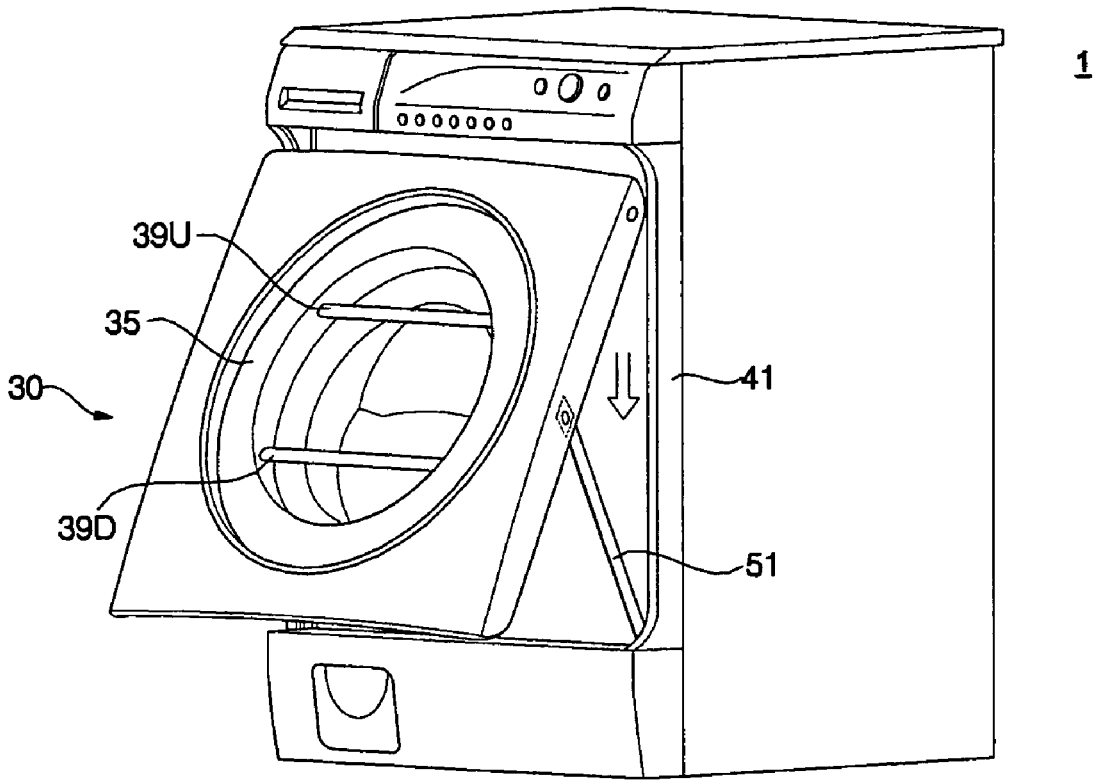
Figure 7C:
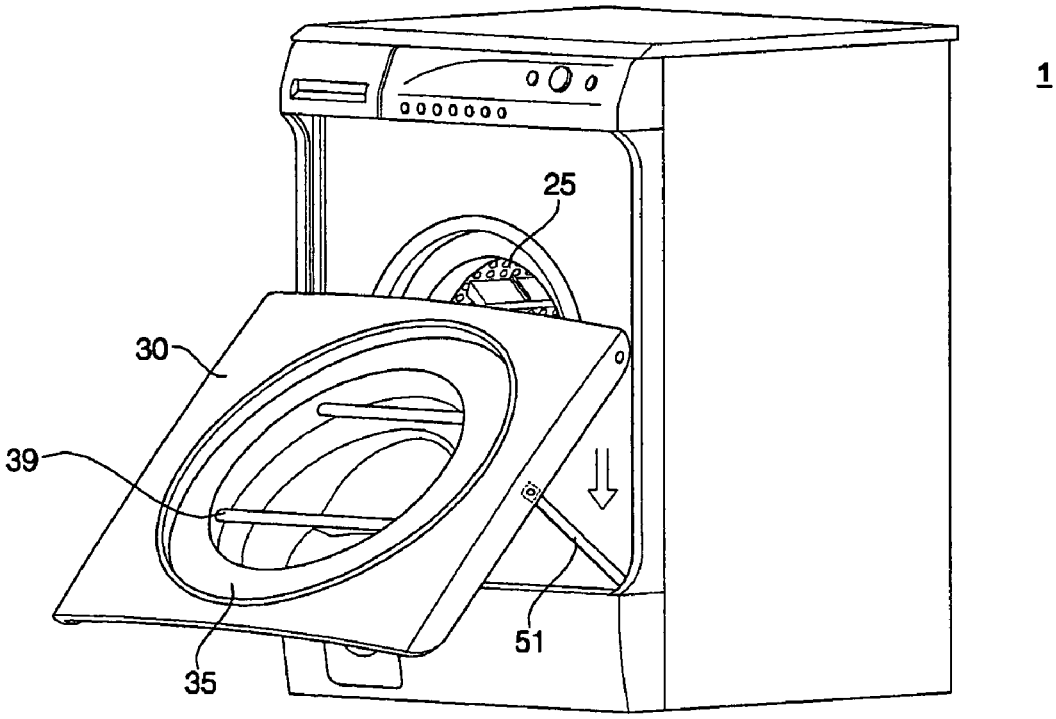
Figure 7D:
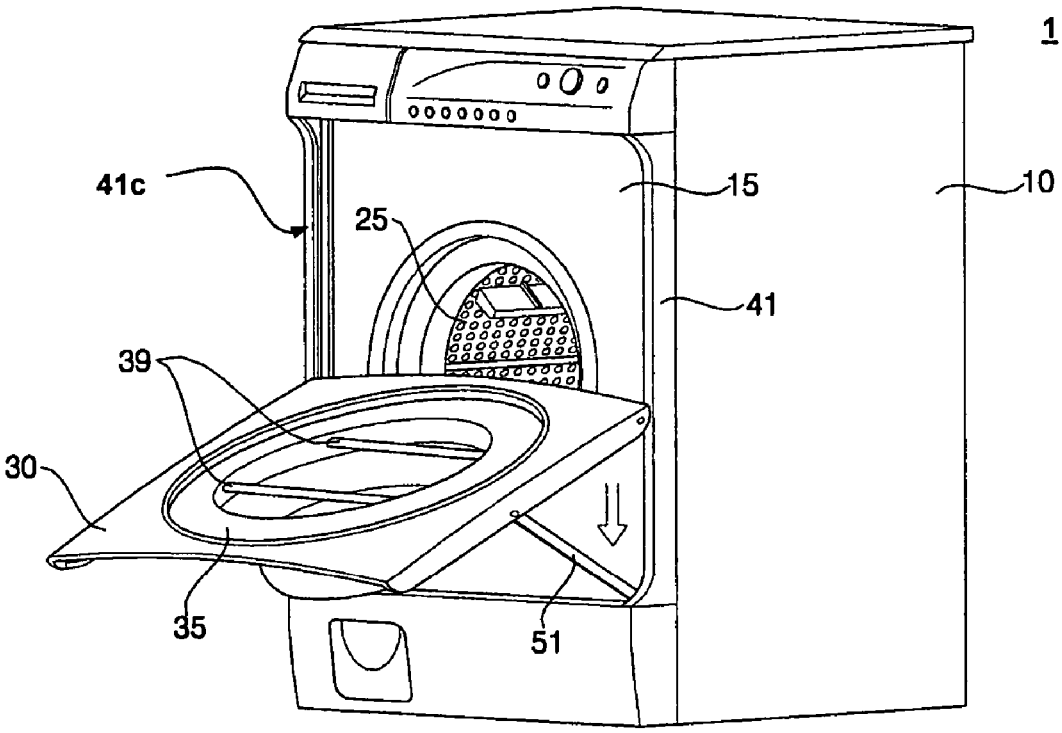
Figure 7E:
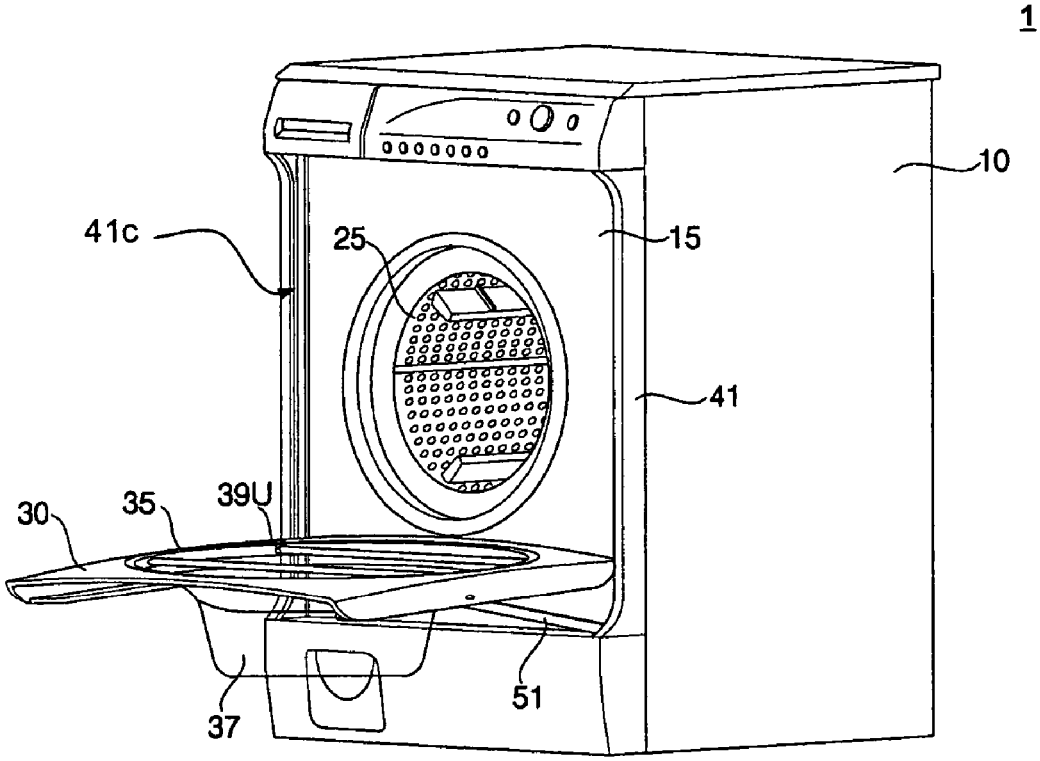

When the user pulls the lower handle 39D of the door 30 downward while grasping the lower handle 39D when the door 30 is closed to open the door 30 (see FIG. 7A), the door 30 is moved according to the sequence shown in FIGS. 7B through 7E such that the upper end of the door 30 is moved downwardly, and the lower end of the door 30 is horizontally and forwardly moved away from the cabinet 10. As a result, the door 30 is opened, as shown in FIG. 7E.

For example, the upper end of the door 30 moves downwardly as the rollers 47 roll downwardly along the associated vertical guides 41. At this time, each support rod 51 hinges about the lower end thereof from a vertical state in accordance with the movement of the door 30 such that the upper end of the support rod 51 moves horizontally and downwardly to be forwardly spaced away from the cabinet 10. In accordance with this movement, the support rod 51 supports the door 30 as the door 30 opens, to enable the lower end of the door 30 to be horizontally and forwardly moved.

When the door 30 is open, the user can put laundry into the drum 25 through the opening 11 of the cabinet 10, and can take laundry out of the drum 25. At this time, the user can also temporarily store the laundry, taken out of the drum 25, in the container-shaped door window 35, if necessary.

The laundry, which is taken out of the drum 25 when the door 30 is open, and temporarily stored in the door window 35, is subsequently taken out of the door window 35 and transferred to another place. When the user pulls the upper handle 39U of the door 30 upward while grasping the upper handle 39U, the door 30 is moved upwardly to be closed.

At this time, the rollers 47 mounted to the upper end of the door 30 roll upwardly along the associated vertical guides 41 in a process reverse of the above described procedure of opening the door 30. The lower end of the door 30 is substantially horizontally moved toward the cabinet 10, and comes into contact with the front cover 15, together with the upper end of the door 30, so that the door 30 is closed.

Figure 8:
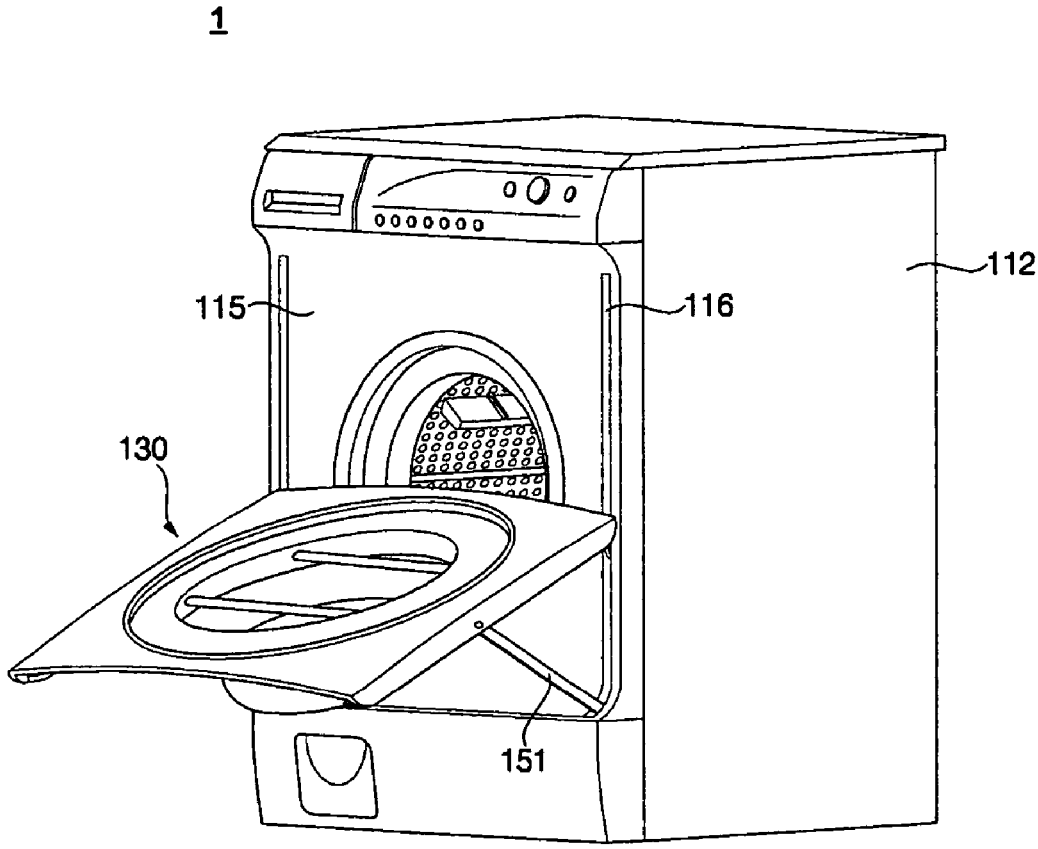
FIG. 8 is a perspective view of a drum washing machine according to a second embodiment of the present invention.
Figure 9:
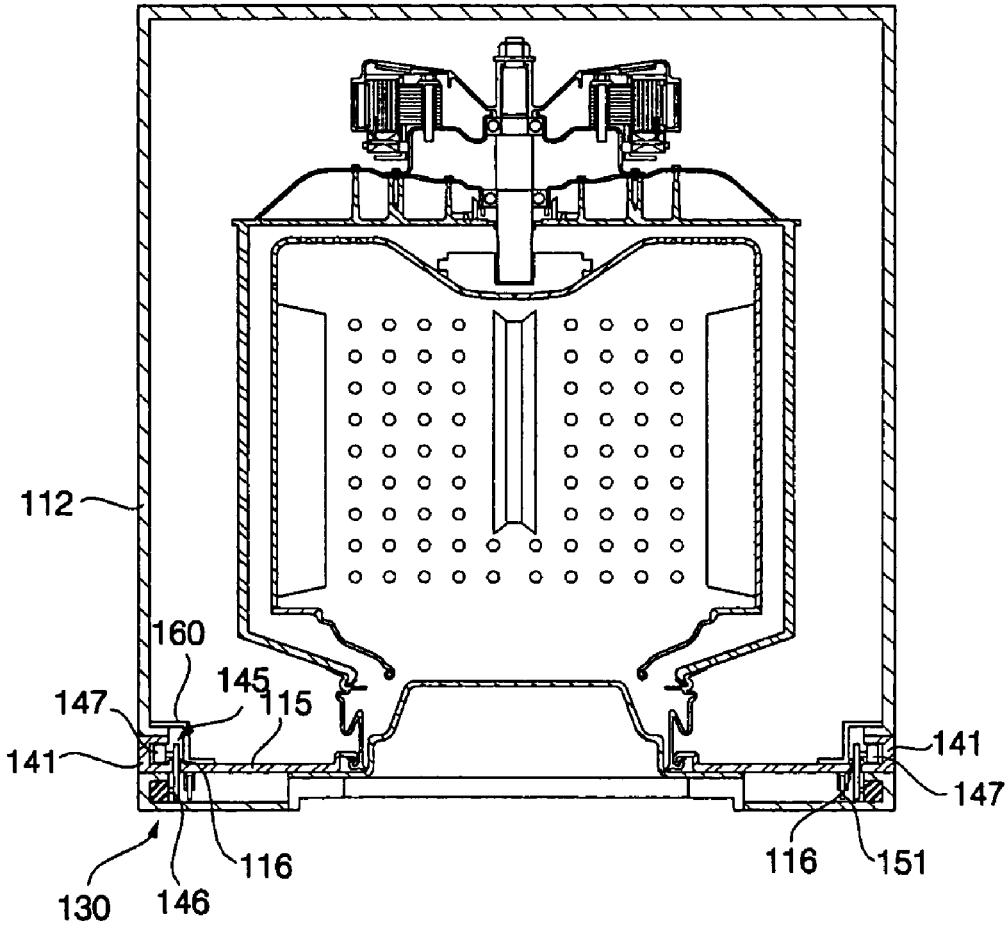
FIG. 9 is a transverse sectional view of the drum washing machine according to the second embodiment of the present invention.

FIGS. 8 and 9 illustrate a drum washing machine according to a second embodiment of the present invention, in which guide couplers 145 provided at a door 130 are received in the front cover 115 such that the guide couplers 145 are vertically movable along vertical guides 141.

Further, vertically-elongated slits 116 are formed at opposite side portions of the front cover 115 to receive the guide couplers 145 such that the guide couplers 145 are movable. The front cover 115 is also provided with the vertical guides 141 in rear of the slits 116, respectively. The vertical guides 141 may be formed by bending opposite side end portions of the front cover 115 into a generally "U" shape. Roller brackets 146 are mounted to the upper end of the door 130 at opposite sides of the door 130, respectively. Each roller bracket 146 extends through an associated one of the slits 116 such that the roller bracket 146 is vertically movable along the associated slit 116 in accordance with a vertical movement of the door 130. A roller 147 is mounted to each roller bracket 146 such that the roller 147 rolls along an associated one of the vertical guides 141 during the vertical movement of the roller bracket 146.

Although the vertical guides 141 have been described as being formed integrally with the front cover 115 by bending the opposite side end portions of the front cover 115, as shown in FIG. 9, the vertical guides 141 may alternatively be provided in the form of separate members so that they may be mounted to the opposite side ends of the front cover 115, respectively, as in the first embodiment.

In order to reinforce the portions of the front cover 115, which may be weakened due to the formation of the slits 116, reinforcing members 160 may be connected between the front cover 115 and the cabinet body 112 or vertical guides 141. In this case, the front cover 115 may have a firmer structure.

The configuration of other aspects of the drum washing machine according to the second embodiment other than the above-described configuration may be similar to the first embodiment, or may be provided according to any other suitable configuration.

In the above-described drum washing machine according to the second embodiment of the present invention, the rollers 147 mounted to the associated roller brackets 146 extending through the associated slits 116 roll along the associated vertical guides 141 in accordance with a vertical movement of the door 130. At this time, the support rods 151 support the opening or closing operation of the door 130, as in the first embodiment, for example.

Figure 10:
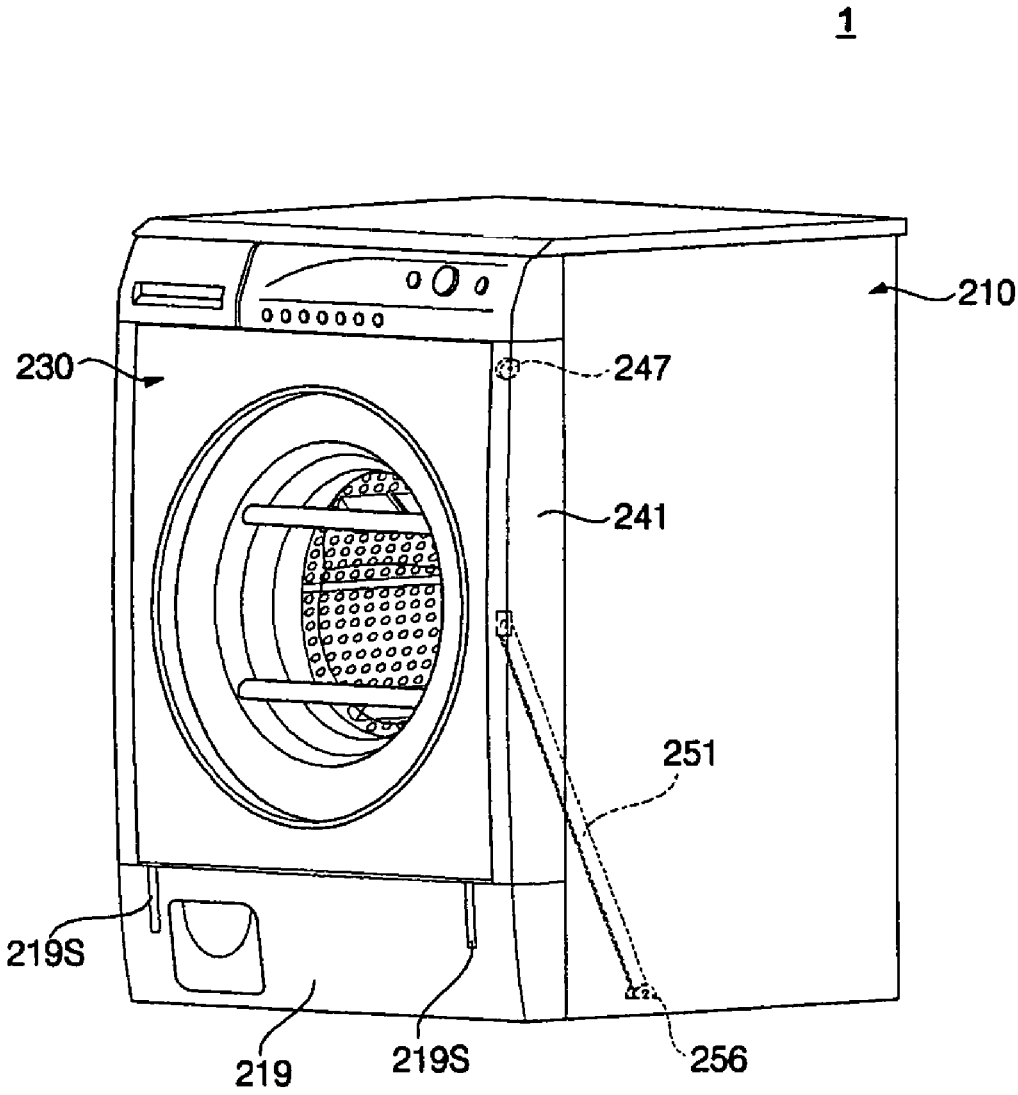
FIG. 10 is a perspective view of a drum washing machine according to a third embodiment of the present invention, illustrating a state in which the door is closed.
Figure 11:
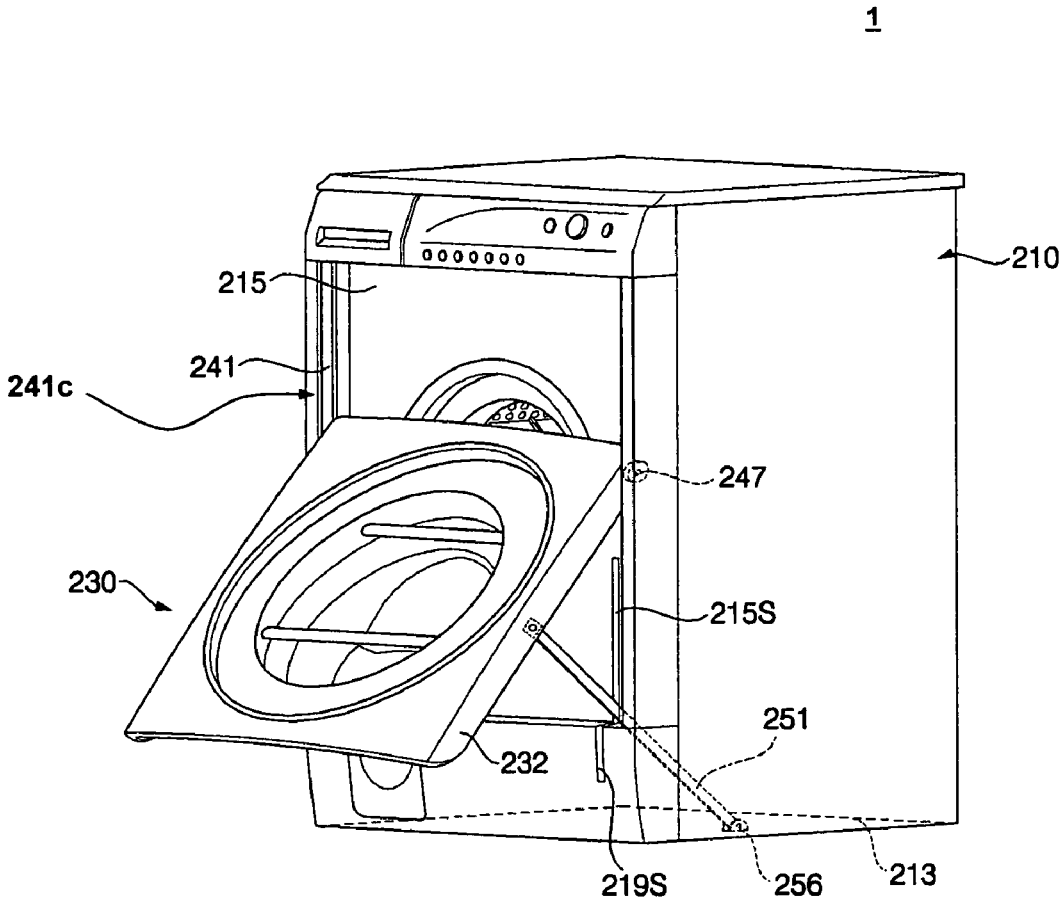
FIG. 11 is a perspective view of the drum washing machine according to the third embodiment of the present invention, illustrating a state in which the door is partially opened.

FIGS. 10 and 11 are perspective views showing a drum washing machine according to a third embodiment of the present invention. FIG.10 shows a closed state of a door of the drum washing machine, and FIG. 11 shows an opened state of the door.

The drum washing machine according to the third embodiment of the present invention may include rollers 247 mounted directly to side portions 232 of a door 230, and support rods 251 mounted to a bottom wall of a cabinet 210.

Also, vertical guide plates 241 may be arranged at opposite side ends of an outer surface of a front cover 215, respectively, such that the outer surface of each vertical guide plate 241 is flush with the outer surface of the door 230. The door 230 is arranged between the vertical guide plates 241. The rollers 247 are directly mounted to the associated side portions 232 of the door 230 at an upper end of the door 230, without using separate roller brackets, such that the rollers 247 are movable along the associated vertical guide plates 241. In this case, a guide groove 241*c* may be formed at an inner surface of each vertical guide plate 241 to receive the associated roller or rollers 247.

Each support rod 251 has an upper end hingably connected to an associated one of the side portions 232 of the door 230, and a lower end extending into the cabinet 210 through the front cover 215 and a lower cover 219 and hingably connected to a base 213 forming the bottom wall of the cabinet 210.

A pair of hinge brackets 256 are mounted to the base 213 to connect respective support rods 251 to the base 213. Vertically-elongated slits 215*s* and 219*s* are formed at the front cover 215 and lower cover 219, respectively, so that the support rods 251 are freely movable and extend through the associated slits 215*s* and 219*s*.

In the above-mentioned drum washing machine according to the third embodiment of the present invention, the door 230 may be horizontally opened in accordance with a downward movement thereof, and closed from the horizontally opened state in accordance with an upward movement thereof, as in the first and second embodiments, for example.

Figure 12:
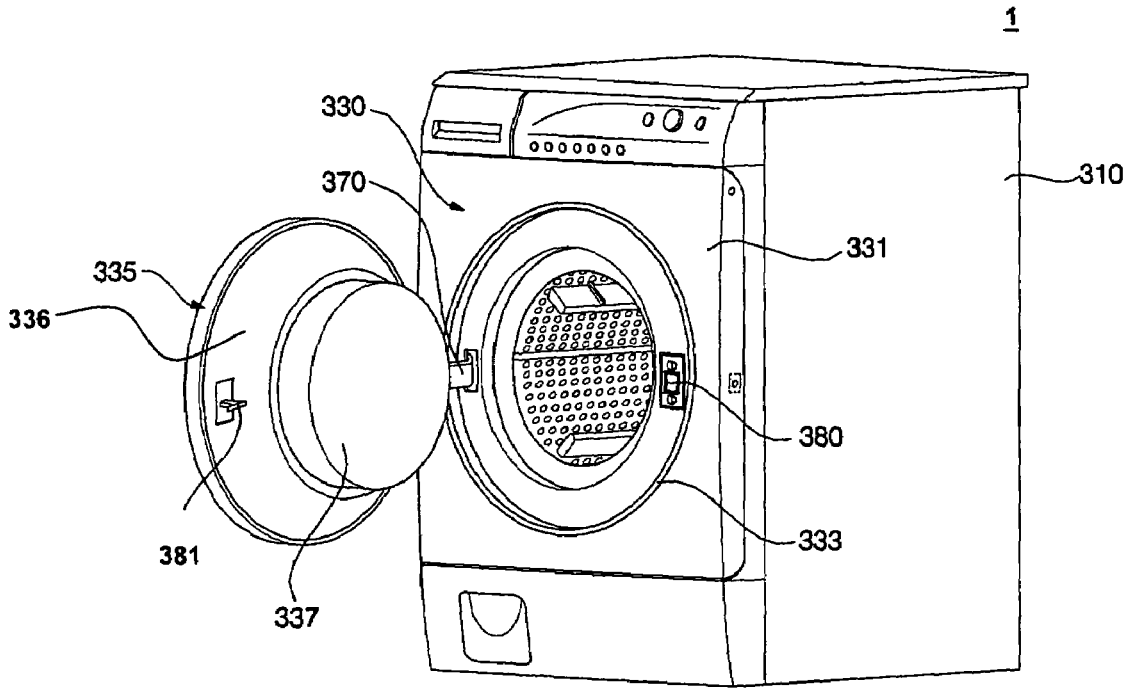
FIG. 12 is a perspective view illustrating a drum washing machine according to a fourth embodiment of the present invention.

FIG. 12 is a perspective view illustrating a drum washing machine according to a fourth embodiment of the present invention, in which the entire door 330 is downwardly openable, as in the above-described first, second and third embodiments, for example, and a door window 335 is horizontally and hingably openable.

For example, the door 330 may include a door frame 331 and the door window 335. The door frame 331 is connected to a cabinet 310 via a vertical guide mechanism and a door support mechanism (not shown) so that the door frame 331 is vertically movable to vertically open or close the door 330. The door window 335 is connected to the door frame 331 via a hinge mechanism 370.

The vertical guide mechanism and door support mechanism may have configurations similar to any of the suitable above-described embodiments, respectively, for example.

Also, the door window 335 may include a window rim 336 and a container-shaped window 337 fitted in the window rim 336, as in the above-described embodiments, for example.

In accordance with the fourth embodiment of the present invention, the door frame 331 may be provided with a window frame 333, in which the door window 335 is fitted when the door window 335 is closed. A locking device 380 may be mounted to the window frame 333 to prevent the door window 335 from being opened by securing a latch 381 on the door window 335.

In the above-described drum washing machine according to the fourth embodiment of the present invention, accordingly, the user not only can downwardly open the entire door 330 by hingably moving the door frame 331, but also can horizontally and hingably open a portion of the door 330, that is, the door window 335, as in conventional drum washing machines, for example.

As apparent from the above description, a drum washing machine with a vertically-openable/closable door according to the present invention can allow the user to conveniently perform loading and unloading of laundry at either side of the drum washing machine because the door is vertically movable to be opened or closed. Because the door can be completely opened even where the washing machine is installed in a limited space, there is an advantage in that the loading and unloading of laundry can be easily achieved without any interference by the door.

Also, because the door window of the door has a container-shaped structure, the door window can be used as a laundry holder when the door is completely opened to be horizontally maintained. Accordingly, it is possible to solve the problem of dropping laundry to the floor when taking the laundry out of the washing machine, for example, by moving the laundry from the washing machine to the door window. Thus, improved convenience for the user may be achieved.

In accordance with an aspect the present invention, it is also possible not only to vertically open the entire door, but also to horizontally and hingably open a portion of the door. Accordingly, it is possible to achieve a more convenient door opening operation in accordance with a selection by the user.

Figure 13:
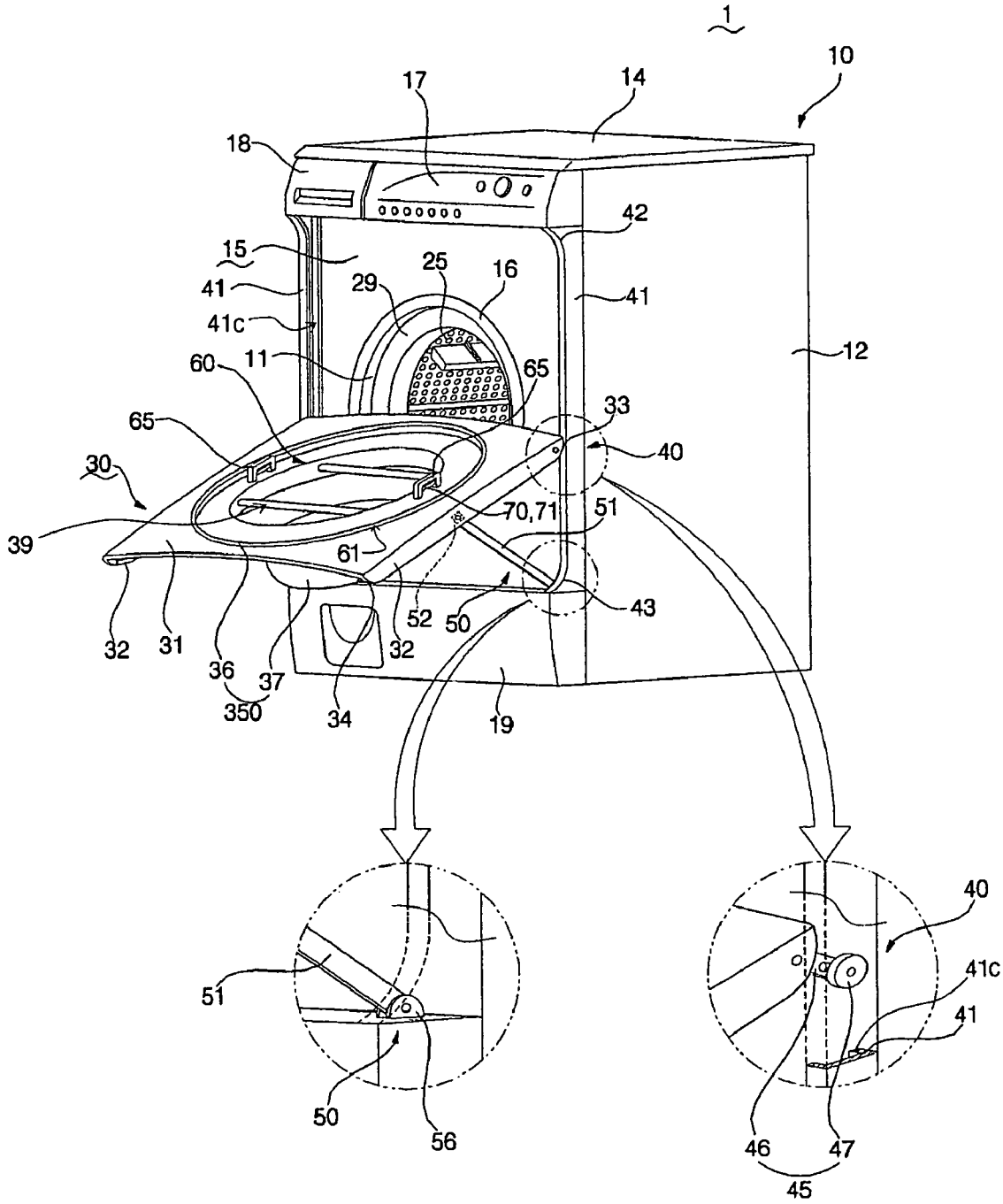
FIG. 13 is a perspective view showing a drum washing machine according to a fifth embodiment of the present invention, including enlarged cutaway perspective views of sections of the drum washing machine.
Figure 14:
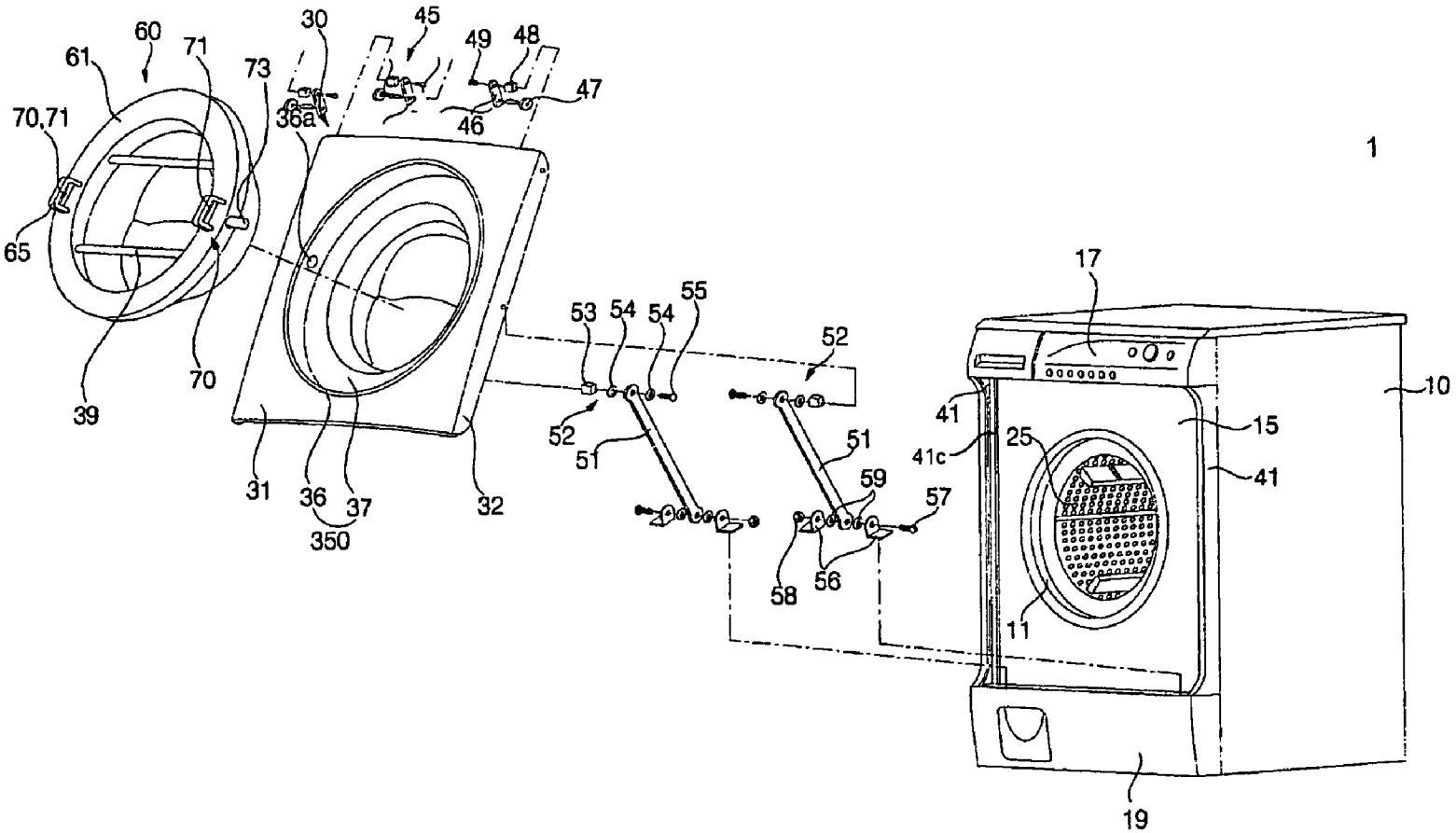
FIG. 14 is an exploded perspective view showing a door of the drum washing machine according to the fifth embodiment shown in FIG. 13.
Figure 15:
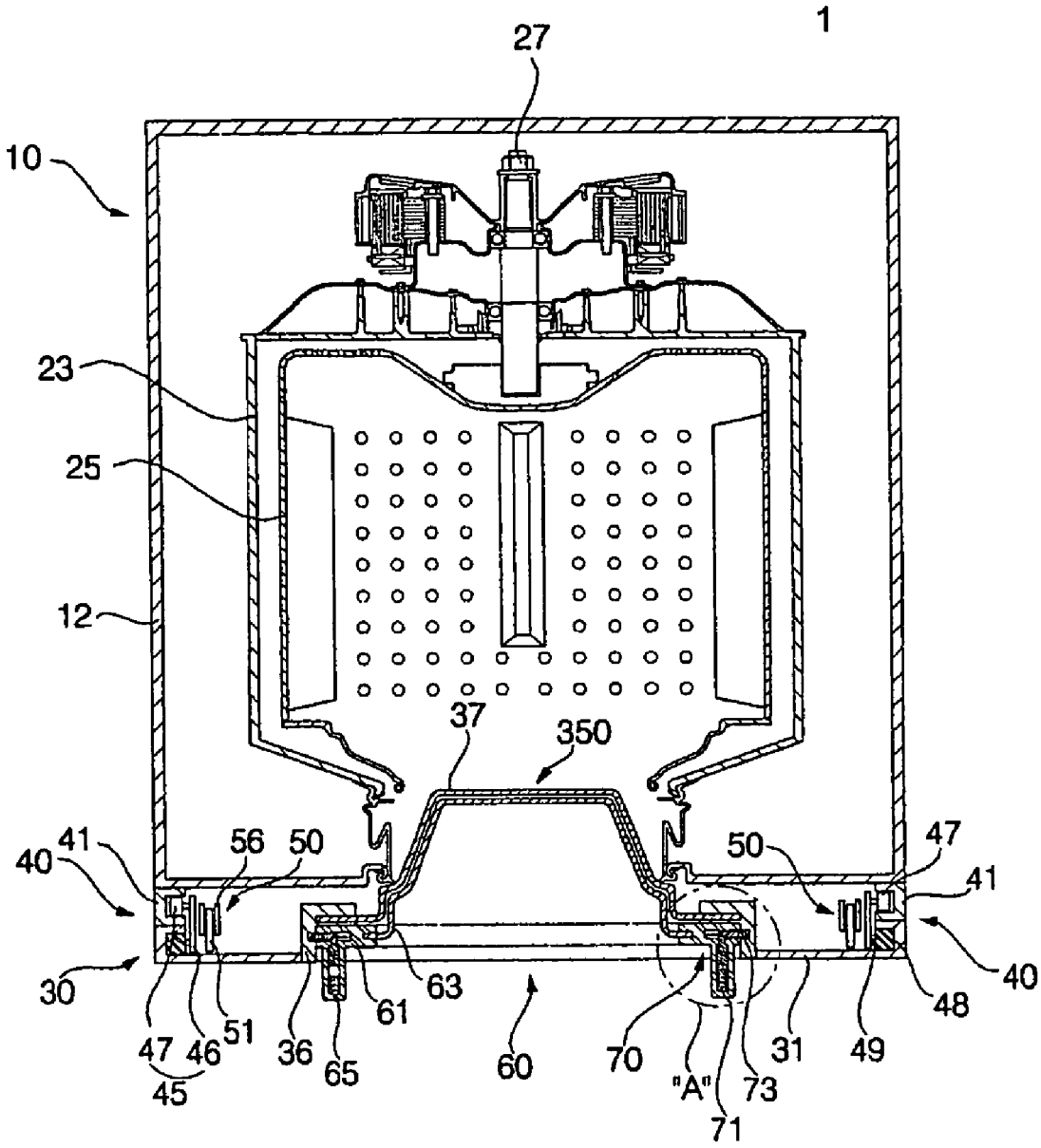
FIG. 15 is a cross-sectional view of the drum washing machine according to the fifth embodiment shown in FIG. 13.

Referring to FIGS. 13 and 14 in regard to a fifth embodiment of the present invention, a drum washing machine 1, which is provided with a basket 60 attached to the door 30 may include a cabinet 10 to form an outer structure of the washing machine 1. An opening 11 is provided at a front wall of the cabinet 10 to allow laundry to be put into or taken out of the washing machine 1.

The door 30 may have a substantially quadrangular shape similar to the shape of the front cover 15. In FIG. 14, the door 30 has a quadrangular plate structure and includes a door frame 31 having a shape conforming to the shape of the outer surface of the front cover 15, a container-shaped door window 350 having a convex structure extending into the opening 11 of the cabinet 10 when the door 30 is closed such that the container-shaped door window 350 comes into close contact with the gasket 29, and a basket 60 detachably attached to the container-shaped door window 350 such that the laundry may be put in the basket 60, the basket 60 formed to connect with the container-shaped window 350.

The container-shaped door window 350 may have a convex container structure in which the container-shaped door window 350 comes into contact with the gasket 29 when the door 30 is closed, and the basket 60 is attached to the container-shaped door window 350. The door window 350 may include an annular window rim 36 mounted to the door frame 31, and a container-shaped inner window 37 having a concave container structure. The container-shaped inner window 37 may be fitted in the window rim 36, and come into contact with the gasket 29 when the door 30 is closed.

The basket 60 may be inserted into the container-shaped door window 350 from the front of the door 30 such that the basket 60 is attached to the door 30. At both sides of the basket 60 are separate basket handles 65 and a locking mechanism 70 to prevent the basket from being separated from the container-shaped door window 350, which will be described below in detail.

Figure 17A:
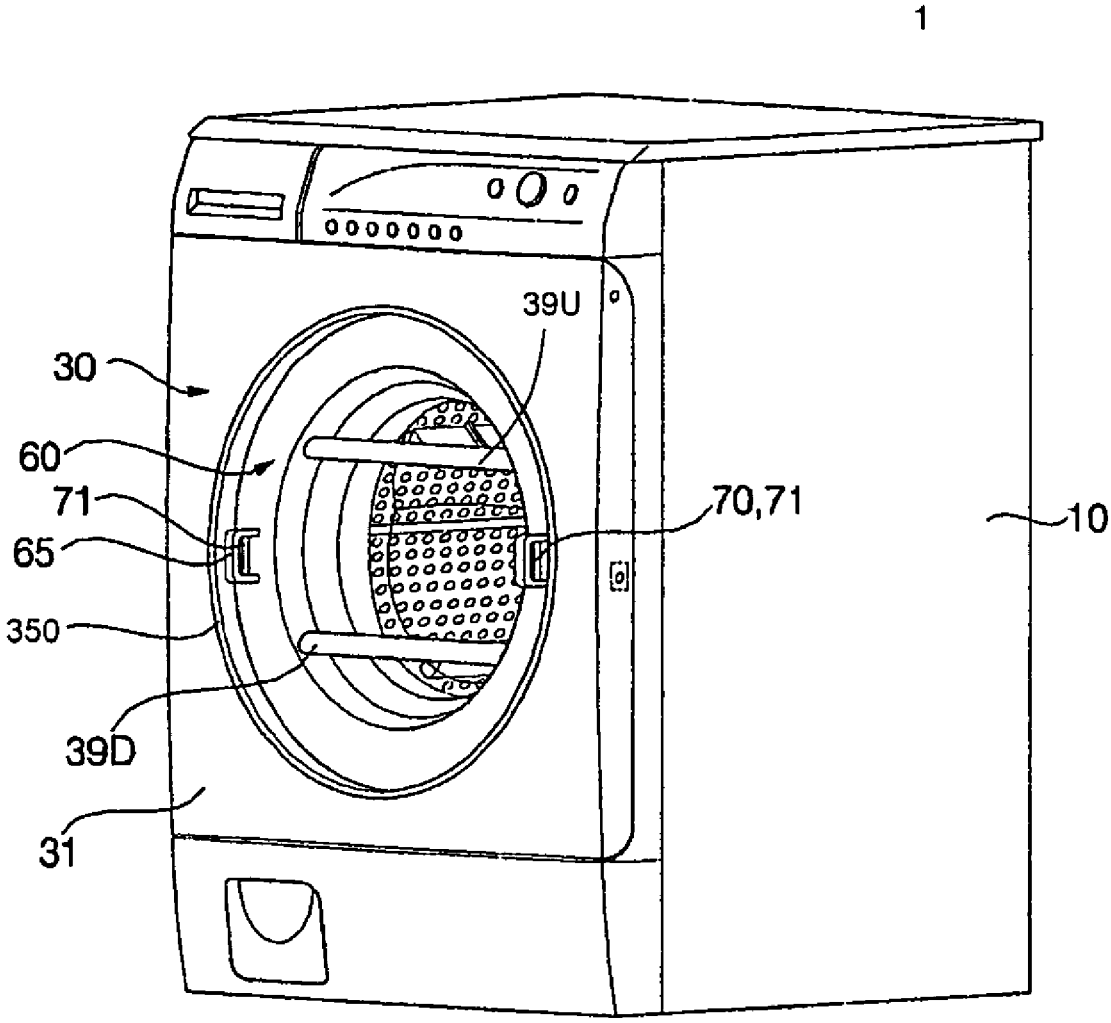
FIGS. 17A through 17E are perspective views respectively illustrating a sequence of door positions of the drum washing machine as the door opens, according to the fifth embodiment shown in FIG. 13.

At least one door handle 39 is provided at the door 30 to allow the user to open or close the door 30 while grasping the handle 39. The door handle 39 may be disposed at the door frame 31 or the container-shaped door window 350. For example, as shown in FIG. 17A, a pair of door handles, i.e., two door handles 39U and 39D, may be attached to the basket 60. The two door handles 39U and 39D may be horizontally arranged and spaced apart from each other.

The door 30 is vertically movable such that it may be opened by moving the door 30 downwardly, and closed by moving the door 30 upwardly. When the door 30 is opened, the outer surface of the door 30 is upwardly directed so that, when removing laundry from the drum 25, the removed laundry may be temporarily stored in the basket 60.

As described above, the basket 60 may be attached to the door 30 such that the laundry is put into the basket 60 while the door 30 is horizontally opened. The basket 60 may further include a basket rim 61 formed in the shape of a circular ring, and a basket window 63 attached to the basket rim 61. The basket window 63 may be formed in the shape of a container in which the laundry may be placed.

The basket rim 61 may be fitted in the window rim 36 of the container-shaped door window 350. The basket handles 65 may be respectively mounted to both sides of the basket rim 61. Also, the locking mechanism 70 may be disposed at both sides of the basket rim 61.

The basket window 63 may be inserted in the inner window 37 of the container-shaped door window 350. Both the inner window 37 and the basket window 63 may be made of a transparent material such that the interior of the drum 25 can be seen from the outside.

Although the inner window 37 may be made of glass, for example, it is preferable that the basket window 63 be made of transparent synthetic resin or reinforced glass so that the basket window 63 is not easily broken when the basket window 63 is separated from the door 30.

The basket handles 65 are preferably mounted to both sides of the basket 60, respectively. The locking mechanism 70 may be disposed inside the basket handles 65 of the basket 60 such that the locking mechanism 70 cooperates with the basket handles 65, respectively.

Figure 16A:
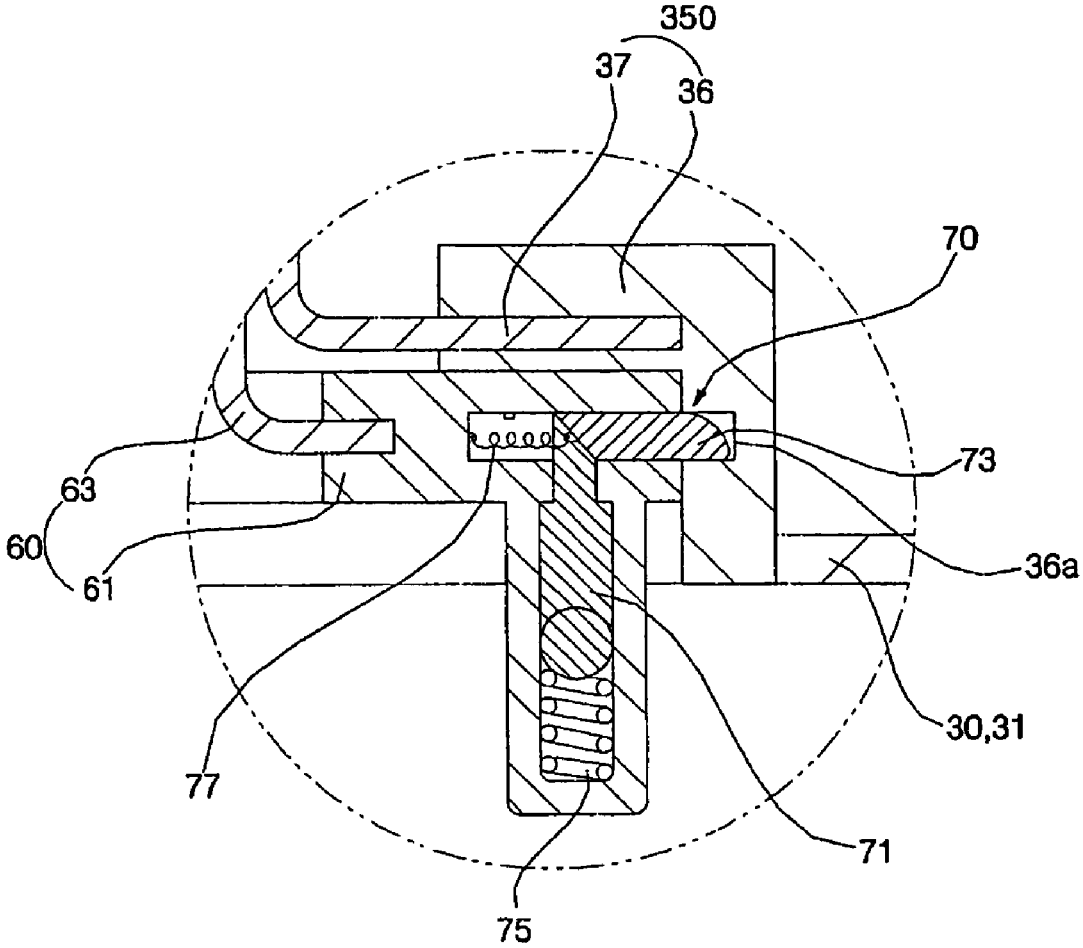
Figure 16B:
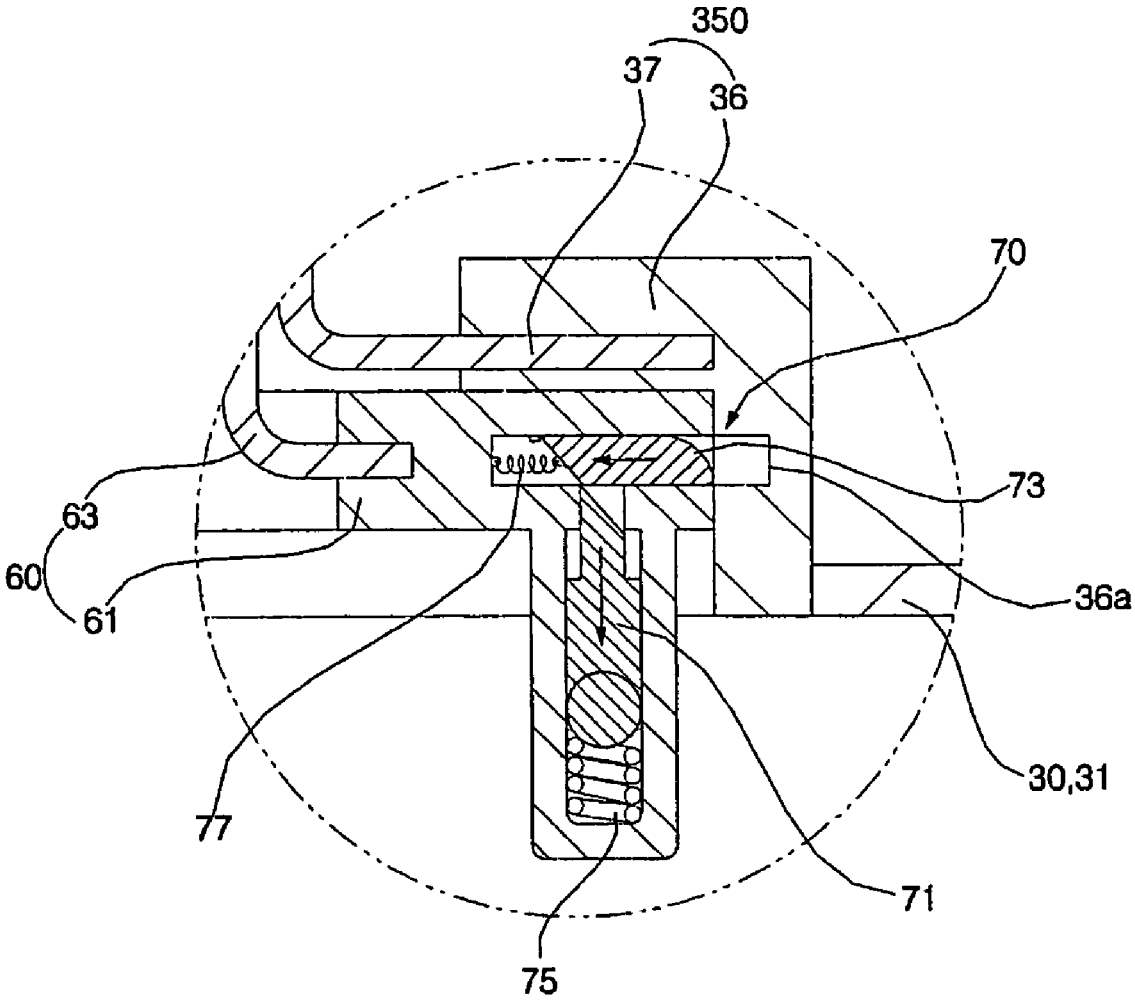

The locking mechanism 70 prevents the basket 60 from being undesirably separated from the door 30. As shown in FIGS. 16A and 16B, for example, the locking mechanism 70 may include a locking release lever 71 disposed inside the basket handle 65 such that the locking release lever 71 is linearly movable when the locking release lever 71 is pulled by a user; a locking pin 73 disposed in the basket rim 61 such that the locking pin 73 can extend outward for cooperating with the locking release lever 71 such that the locking pin 73 is latched by the window rim 36 of the container-shaped door window 350; and several locking springs 75 and 77 to provide elastic forces to the locking release lever 71 and the locking pin 73 such that the locking pin 73 is urged to a locking position.

At the window rim 36 of the container-shaped door window 350 locking holes 36*a* may be formed, in which the locking pins 73 are inserted, respectively.

When each of the basket handles 65 is formed in a generally "U" shape, for example, each of the locking release levers 71 is preferably also formed in a generally "U" shape such that the locking release lever 71 can be moved forward and backward while being inserted, in a line, in the corresponding basket handle 65. Specifically, the middle part of the locking release lever 71 is disposed in parallel with the middle part of the corresponding basket handle 65 such that the middle part of the locking release lever 71 can be pulled by the user, and the side parts of the locking release lever 71, which are connected to the middle part of the locking release lever 71 while being perpendicular to the middle part of the locking release lever 71, are inserted in the corresponding basket handle 65. One of the side parts of the locking release lever 71 extends into the basket rim 61 such that the locking release lever 71 cooperates with the corresponding locking pin 73.

The cooperation of the locking release lever 71 with the locking pin 73 is preferably accomplished through contact of inclined cam surfaces of the locking release lever 71 and the locking pin 73, which are generally perpendicular to each other.

The locking spring 75, which provides the elastic force to the locking release lever 71, may be a compression spring disposed in the handle 65 for providing the elastic force to the locking release lever 71 such that the locking release lever 71 is pushed toward the locking pin 73. The locking spring 77, which provides the elastic force to the locking pin 73, may be a tension spring disposed in the basket rim 61 for providing the elastic force to the locking pin 73 in the direction in which locking of the locking pin 73 is released.

The elastic force of the compression spring 75 may be greater than that of the tension spring 77. Consequently, the locking pin 73 urged toward the locking position by the elastic force of the compression spring 75 of the locking release lever 71, unless the locking release lever 71 is pulled.

As described above, for example, the locking mechanism 70 may cooperate with the handles 65 of the baskets 60, respectively, although alternatively, the locking release levers 71 and the locking pins 73 may be disposed at the door window 350, and the locking holes may be formed at the basket 60.

In the above-described embodiment, the basket 60 may be separated from the container-shaped door window 350, although alternatively, the entire container-shaped door window 350 may be separated from the door frame 31, if necessary.

Specifically, the container-shaped door window 350 may be separated from the door frame 31 when the container-shaped door window 350 is formed in the shape of a container such that the container-shaped door window 350 serves as the basket 60. The basket handles 65 and the locking mechanism 70 may have the same or similar structures in this configuration as described above, for example. In this case, a sealing member (not shown) is preferably disposed between the door frame 31 and the container-shaped door window 350.

Now, a description will be given of how to open or close the door 30 of the drum washing machine 1 and how to separate the basket 60 of the drum washing machine 1 with the above-stated constructions.

Figure 17B:
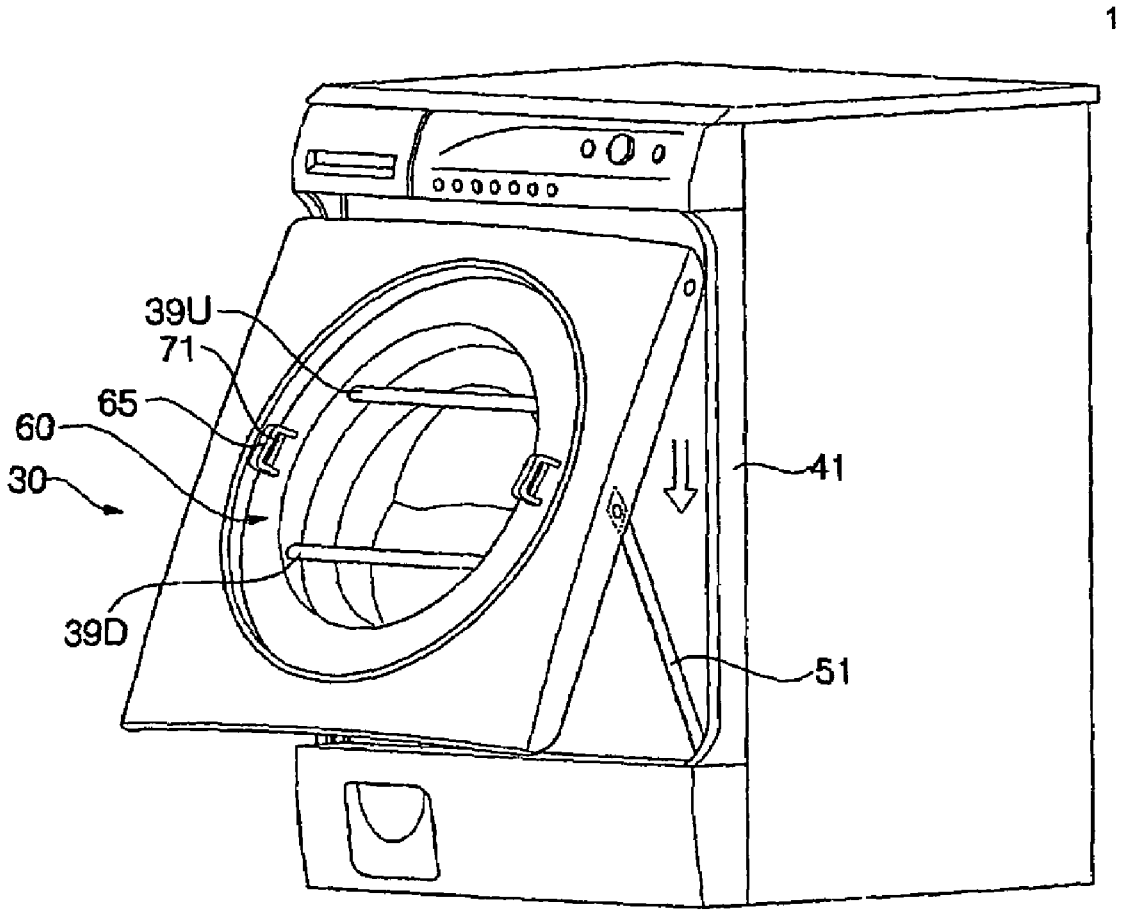
Figure 17C:
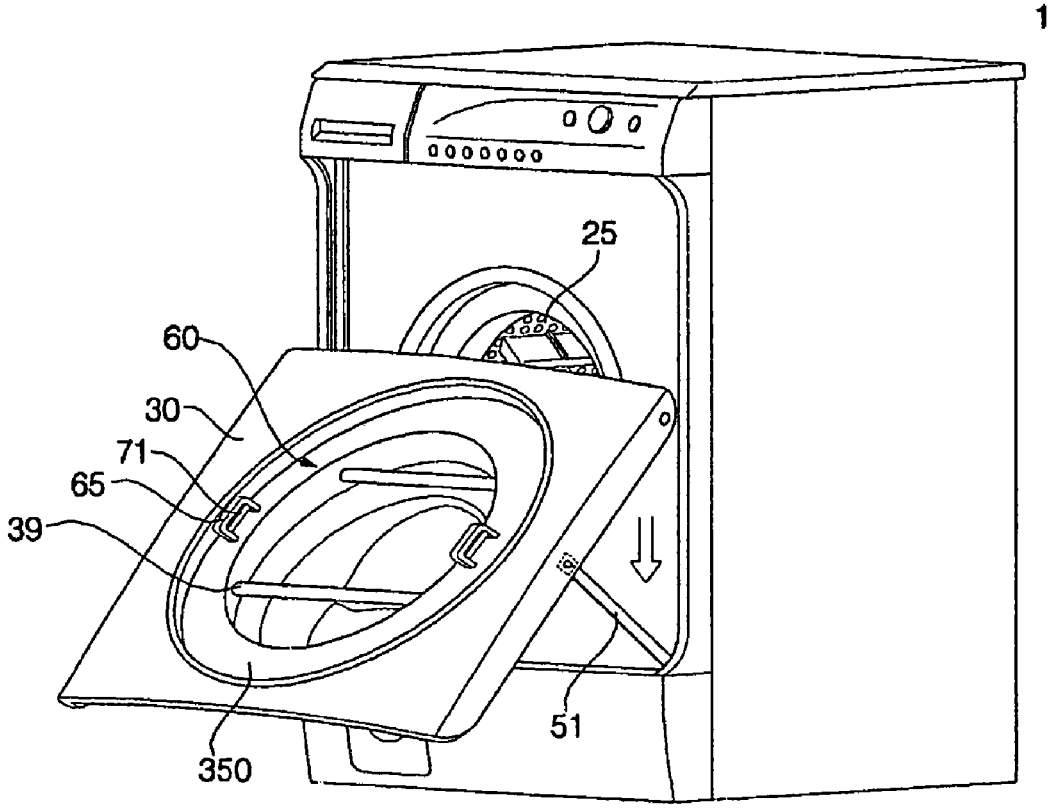
Figure 17D:
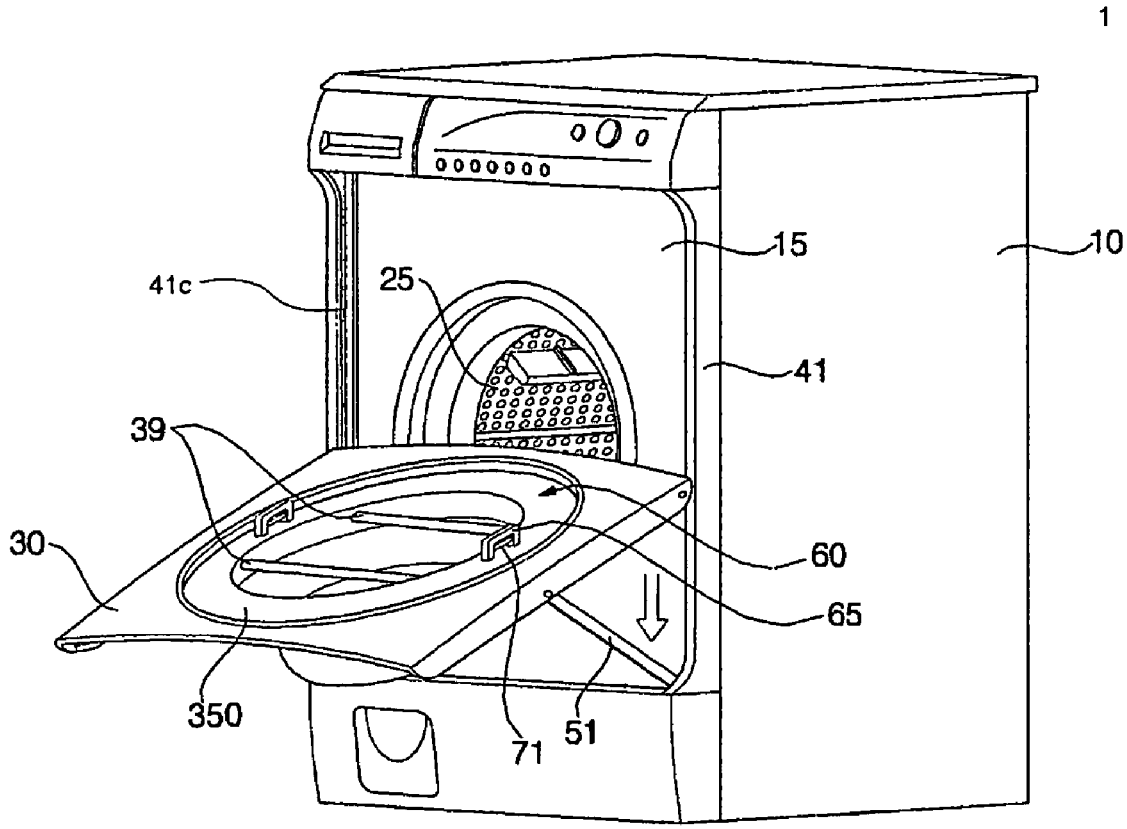
Figure 17E:
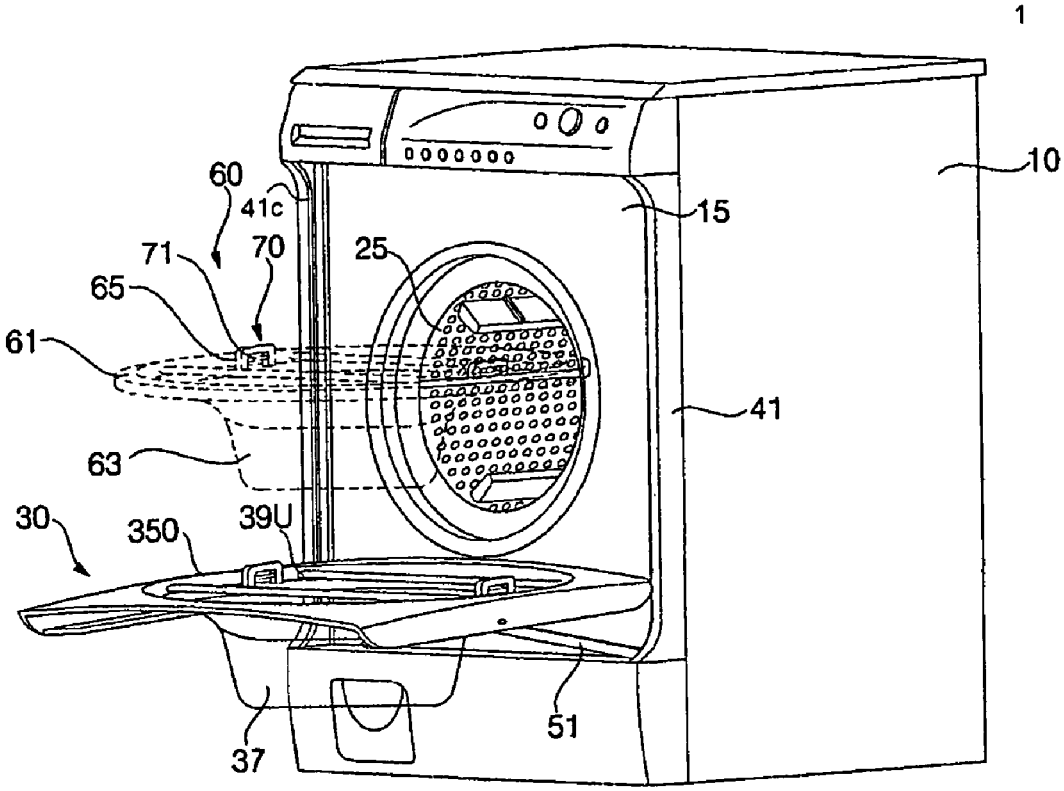

FIGS. 17A through 17E are respective perspective views of sequential door opening states of the drum washing machine 1 according to the fifth embodiment of the present invention. In particular, FIG. 17E shows how the basket 60 may be separated from the door 30 when the door 30 is fully opened.

For example, when the user pulls the lower handle 39D of the door 30 downward while grasping the lower handle 39D when the door 30 is closed, as shown in FIG. 17A, in order to open the door 30, the door 30 is moved through the positions shown in FIGS. 17B though 17D such that an upper end of the door 30 is moved downward, and a lower end of the door 30 is moved horizontally and forwardly away from the cabinet 10. As a result, the door 30 may be opened as shown in FIG. 17E.

In the basket 60 attached to the door 30, as shown in FIG. 16A, the locking pins 73 of the locking mechanism 70 are inserted in the corresponding locking holes of the container-shaped door window 350, which guarantees that the basket 60 is securely attached to the door 30.

When the door 30 is open, the user can put laundry into the drum 25 through the opening 11 of the cabinet 10, and can take laundry out of the drum 25. At this time, the user can also temporarily store the laundry taken out of the drum 25 in the basket 60 attached to the door 30, if necessary.

The laundry which has been put in the basket 60 may be transferred to another laundry container so as to transfer the laundry somewhere else. In this embodiment of the present invention, however, the basket 60 may be separated from the door 30, and therefore, the laundry can be transferred while the laundry is in the basket 60.

For example, when the basket handles 65 are gripped, and simultaneously, the locking release levers 71 of the locking mechanism 70 are pulled while the laundry is put in the basket 60, the locking pins 73 are disengaged from the locking holes 36*a*, respectively, because of the elastic forces of the tension springs 77, as shown in FIG. 16B. Then, the basket 60 is raised while the handles 65 are held, as shown in FIG. 17E, to transfer the basket 60 while the laundry is in the basket 60.

After that, the basket 60 may be inserted into the container-shaped door window 350 such that the basket 60 is attached to the door 30. When the user pulls the upper handle 39U of the door 30 upward while grasping the upper handle 39U, the door 30 may be moved upward to be closed.

At this time, the rollers 47 mounted to the upper end of the door 30 roll upwardly along the associated vertical guides 41 in accordance with a procedure substantially reverse the above-described procedure for opening the door 30. The lower end of the door 30 is substantially horizontally moved toward the cabinet 10, and comes into contact with the front cover 15, together with the upper end of the door 30, so that the door 30 is closed. At this time, the basket 60 is securely attached to the door 30 by the locking mechanism 70.

As apparent from the above description, the present invention may further provide a drum washing machine with a basket on a door, in which the door may be moved downward such that the door is approximately horizontally opened, the basket may be attached to the door such that the laundry may be taken out of the drum washing machine, and then put into the basket, and the basket may be separated from the door to transfer the laundry, in which the door may be fully opened even where the washing machine is installed in a limited space.

As a result, the laundry may be easily taken out of the drum washing machine after washing has been completed, and the laundry may be conveniently transferred to a desired place using the basket, without having to use an additional laundry container. Consequently, a convenient laundry loading and/or unloading process and improved user convenience may be achieved.

Figure 18:
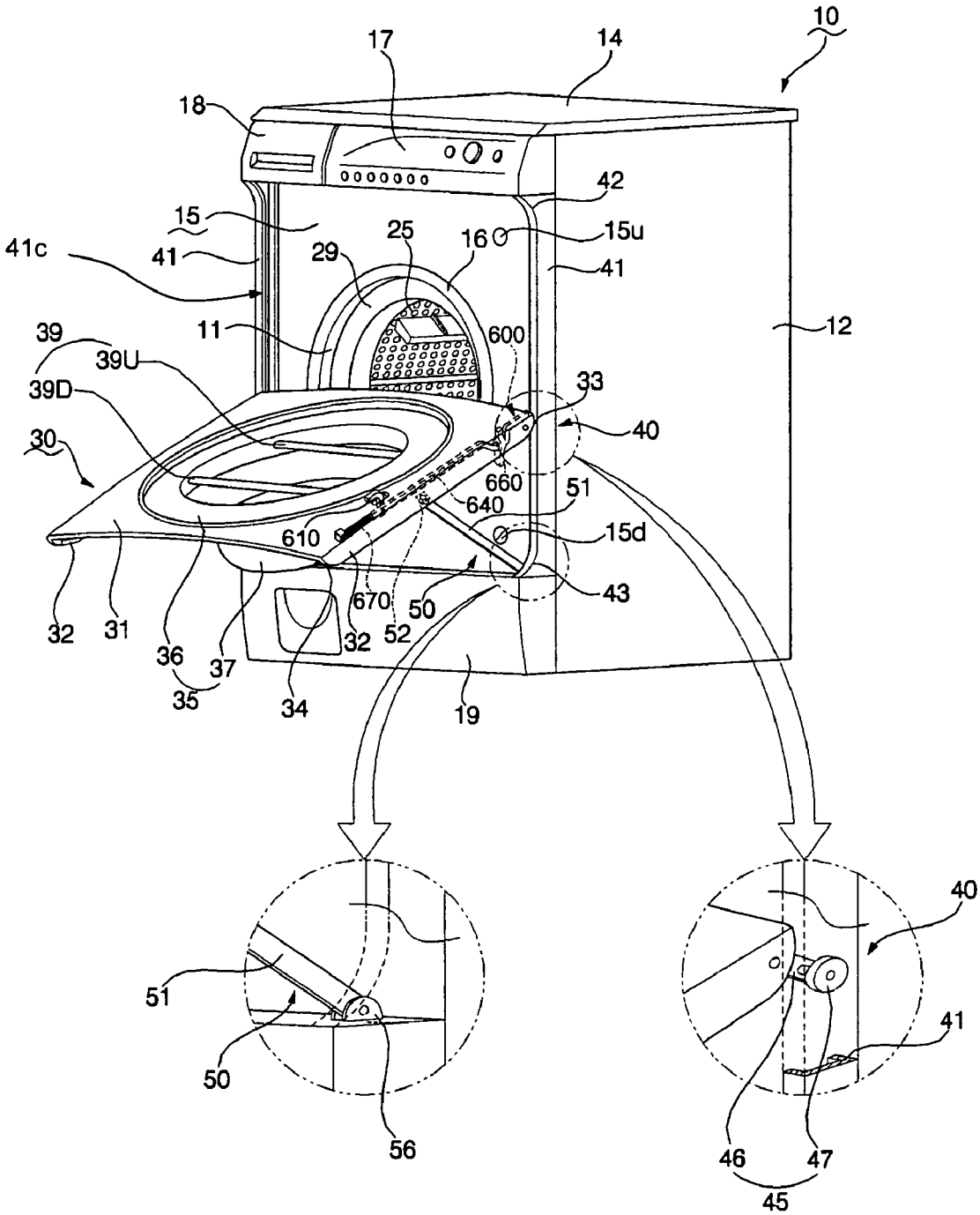
FIG. 18 is a perspective view illustrating a drum washing machine according to a sixth embodiment of the present invention, together with enlarged views of particular sections of the drum washing machine.
Figure 19:
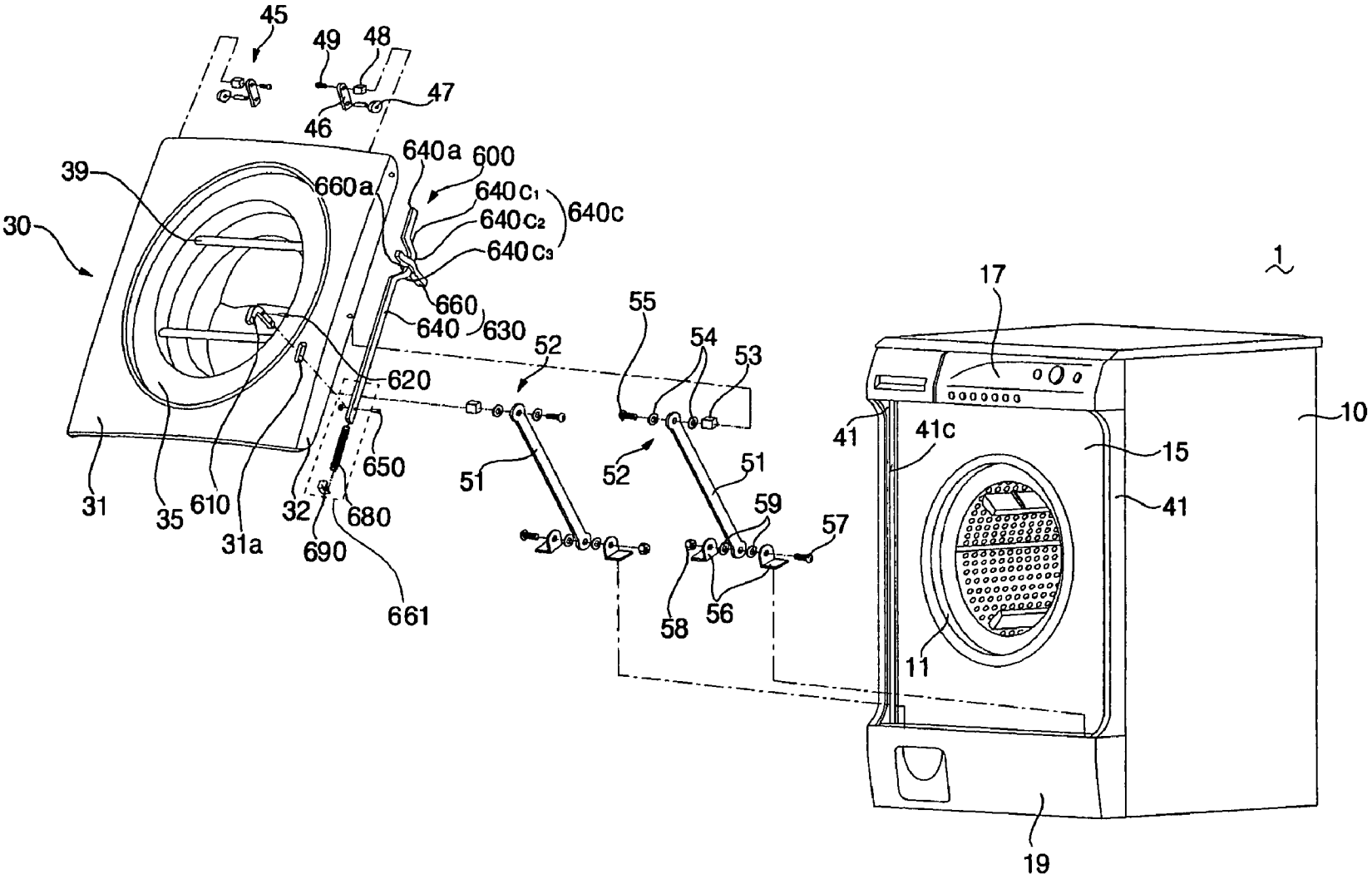
FIG. 19 is an exploded perspective view illustrating the drum washing machine according to the sixth embodiment of the present invention, in which a door is separated from the drum washing machine.
Figure 20:
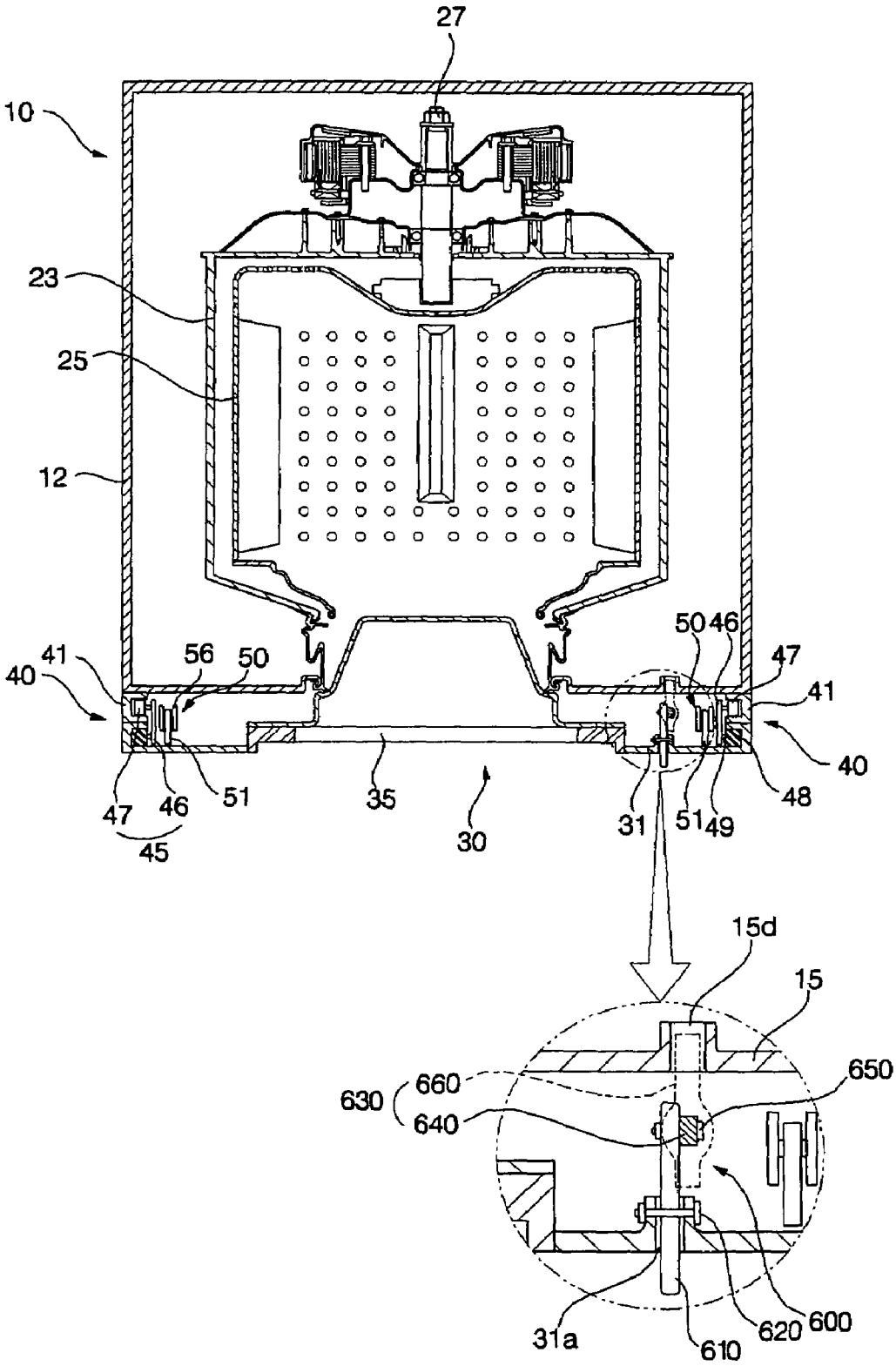
FIG. 20 is a transverse sectional view of the drum washing machine according to the sixth embodiment of the present invention.

Referring to FIGS. 18 and 19 in regard to a sixth embodiment of the present invention, for example, a drum washing machine 1, which is provided with a door-opened/closed state maintaining apparatus, includes a cabinet 10 to form an outer structure of the drum washing machine 1. An opening 11 is provided at a front wall of the cabinet 10 to allow laundry to be put into or taken out of the drum washing machine 1, and other details of the drum washing machine 1 may be similar to any of the other embodiments of the present invention described herein.

Additionally, the door-opened/closed state maintaining apparatus of the drum washing machine 1 according to the sixth embodiment of the present invention includes a latch mechanism 600 to maintain the door 30, which is opened or closed in a substantially vertical direction, in a fully opened or closed state.

The latch mechanism 600 includes a protrusion 661 mounted to the door 30 such that the protrusion 661 extends toward the cabinet 10; and upper and lower latch holes 15*u* and 15*d*, respectively, disposed at the front cover 15 of the cabinet 10 such that the protrusion 661 may be inserted into the upper latch hole 15*u* or the lower latch hole 15*d* when the protrusion 661 is extended.

For example, as shown in FIG.19, the protrusion may include a maintenance-release lever 610 disposed at the door 30 for releasing a door-opened/closed state of the door 30; a latching unit 630 disposed at the door 30 such that the latching unit 630 may be moved by operating the maintenance-release lever 610, the latching unit 630 being inserted into the upper latch hole 15*u* or the lower latch hole 15*d* of the front cover 15 for restricting the movement of the door 30 or releasing the restricted state of the door 30; and a resilient member 680 to provide a resilient force to the latching unit 630 such that the latching unit 630 is protruded toward the upper latch hole 15*u* or the lower latch hole 15*d*.

The latching unit 630 may include a latching rod 640 inserted into the lower latch hole 15*d* when the door 30 is opened; and a latching pin 660 inserted into the upper latch hole 15*u* when the door 30 is closed, the latching pin 660 being connected with the latching rod 640.

The maintenance-release lever 610, the latching rod 640, and the latching pin 660, and the resilient member 680, which constitute the protrusion, will be described hereinafter in more detail.

The maintenance-release lever 610 may be formed in a generally "L" shape, and may protrude out of the front surface of the door 30 through a lever hole 31*a* of the door 30. The maintenance-release lever 610 may be disposed at the door 30 such that the maintenance-release lever 610 is vertically hinged about a lever pin 620 along the lever hole 31*a*. Preferably, the lever hole 31*a* is vertically elongated such that the maintenance-release lever 610 is easily operated in the lever hole 31*a*.

The latching rod 640 may disposed at an inside of the door 30 while extending in a vertical direction of the door 30. A lower end of the latching rod 640 may be connected to the maintenance-release lever 610 such that the latching rod 640 can be rotated about a rod pin 650, relative to the maintenance-release lever 610. Consequently, the latching rod 640 may be linearly moved vertically as the maintenance-release lever 610 is operated. The upper end 640*a* of the latching rod 640 protrudes out of the upper end of the door 30 such that the upper end 640*a* of the latching rod 640 can be inserted into the lower latch hole 15*d* of the front cover 15 of the cabinet 10 when the door 30 is opened.

The latching pin 660 is connected to the latching rod 640 at the upper part of the door 30 while the latching pin 660 is perpendicular to the latching rod 640. Consequently, when the latching rod 640 is moved, the latching pin 660 is also moved along with the latching rod 640 such that the latching pin 660 can be inserted into the upper latch hole 15*u* when the door 30 is closed.

For example, the latching pin 660 may be connected to the latching rod 640 in a cam-connection fashion. At the latching pin 660 a cam hole 660*a* is formed through which the latching rod 640 is inserted such that the latching rod 640 can be moved relative to the latching pin 660. The latching rod 640 has a curved cam part 640*c*, which is inserted through the cam hole 660*a* of the latching pin 660. Preferably, the cam part 640*c* includes an inclined cam part 640$C_1$, a straight cam part 640$C_2$, and another inclined cam part 640$C_3$.

Figure 21A:
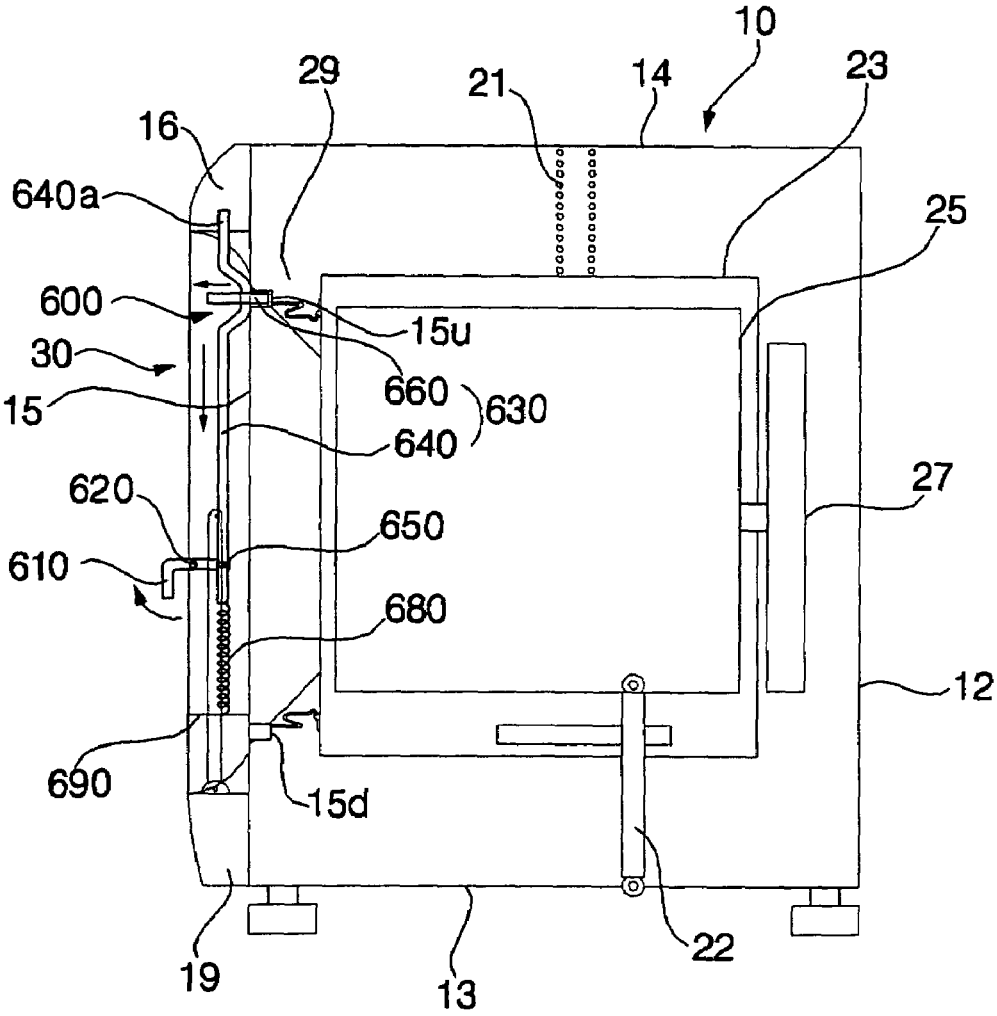

When the door 30 is closed as shown in FIG. 21A, the latching unit 630 may be operated as follows: as the latching rod 640 is linearly moved upward or downward while the cam part 640*c* of the latching 640 is inserted through the cam hole 660*a* of the latching pin 660, the latching pin 660, which is connected to the latching rod 640 while being perpendicular to the latching rod 640, is horizontally moved such that the latching pin 660 is inserted into or separated from the upper latch hole 15*u*.

A guide mechanism (not shown) may be mounted in the door 30 to guide the latching rod 640 and the latching pin 660 such that the latching rod 640 and the latching pin 660 are linearly moved only in the longitudinal directions thereof, respectively.

The resilient member 680 may be disposed corresponding to any of the maintenance-release lever 610, the latching rod 640, or the latching pin 660. The resilient member 680 is preferably a compression spring disposed at the lower end of the latching rod 640. Also, the door 30 may be provided with a spring support member 690 to support the resilient member 680.

In the sixth embodiment of the present invention as described above, not only the latching rod 640 but also the latching pin 660 are provided, although alternatively, only the latching rod 640 may be provided, or only the latching pin 660, which is directly connected to the maintenance-release lever 610, may be provided, as necessary.

In the sixth embodiment of the present invention as described above, the protrusion 661 is mounted to the door 30, although the protrusion 661 may be alternatively mounted to the cabinet 10. In this case, the maintenance-release lever 610, the latching rod 640, or the latching pin 660 may be disposed at the cabinet 10, and the latch hole 15*u* or 15*d* may be formed at the door 30.

Hereinafter, an example of an operation of the drum washing machine 1 with the door-opened/closed state maintaining apparatus according to the sixth embodiment of the present invention, will be described.

Figure 22A:
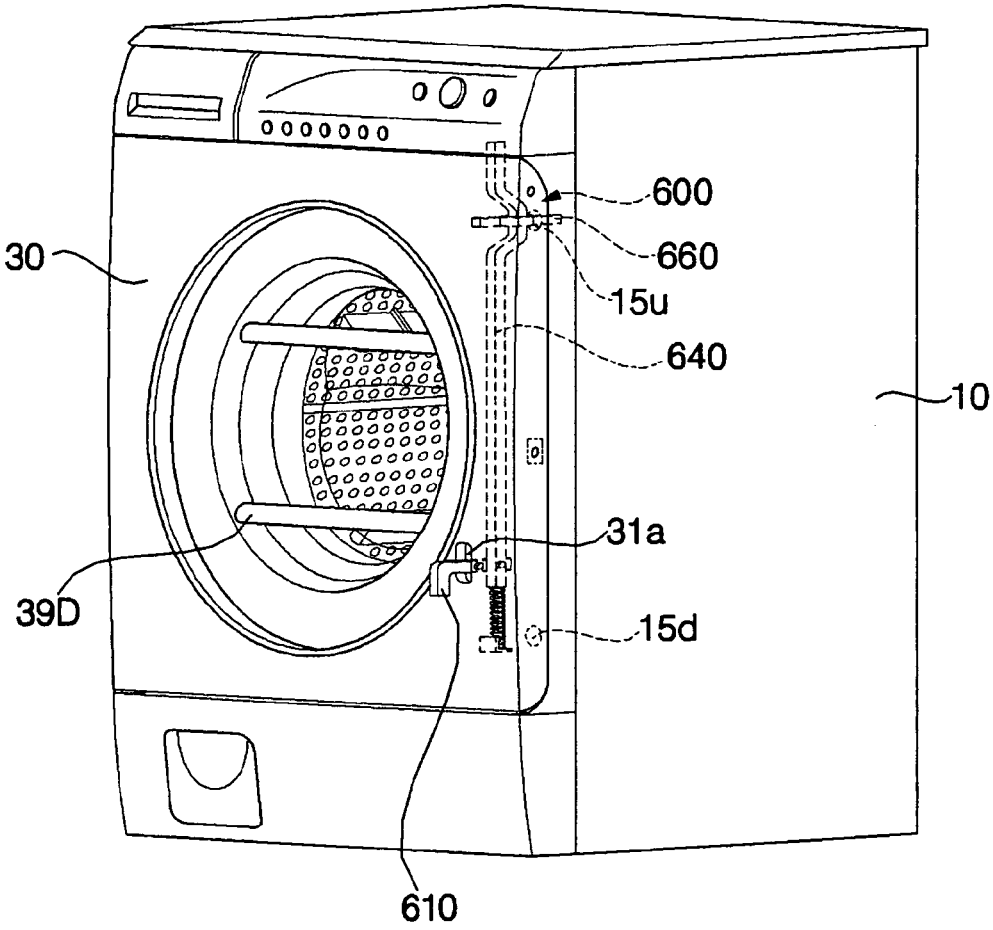
FIGS. 22A through 22E are perspective views respectively illustrating a sequence of door positions of the drum washing machine according to the sixth embodiment of the present invention.
Figure 22B:
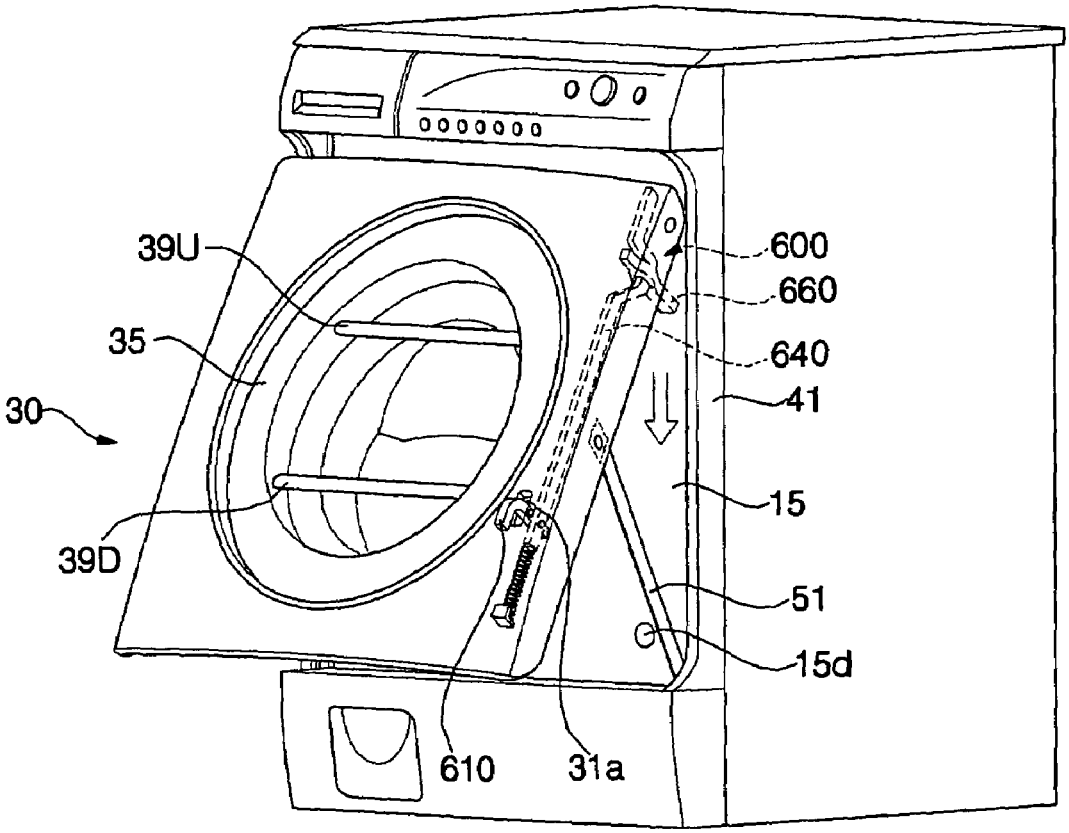
Figure 22C:
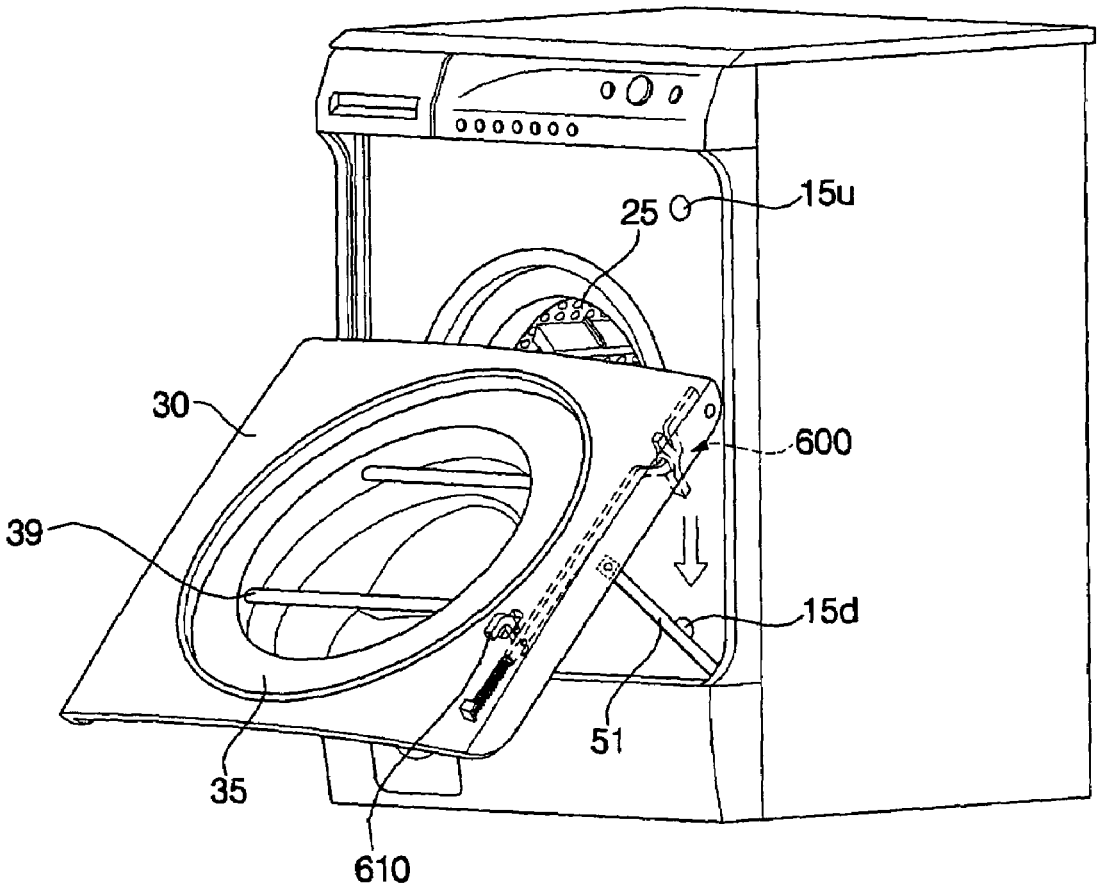
Figure 22D:
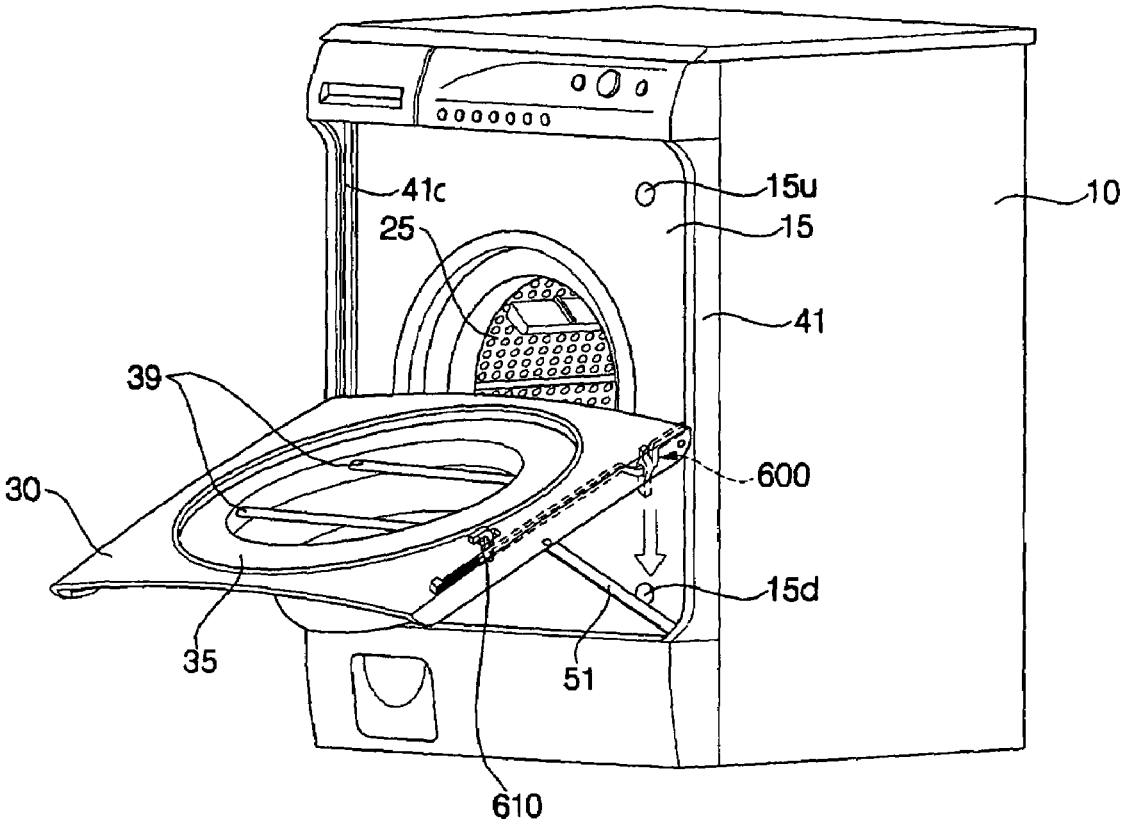
Figure 22E:
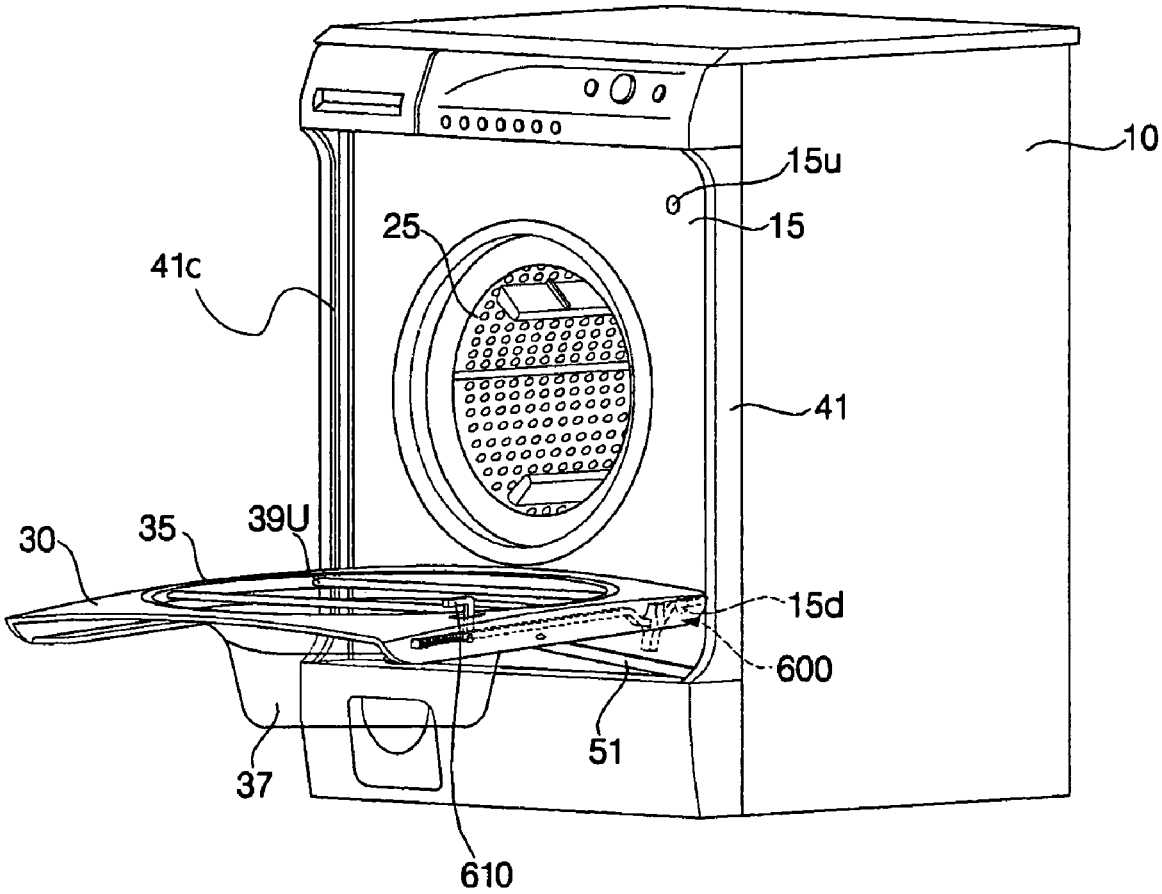

FIGS. 22A through 22E are respective perspective views illustrating a sequence of door positions of the drum washing machine according to the sixth embodiment of the present invention. When a user pulls the maintenance-release lever 610 upward such that the maintenance-release lever 610 is rotated, and then pulls the lower handle 39D of the door 30 downward while grasping the lower handle 39D when the door 30 is closed (as shown in FIG. 22A) to open the door 30, the door 30 is moved through the positions shown in FIGS. 22A through 22E such that the upper end of the door 30 is moved downward, and the lower end of the door 30 is horizontally and forwardly moved away from the cabinet 10. As a result, the door 30 may opened as shown in FIG. 22E.

For example, when the maintenance-release lever 610 is pushed upward such that the maintenance-release lever 610 is rotated while the latching pin 660 of the door 30 is inserted in the upper latch hole 15*u* of the front cover 15 (thus keeping the door 30 closed as shown in FIG. 21A), the latching rod 640 is moved downward while compressing the resilient member 680. At that time, the latching pin 660 is retracted through the cam operation of the latching pin 660 and the latching rod 640. As a result, the latching pin 660 is separated from the upper latch hole 15*u*.

When the user pulls the lower handle 19D downward, the upper end of the door 30 moves downward as the rollers 47 roll downward along the associated vertical guides 41. At that time, each support rod 51 hinges about the lower end thereof from a vertical state in accordance with the movement of the door 30 such that the upper end of the support rod 51 moves horizontally and downwardly to be forwardly spaced away from the cabinet 10. In accordance with this movement, the support rod 51 supports the door 30 when opening the door 30 to enable the lower end of the door 30 to be moved horizontally and forwardly.

Figure 21B:
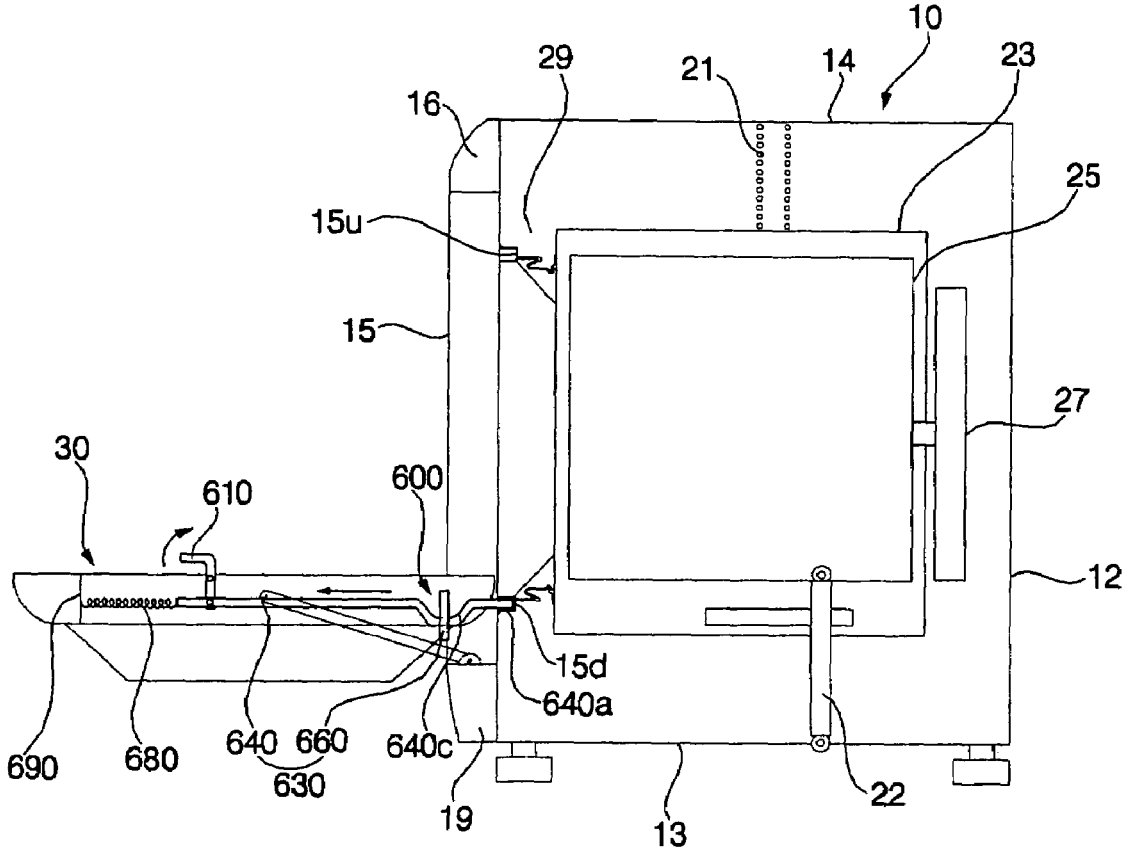

When the door 30 is fully opened, the latching rod 640 is advanced by the resilient force of the resilient member 680. Consequently, the end 640*a* of the latching rod 640 is inserted into the lower latch hole 15*d*, as shown in FIG. 21B. As a result, the door may be stably kept open.

When the door 30 is open, the user can put laundry into the drum 25 through the opening 11 of the cabinet 10, and can take laundry out of the drum 25. At this time, the user can also temporarily store the laundry taken out of the drum 25 in the container-shaped door window 35, if necessary, as discussed in the fifth embodiment of the present invention, for example.

The laundry, which is taken out of the drum 25 when the door 30 is open and temporarily stored in the door window 35, may be subsequently taken out of the door window 35 and transferred to another place. After that, when the user rotates the maintenance-release lever 610, the latching rod 640 is separated from the lower latch hole 15*d*. Subsequently, when the user pulls the upper handle 39U of the door 30 upward while grasping the upper handle 39U, the door 30 is moved upward to be closed.

At this time, the rollers 47 mounted to the upper end of the door 30 roll upward along the associated vertical guides 41 in accordance with a procedure substantially reverse to the above-discussed procedure for opening the door 30. The lower end of the door 30 is substantially moved horizontally toward the cabinet 10, and comes into contact with the front cover 15, together with the upper end of the door 30, so that the door 30 is closed. At the same time, the latching pin 660 of the door 30 is inserted into the upper latch hole 15*u*, as shown in FIG. 21A. Consequently, the door 30 may be stably kept closed.

Hereinafter, the seventh through tenth embodiments of the present invention will be described. Elements of the drum washing machine according to the seventh through tenth embodiments of the present invention, which correspond to those of the drum washing machine according to the above-described first through sixth embodiments of the present invention, are indicated by the same reference numerals, and implementation details thereof not discussed below may be similar to any of the other embodiments described herein.

Figure 23:
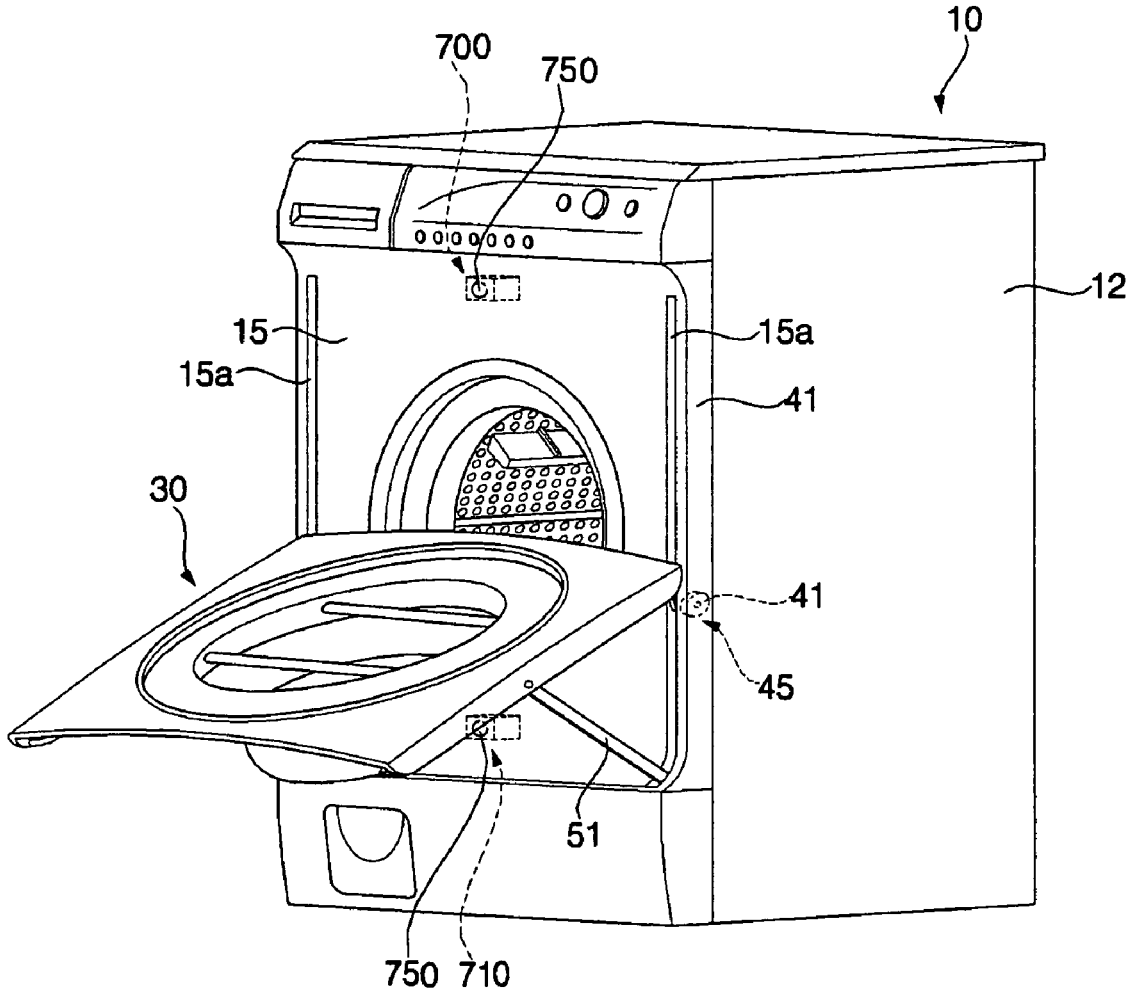
FIG. 23 is a perspective view of a drum washing machine according to a seventh embodiment of the present invention.
Figure 24:
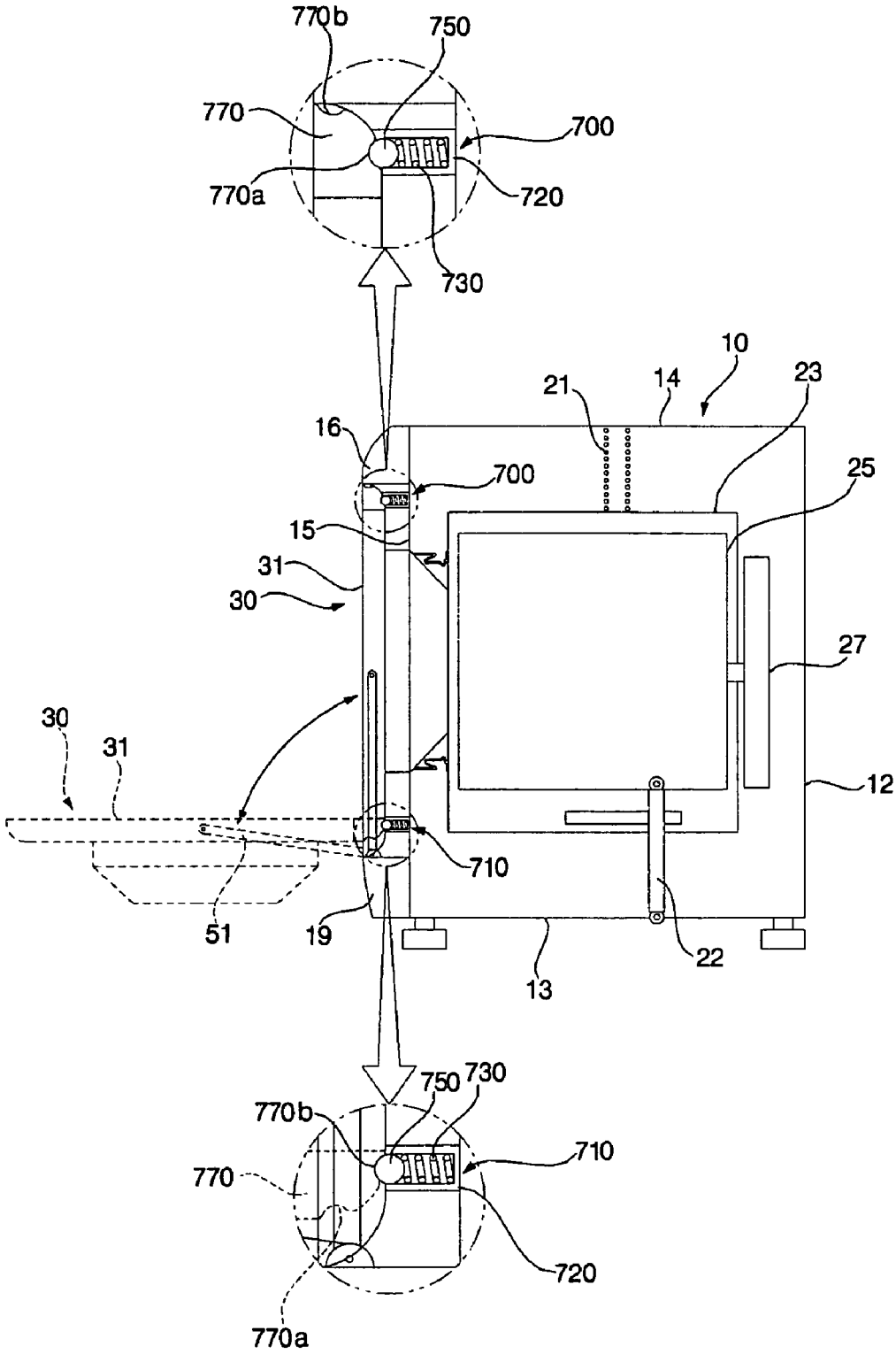
FIG. 24 is a schematic side view illustrating a door-opened/closed state maintaining apparatus of the drum washing machine according to the seventh embodiment of the present invention.

As shown in FIGS. 23 and 24, for example, a drum washing machine 1 according to the seventh embodiment of the present invention may include guide couplers 45 provided at the door 30 received in the front cover 15 such that the guide couplers 45 are vertically movable along vertical guides 41.

For example, vertically-elongated slits 15*a* may be formed at opposite side portions of the front cover 15 to receive the guide couplers 45, allowing the guide couplers 45 to be movable. The vertical guides 41 may be disposed at the front cover 15 in the rear of the slits 16, respectively, such that the rollers 47 of the guide couplers 45 may be moved along the vertical guides 41.

Further, detent units 700 and 710 may be disposed at the upper and lower part of the front surface of the front cover 15, and may function as protrusions for maintaining a closed or opened state of the door 30. At the door 30, grooves 770*a* and 770*b* may be formed respectively corresponding to the detent units 700 and 710, which serve as a latching mechanism to maintain the door-closed/opened state of the door 30.

Each of the detent units 700 and 710 includes a detent case 720 mounted to the rear surface of the front cover 15; a detent ball 750 disposed at the detent case 720 such that the detent ball 750 protrudes out of the front surface of the front cover 15 and is inserted in the corresponding one of the grooves 770*a* or 770*b;* and a spring 730 disposed in the detent case 720 for providing a resilient force to the detent ball 750.

The grooves 770*a* and 770*b* are preferably formed, in a pair, at a detent block 770 mounted to the door frame 31. For example, the detent block 770 having a predetermined or particular thickness may be attached to the rear of the door frame 31, since the door frame 31 is generally made of a plate shape. The grooves 770*a* and 770*b*, in which the detent ball 750 may be inserted, may be formed at the rear surface of the detent block 770 while the grooves 770*a* and 770*b* are vertically arranged.

Consequently, when the door 30 is fully closed as shown in solid lines in FIG. 24, the detent ball 750 of the upper detent unit 700 is engaged in the lower groove 770*a*. As a result, the door 30 may be kept closed. When the door 30 is fully opened as shown in broken lines in FIG. 24, the detent ball 750 of the lower detent unit 710 is engaged in the upper groove 770*b*. As a result, the door 30 is kept opened.

According to at least one aspect of the seventh embodiment of the present invention, the detent block 770 may be attached to the door frame 15, and the grooves 770*a* and 770*b* are formed at the detent block 770, although the door frame 15 may alternatively be folded such that the folded part of the door frame 15 serves as the outer surface of the detent block 770, and the grooves 770*a* and 770*b* may be formed at the folded part of the door frame 14, as long as the implementation of the grooves 770*a* and 770*b* is suitable.

Figure 25:
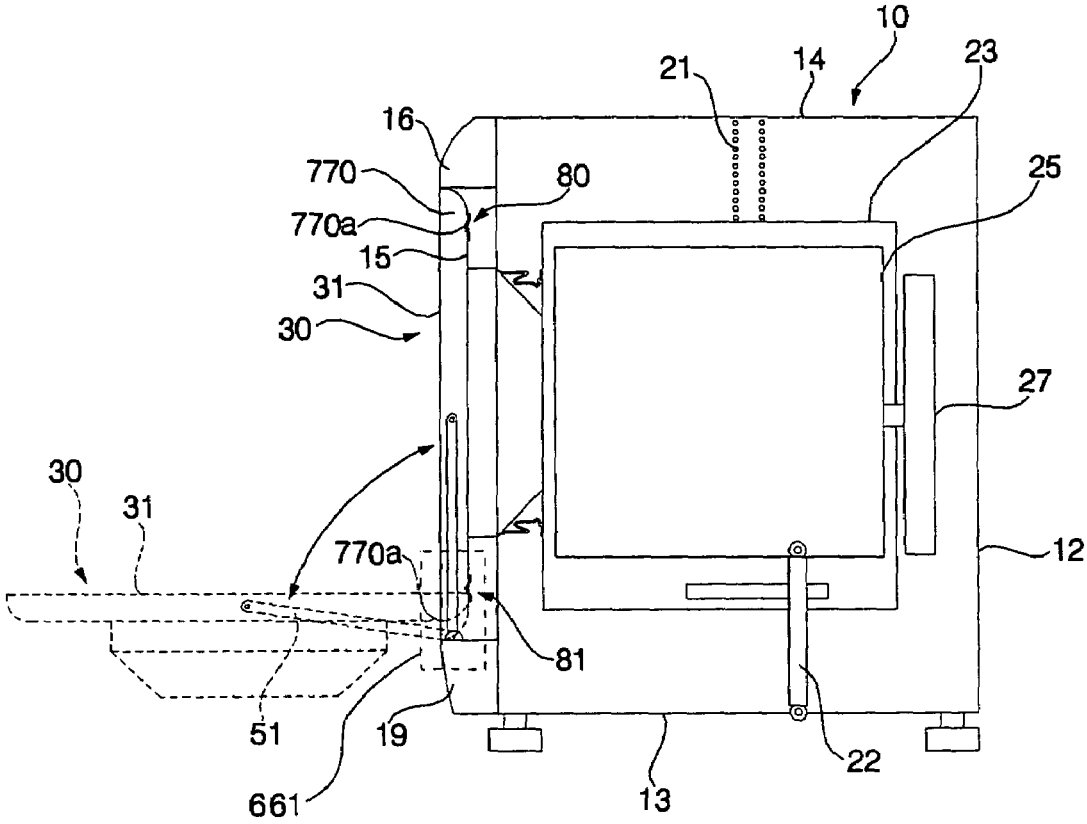
FIG. 25 is a schematic side view illustrating a door-opened/closed state maintaining apparatus of a drum washing machine according to an eighth embodiment of the present invention.

As shown in FIG. 25, for example, the drum washing machine 1 according to the eighth embodiment of the present invention may be substantially similar in construction to the drum washing machine according to the seventh embodiment of the present invention except that a protrusion 661 includes convex plate springs 80 and 81, which have curved surfaces, respectively, instead of the detent units 700 and 710.

For example, the plate springs 80 and 81, each of which exert a respective resilient force, may be mounted to the front cover 15 while the plate springs 80 and 81 are vertically arranged. The detent block 770 is attached to the door 30, and the groove 770*a* is formed at the detent block 770.

The upper plate spring 80 may be inserted in the groove 770*a*, while the lower plate spring 81 may be engaged with the upper end of the door 30.

Alternatively, the lower plate spring 81 may also be inserted in the groove 770*a* formed at the detent block 770, similarly to the seventh embodiment of the present invention, for example.

Consequently, when the door 30 is fully closed as shown in solid lines in FIG. 25, the upper plate spring 80 is engaged in the groove 770*a*. As a result, the door 30 is kept closed. When the door 30 is fully opened as shown in broken lines in FIG. 25, the upper end of the door 30 may be engaged with the lower plate spring 81. As a result, the door 30 may be kept open.

Figure 26:
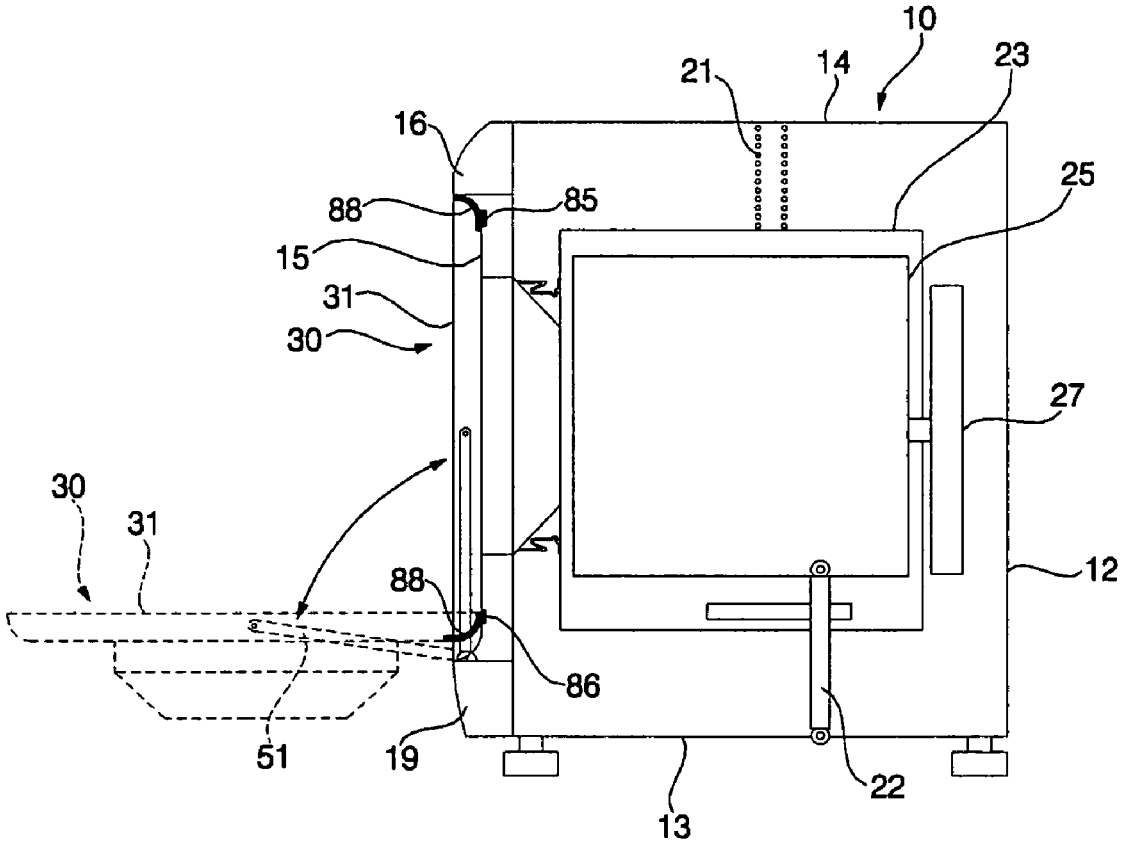
FIG. 26 is a schematic side view illustrating a door-opened/closed state maintaining apparatus of a drum washing machine according to a ninth embodiment of the present invention.

In the drum washing machine 1 according to the ninth embodiment of the present invention as shown in FIG. 26, for example, magnetic members 85 and 86 may be provided instead of the detent units 700 and 710 of the seventh embodiment of the present invention, and an iron piece 88, which is a counterpart of the magnetic members 85 and 86, may be provided instead of the groove 770*a*. The iron piece 88 may be attached to one of the magnetic members 85 or 86 through the interaction between the iron piece 88 and the corresponding one of the magnetic members 85 or 86.

The magnetic members 85 and 86 may be disposed at the upper and lower parts of the front cover 15, respectively. Preferably, the magnetic members 85 and 86 are permanent magnets. Alternatively, electromagnets may be provided as the magnetic members 85 and 86 to control generation of a magnetic force when the door is automatically opened or closed.

The iron piece 88 may be disposed at the rear part of the door 30 such that the iron piece 88 corresponds to the magnetic members 85 and 86 when the door 30 is opened or closed. Preferably, the door 30 includes a synthetic resin plate, which does not interact with the magnetic members 85 and 86. When the door 30 includes a metal plate, which interacts with the magnetic members 85 and 86, non-magnetic holders to hold the magnetic members 85 and 86 or a non-magnetic holder (not shown) to hold the iron piece 88 (not shown) may be disposed around the magnetic members 85 and 86 or the iron piece 88 such that the interaction between the door 30 and the magnetic members 85 and 86 or between the door 30 or the iron piece 88, which is generated because of the magnetic force(s), is interrupted by the non-magnetic holder(s).

Consequently, when the door 30 is fully closed as shown in solid lines in FIG. 26, the iron piece 88 disposed at the door 30 is attached to the upper magnetic member 80. As a result, the door 30 may be kept closed. When the door 30 is fully opened as shown in broken lines in FIG. 26, the iron piece 88 disposed at the door 30 is attached to the lower magnetic member 81. As a result, the door 30 may be kept open.

Figure 27:
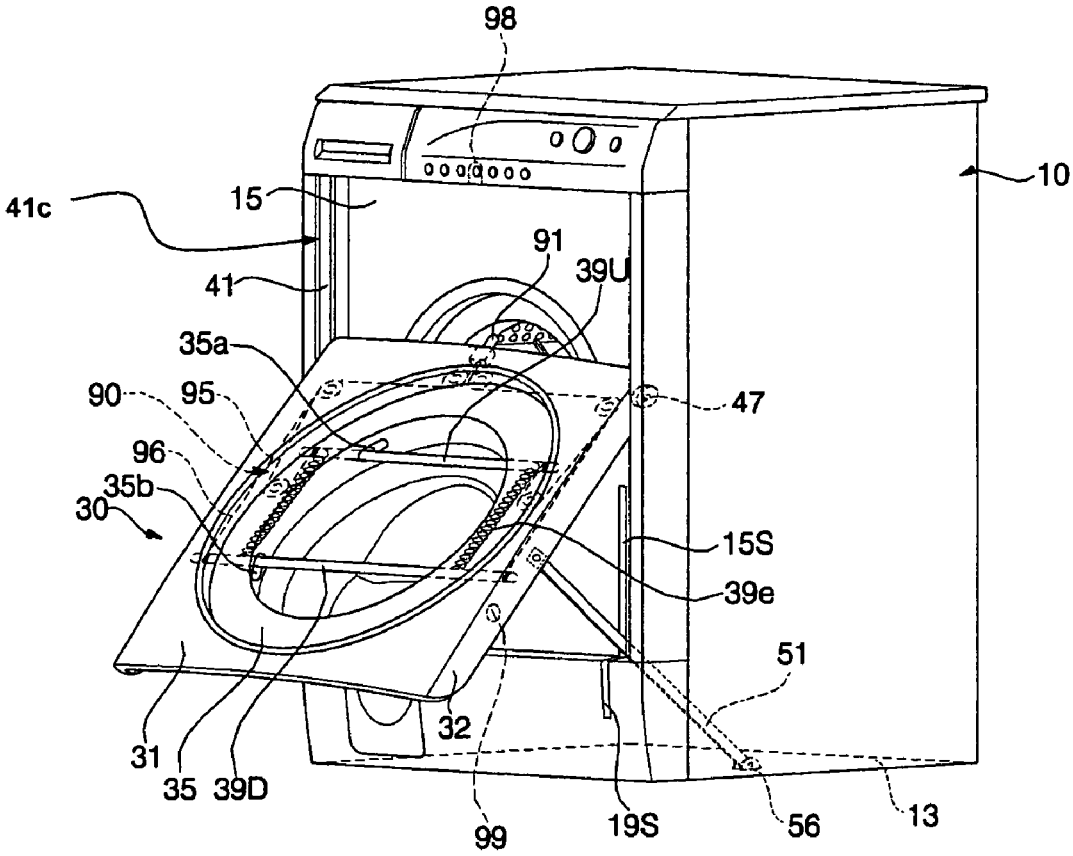
FIG. 27 is a perspective view of a drum washing machine according to a tenth embodiment of the present invention, illustrating a door of the drum washing machine being opened.
Figure 28:
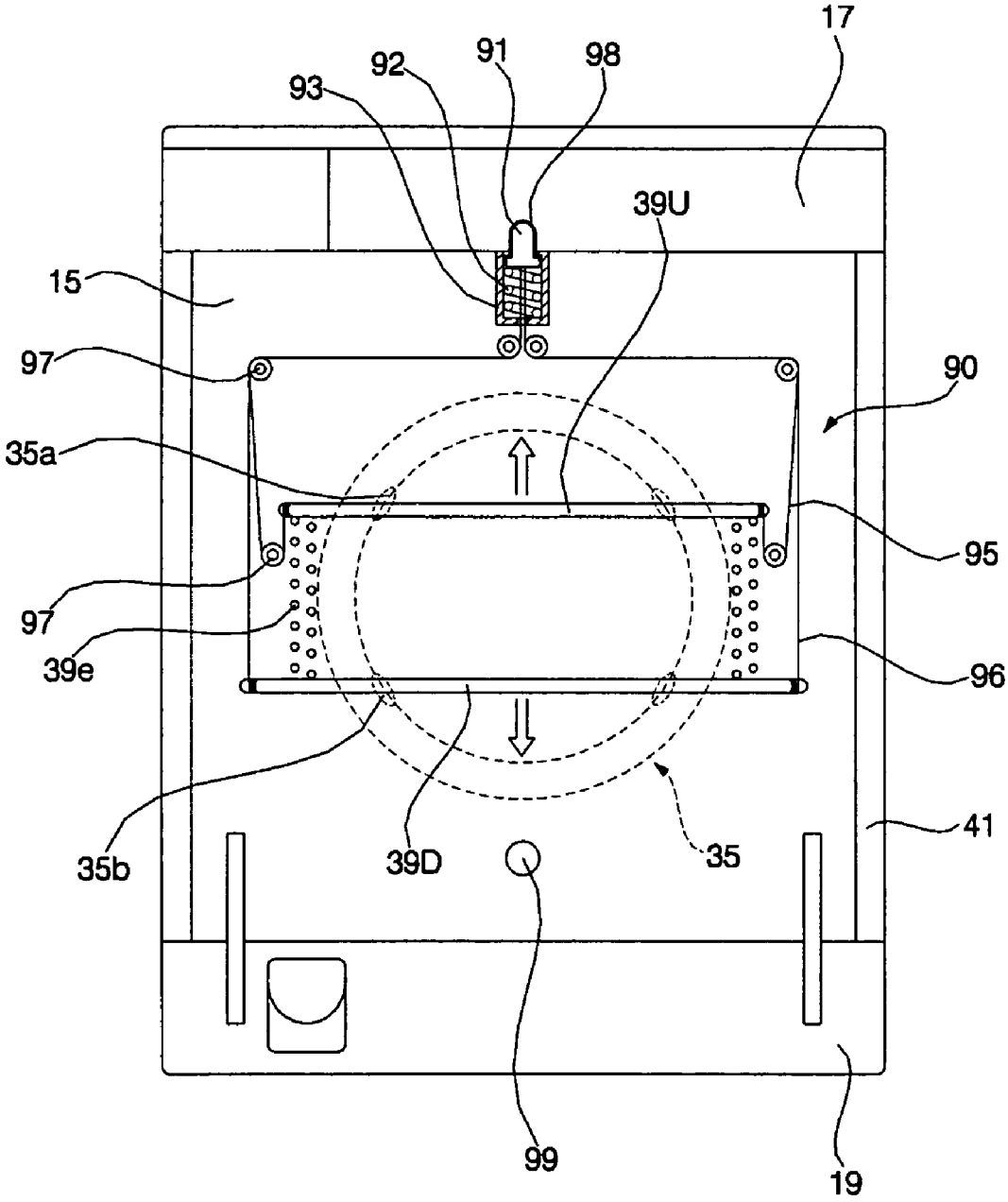
FIG. 28 is a schematic front view illustrating an inner structure of the door of the drum washing machine according to the tenth embodiment of the present invention.

As shown in FIGS. 27 and 28, for example, a drum washing machine 1 according to the tenth embodiment of the present invention may be similar, in its basic construction, to the drum washing machine according to the previously described sixth embodiment of the present invention except that the rollers 47 are directly mounted to the side portions of the door 30, and the support rods 51 are mounted to the bottom wall of the cabinet 10.

For example, the vertical guide plates 41 may be arranged at opposite side ends of an outer surface of the front cover 15, respectively, such that the outer surface of each vertical guide plate 41 is flush with the outer surface of the door 30. The door 30 may be arranged between the vertical guide plates 41. The rollers 47 may be mounted directly to the associated side portions 32 of the door 30 at the upper end of the door 30, without using separate roller brackets, such that the rollers 47 are movable vertically along the associated vertical guide plates 41. In this case, a guide groove (not shown) may be formed on an inner surface of each vertical guide plate 41 to receive the associated roller or rollers 47.

Each support rod 51 may include an upper end hingably connected to an associated one of the side portions 32 of the door 30, and a lower end extending into the cabinet 10 through the front cover 15 and a lower cover 19 and hingably connected to the base 13 forming the bottom wall of the cabinet 10.

A pair of hinge brackets 56 may be mounted to the base 13 to connect respective support rods 51 to the base 13. Vertically-elongated slits 15*s* and 19*s* may be formed at the front cover 15 and lower cover 19, respectively, so that the support rods 51 are freely movable while extending through the associated slits 15*s* and 19*s*.

Two handles 39U and 39D, which are used to open or close the door 30, may be attached to the door window 35 of the door 30 while being arranged vertically such that the handles 39U and 39D are spaced apart from each other. A protrusion 90 to maintain a door closed or opened state of the door 30 is constructed such that the protrusion 90 cooperates with the handles 39U and 39D.

For example, slots 35*a* and 35*b* may be respectively formed at the door window 35, such that the handles 39U and 39D can be moved a predetermined distance in the direction in which the door 30 is opened or closed. The handles 39U and 39D may be inserted in respective slots 35*a* and 35*b* of the door window 35. When the user pulls the upper handle 39U upward to close the door 30, the upper handle 39U moves upward. When the user pushes the lower handle 39D downward to close the door 30, the upper handle 39U moves downward.

At the upper handle 39U and the lower handle 39D are disposed resilient members 39*e*, respectively, by which the upper handle 39U and the lower handle 39D can be returned to their original positions after the upper handle 39U or the lower handle 39D have moved vertically when the door is opened or closed. Each of the resilient members 39*e* may be composed of a spring such as, for example, a tension spring. Preferably, the resilient members 39*e*, when composed of tension springs, are connected between the upper handle 39U and the lower handle 39D at both ends of the handle 39U and 39D, as shown in FIG. 27.

The protrusion 90 may include a latching pin 91 inserted in latching holes 98 and 99 formed at the cabinet 10; and wire-shaped members 95 and 96 connected between the handles 39U and 39D and the latching pin 91 for transmitting an actuating force to the latching pin 91 according to the movement of the respective handles 39U and 39D.

The latching pin 91 may be inserted in a pin case 93 mounted to the upper end of the door 30 such that the latching pin 91 can be linearly moved along the pin case 93. A resilient member 92 may be disposed in the pin case 93 to provide a resilient force to the latching pin 91 in the direction in which the latching pin 91 extends. For example, one latching pin 91 may be disposed at the door 30, although alternatively, several latching pins may be disposed at the door 30 such that the latching pins can be individually moved according to the operation of the handles 39U and 39D, as long as the implementation of the latching pin 91 is suitable.

Each of the wire-shaped members 95 and 96 may be composed of a rope or the like. The wire-shaped members 95 and 96 may be connected between the respective handles 39U and 39D and the latching pin 91. To the rear surface of the door 30 several rollers 97, may be rotatably attached, which are disposed between the respective handles 39U and 39D and the latching pin 91 to guide the movement of each of the wire-shaped members 95 and 96, the respective handles 39U and 39D, and the latching pin 91.

When the user pulls the lower handle 39D of the door 30 downward while grasping the lower handle 39D so as to open the door 30, as shown in FIG. 27, for example, the lower handle 39D moves downward along the slots 35*b* of the door 30. At this time, the latching pin 91 connected to the lower handle 39D via the wire-shaped member 96 is separated from the upper latching hole 98 of the cabinet 10. As a result, the door 30 is moved downward, and therefore, the door 30 may be open.

When the door 30 is fully opened, the lower handle 39D is returned to its original position by the resilient forces of the resilient members 39*e*, and thus the force applied to the latching pin 91 is eliminated. Consequently, the latching pin 91 is inserted into the lower latching hole 99. As a result, the door 30 may be kept open.

When the user pushes the upper handle 39U of the door 30 upward while grasping the upper handle 39U to close the door 30, on the other hand, the upper handle 39U moves upward along the slots 35*a* of the door 30. At this time, the latching pin 91 connected to the upper handle 39U via the wire-shaped member 95 is separated from the lower latching hole 99 of the cabinet 10. As a result, the door 30 is moved upward, and therefore, the door 30 may be closed.

When the door 30 is fully closed, the upper handle 39U is returned to its original position by the resilient forces of the resilient members 39*e*, and thus, the latching pin 91 is inserted into the upper latching hole 98. As a result, the door 30 may be kept closed.

As described above, the door-opened/closed state maintaining apparatus of the drum washing machine according to the tenth embodiment of the present invention may be constructed to cooperate with the handles 39U and 39D to open and close the door 30. Consequently, the opened or closed state of the door may be released by a single operation of the corresponding handle, and therefore, the door is may be easily opened or closed.

As apparent from the above description, the present invention provides a door-opened/closed state maintaining apparatus of a drum washing machine having a vertically-openable/closable door, which is capable of maintaining the vertically-openable/closable door in a fully opened or closed state, the door being opened when it moves downwardly and being closed when it moves upwardly. Consequently, the present invention can prevent the door from being undesirably opened or closed, and thus, reliability of opening or closing the door is improved.

FIGS. 29 through 32 illustrate a drum washing machine 1 according to an eleventh embodiment of the present invention.

Figure 29:
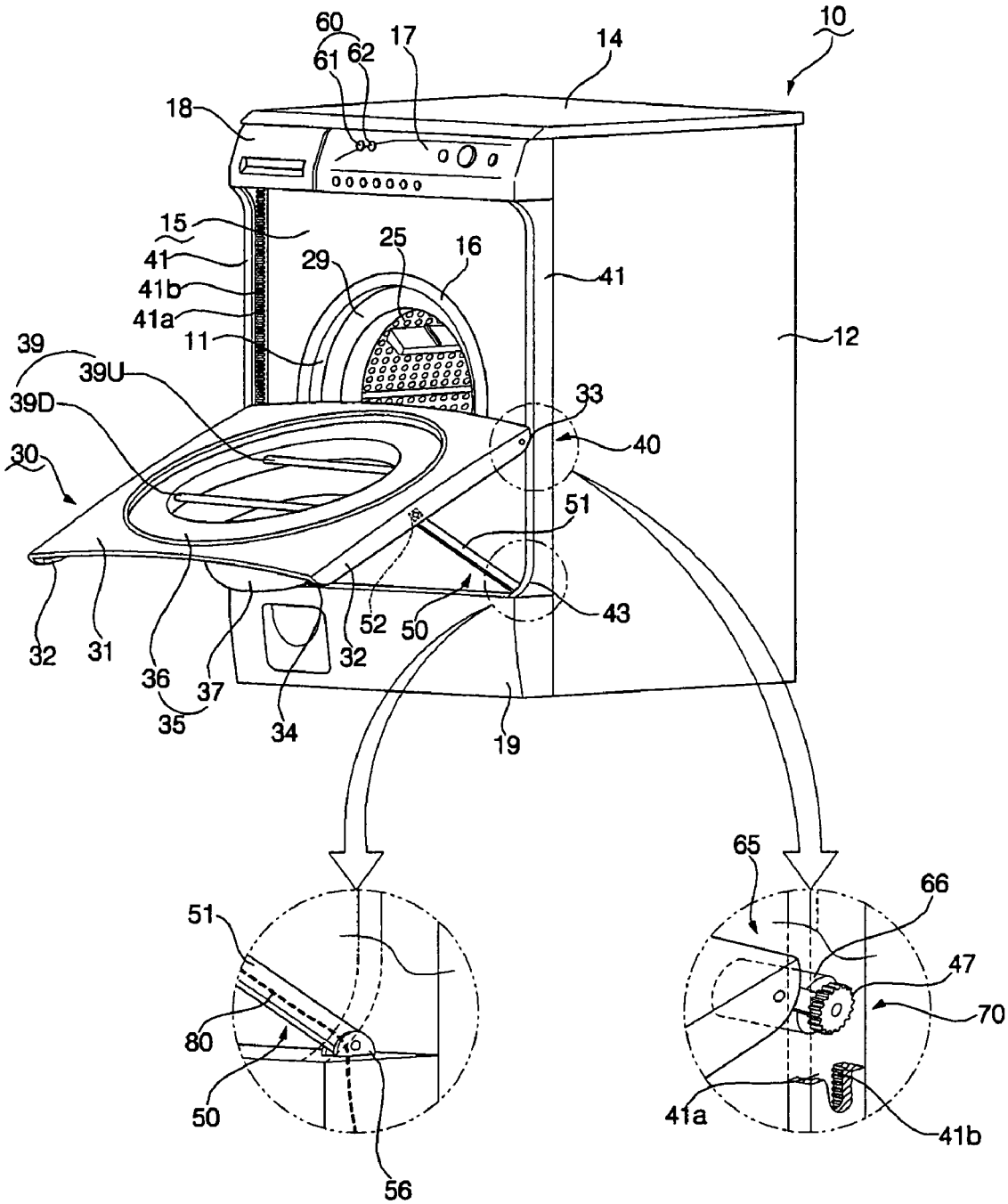
FIG. 29 is a perspective view illustrating a drum washing machine according to an eleventh embodiment of the present invention, together with enlarged views of particular sections thereof.
Figure 30:
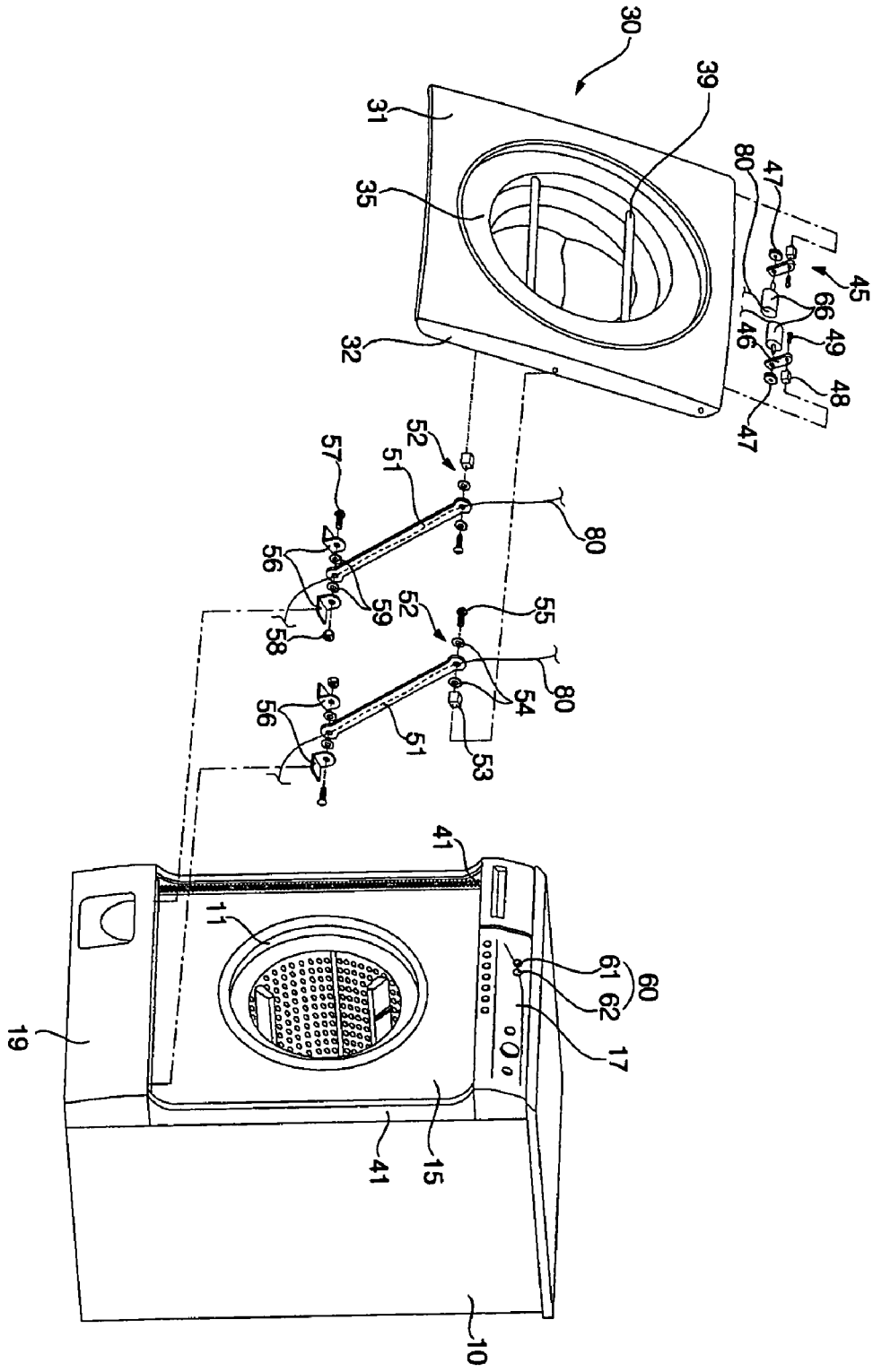
FIG. 30 is an exploded perspective view illustrating the drum washing machine according to the eleventh embodiment of the present invention with a vertically-openable/closable door separated from the drum washing machine.

Referring to FIGS. 29 and 30 in regard to an eleventh embodiment of the present invention, a drum washing machine 1, which is provided with an automatically vertically-openable/closable door, may include a cabinet 10 to form an outer structure of the drum washing machine. An opening 11 may be provided at a front wall of the cabinet 10 to allow laundry to be put into or taken out of the drum washing machine. Other features and/or implementation details of the drum washing machine according to the eleventh embodiment may be similar to any of the other embodiments discussed herein, for example, where not otherwise noted.

A control panel 17 may be arranged on a top portion of the front cover 15. The control panel 17 may include various operating switches to operate the washing machine, and a display device to display an operating state of the washing machine (using, for example, an LCD, LED, CRT or any other suitable display technology). Alternatively, the control panel 17 may be arranged at a different position other than the above-described position in accordance with the design of the washing machine. For example, the control panel 17 may be arranged on a top wall of the cabinet 10, such that, the top cover 14.

The control panel 17 may also include an automatic door opening button 61 and an automatic door closing button 62 to operate the door 30 to be automatically opened and/or closed, respectively, as will be described hereinafter.

A slidable detergent box 18 to supply detergent may be arranged at one side of the control panel 17.

A lower cover 19 may be coupled to the cabinet body 12 and base 13 to form a lower portion of the front cover 15.

For example, a door 30, which may function as a vertically-openable/closable door may be mounted to the outer surface of the front cover 15 to open or close the opening 11. The front cover 15 may be coupled with the cabinet body 12, control panel 17 and lower cover 19 while being retracted into the cabinet 10 with respect to the control panel 17 and lower cover 19, so that the outer surface of the front cover 15 is flush with respective outer surfaces of the control panel 17 and lower cover 19 when the door 30 is closed.

Each guide coupler 45 may include a pinion 47 engaged with a rack 41*b* of an associated vertical guide 41, as a rotating member to be operatively connected with the rotation/linear movement converting member. The pinion 47 is moved vertically along the associated vertical guide 41 in accordance with rotation of the pinion 47. The rotation of the pinion 47 may be carried out by an electric motor 66.

The pinions 47 may be rotatably mounted to motor brackets 46 mounted to the upper end of the door frame 31. Each motor bracket 46 may be connected to a mounting nut 48 fixed to an associated one of the side portions 32 of the door frame 31 by a bracket pin 49 such that the motor bracket 46 is hingably movable within a predetermined angle. Accordingly, as the door 30 moves vertically, the motor bracket 46 hinges about the bracket pin 49, thereby enabling the associated pinion 47 to move smoothly along the associated vertical guide 41.

Figure 40:
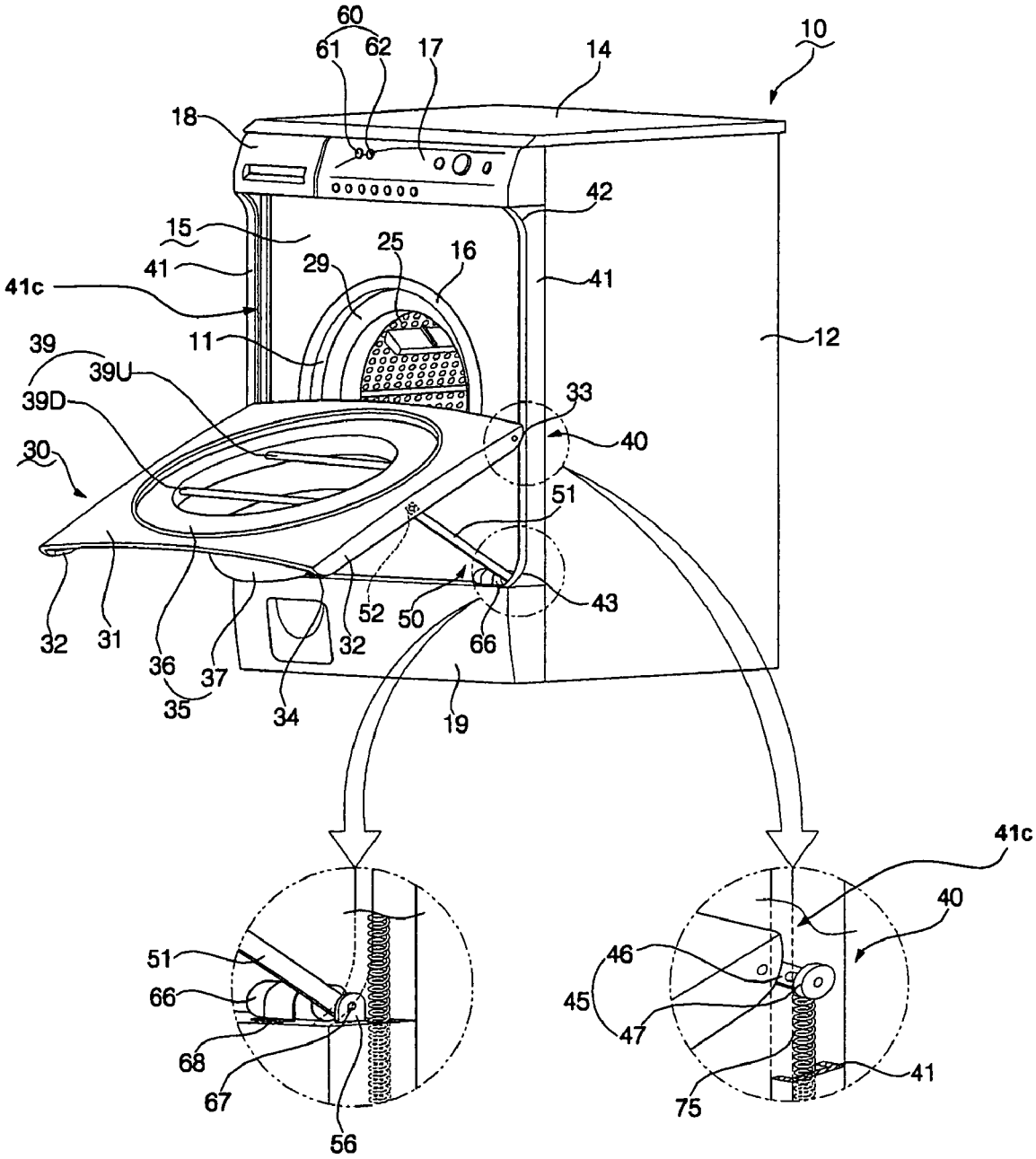
FIG. 40 is a perspective view illustrating a drum washing machine in accordance with a fifteenth embodiment of the present invention, together with enlarged views of particular sections thereof.

The door support mechanism 50 may include an elongated support rod 51 rotatably connected to the cabinet 10 and door frame 31 at opposite ends of the support rod 51, respectively. The door support mechanism 50 may include two support rods 51 arranged at opposite sides of the door 30, respectively, as illustrated in FIG. 40. For example, each support rod 51 may have a hollow structure to allow an electrical wire 80 for supplying electrical power to the associated electric motor 66 to pass through the support rod 51. The electrical wire 80 will be further described hereinafter.

The drum washing machine having the above-described door opening/closing structure may also include an automatic opening/closing mechanism to automatically move the door 30 vertically, and thus, to automatically open or close the door 30.

The automatic opening/closing mechanism may include an automatic opening/closing operating unit 60 including the automatic door opening button 61 and automatic door closing button 62, both provided at the control panel 17 such that the user can directly operate the automatic opening/closing operating unit 60; a rotating power generator 65, including the electric motor 66, operating in accordance with operation of the automatic opening/closing operating unit 60, and thus, to generate a rotating power to move the door 30 vertically; and a door moving mechanism 70 including the rotating members and rotation/linear movement converting members to move the door 30 vertically using the rotating power generated by the rotating power generator 65.

Although it is preferred that the automatic opening/closing operating unit 60 includes both the automatic door opening button 61 and the automatic door closing button 62, only one of the buttons 61 and 62 may alternatively be provided. Also, although the automatic opening/closing operating unit 60 has been described as being provided at the control panel 17 arranged on the front wall of the cabinet 10, the automatic opening/closing operating unit 60 may alternatively be arranged at a different position other than the above-described position, for example, at the top wall or one side wall of the cabinet 10.

Figure 31:
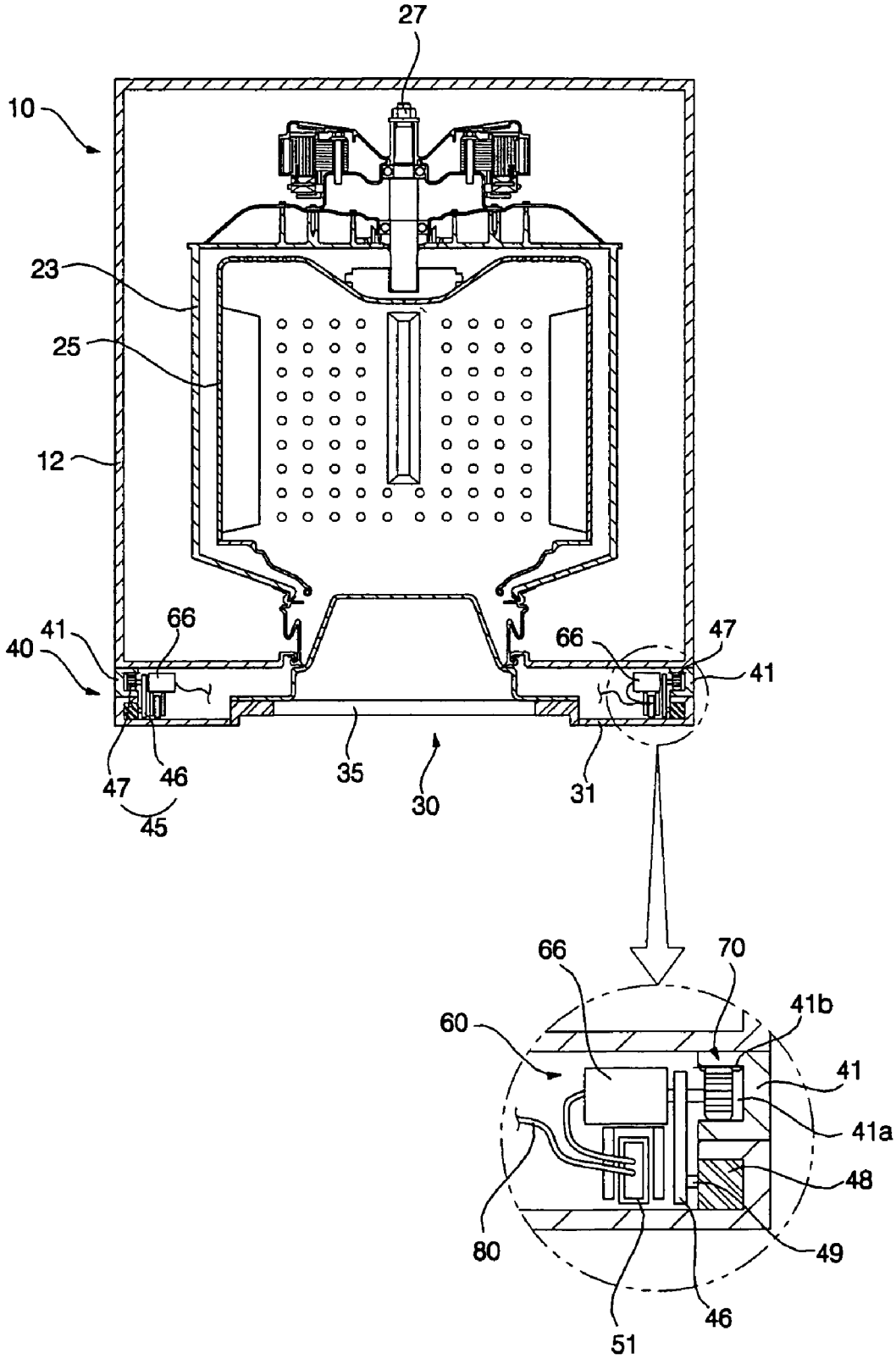
FIG. 31 is a transverse sectional view of the drum washing machine according to the eleventh embodiment of the present invention.
Figure 32:
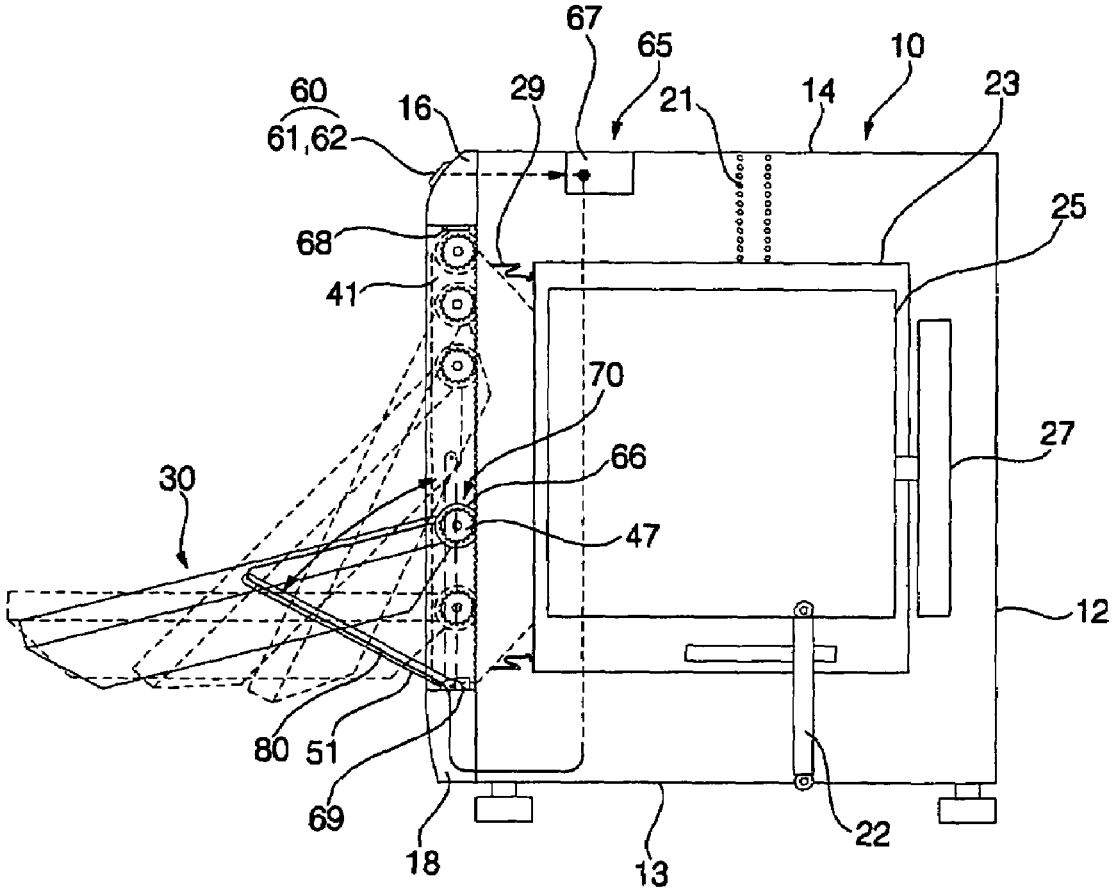
FIG. 32 is a schematic side view illustrating a door of the drum washing machine at various positions as the door opens, according to the eleventh embodiment of the present invention.

As shown in FIGS. 31 and 32, for example, the rotating power generator 65 may include electric motors 66 respectively mounted to the motor brackets 46 of the door 30 to drive the pinions 47, and a motor controller 67 to control the electric motors 66, for example, turning the electric motors 66 on or off, or switching between forward or reverse rotation, in response to an operation of the automatic opening/closing operating unit 60.

The motor controller 67 may be incorporated in a controller (not shown) adapted to control the entire operation of the drum washing machine. Other devices, such as a motor driving circuit to drive the electric motor, may also be incorporated in the controller.

The electric motor 66 may include a small-size bi-directional electric motor to generate a rotating force in a clockwise or counterclockwise direction in accordance with operation of the motor controller 67 and to allow the vertical movement of the door 30 to be easily carried out, for example.

Preferably, limit switches 68 and 69 are respectively arranged in upper and lower door paths on the front cover 15 to sense a completely-opened position and/or a completely-closed position of the door 30 and to send corresponding sensing signals to the motor controller 67 in order to stop the electric motor 66 when appropriate.

The door moving mechanism 70 may include the pinions 47, functioning as the rotating members, to be rotated by respective electric motors 66, and the racks 41*b*, as the rotation/linear movement converting members, provided at respective vertical guides 41. Each rack 41*b* may be formed at a side portion of the inner surface of the guide groove 41 in the associated vertical guide 41. Preferably, the other side portion of the inner surface of the guide groove 41 is smooth, in order to prevent generation of frictional resistance during the rotation of the associated pinion 47.

As shown in FIG. 30, for example, a configuration in which the electric motors 66, pinions 47 and racks 41*b* are arranged at opposite sides of the door 30, is most preferable. However, alternatively, one electric motor 66, one pinion 47 and one rack 41*b* may be arranged at only one side of the door 30, to automatically move the door 30 vertically.

Meanwhile, the electrical wire 80, which may extend through each hollow support rod 51, may also be connected between the cabinet 10 and the door 30, as an electrical connection.

The electrical wire 80 may extend from the motor controller 67 or power supplier to the associated electric motor 66 mounted to the door 30 via the associated hollow support rod 51 to supply electrical power.

Although electrical power is supplied only to the electric motors 66 in this embodiment, alternatively, an additional wire (not shown) may extend through each support rod 51 where an additional electrical power consuming device such as a lamp or a controller is installed on the door 30.

Also, although each support rod 51 has been described above as having a hollow structure to allow the associated electrical wire 80 to extend through the support rod 51, the present invention is not limited to such a structure. The electrical wire 80 may alternatively extend along the outer surface of the associated support rod 51 to supply electrical power to the electrical power consuming device installed on the door 30, for example.

Hereinafter, operation of the drum washing machine with the vertically-openable/closable door according to the eleventh embodiment of the present invention, will be described with reference to FIGS. 33A through 33E. For simplicity of description, the following description will be described in conjunction with the case in which only one rack-and-pinion assembly is used, although any other suitable configuration may similarly be used.

Figure 33A:
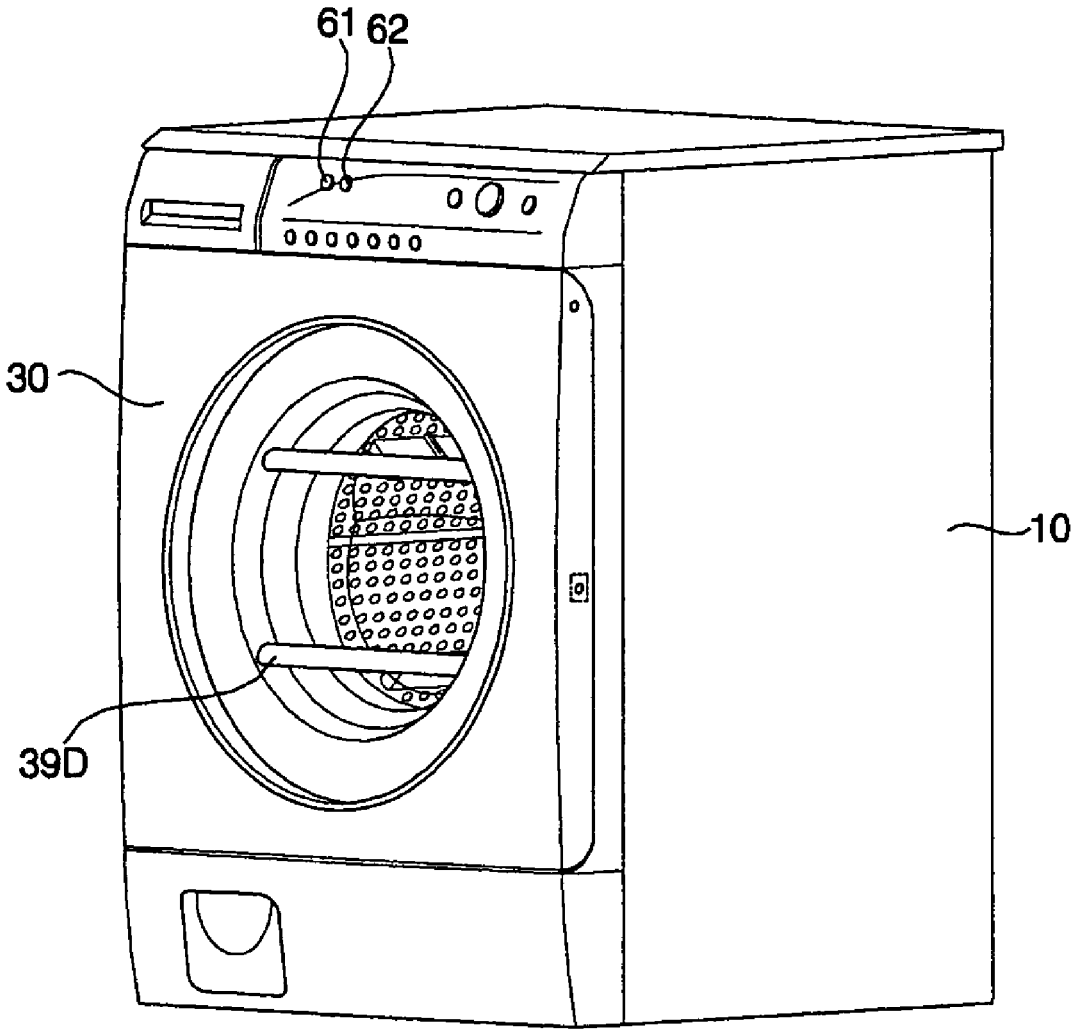
FIGS. 33A through 33E are respective perspective views illustrating a sequence of door positions of the drum washing machine according to the eleventh embodiment of the present invention as the door opens.
Figure 33B:
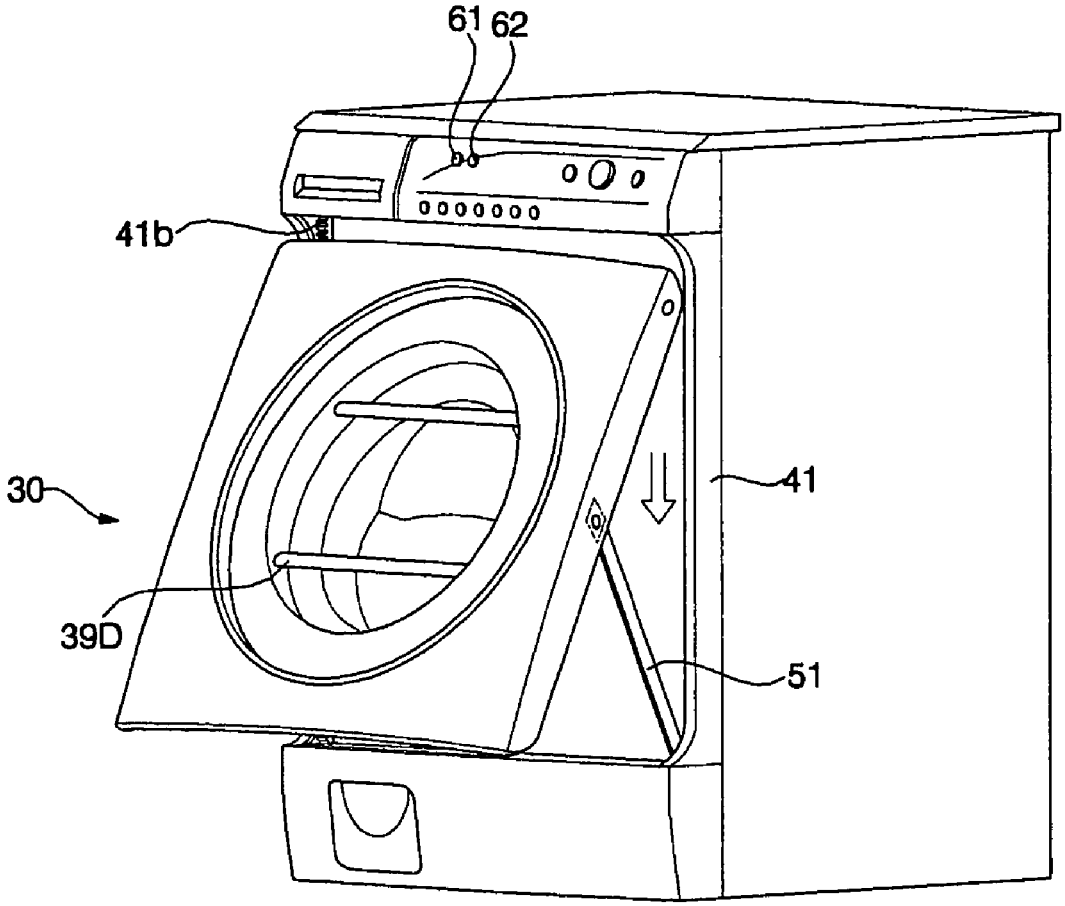
Figure 33C:
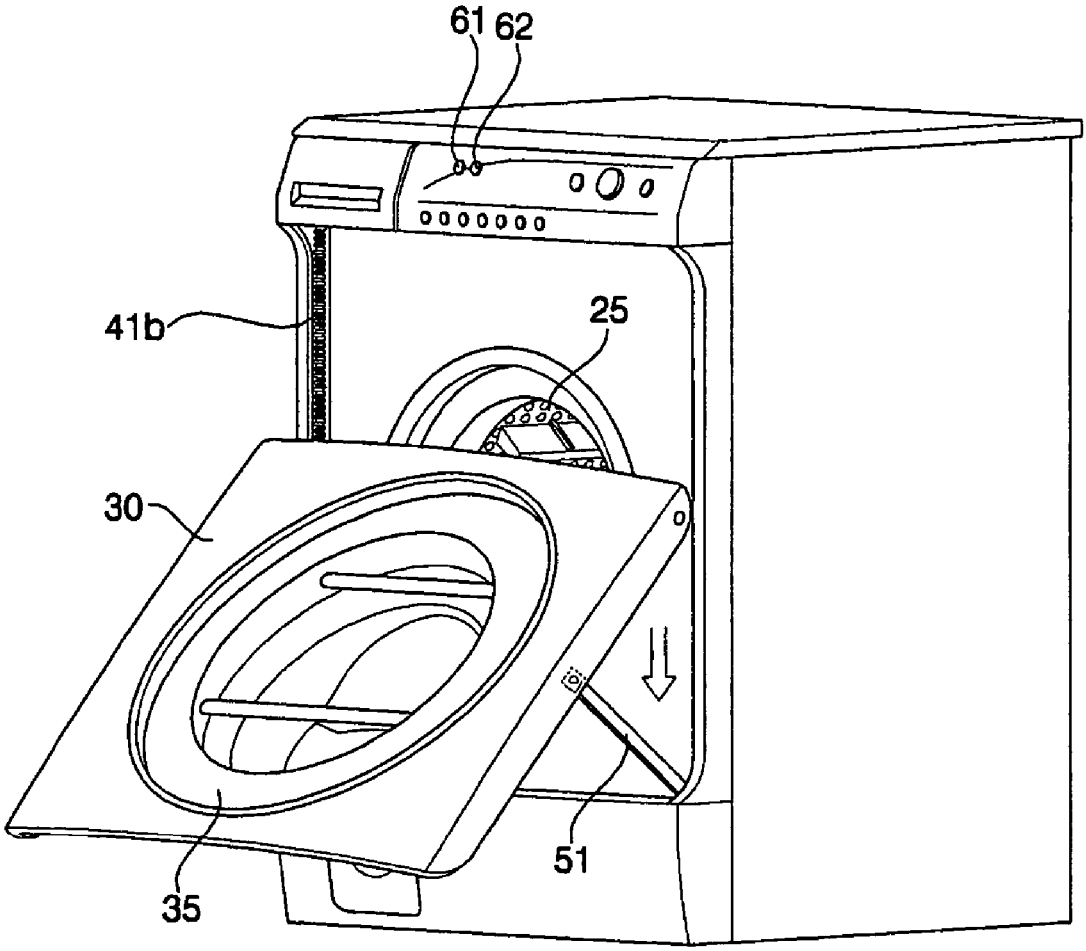
Figure 33D:
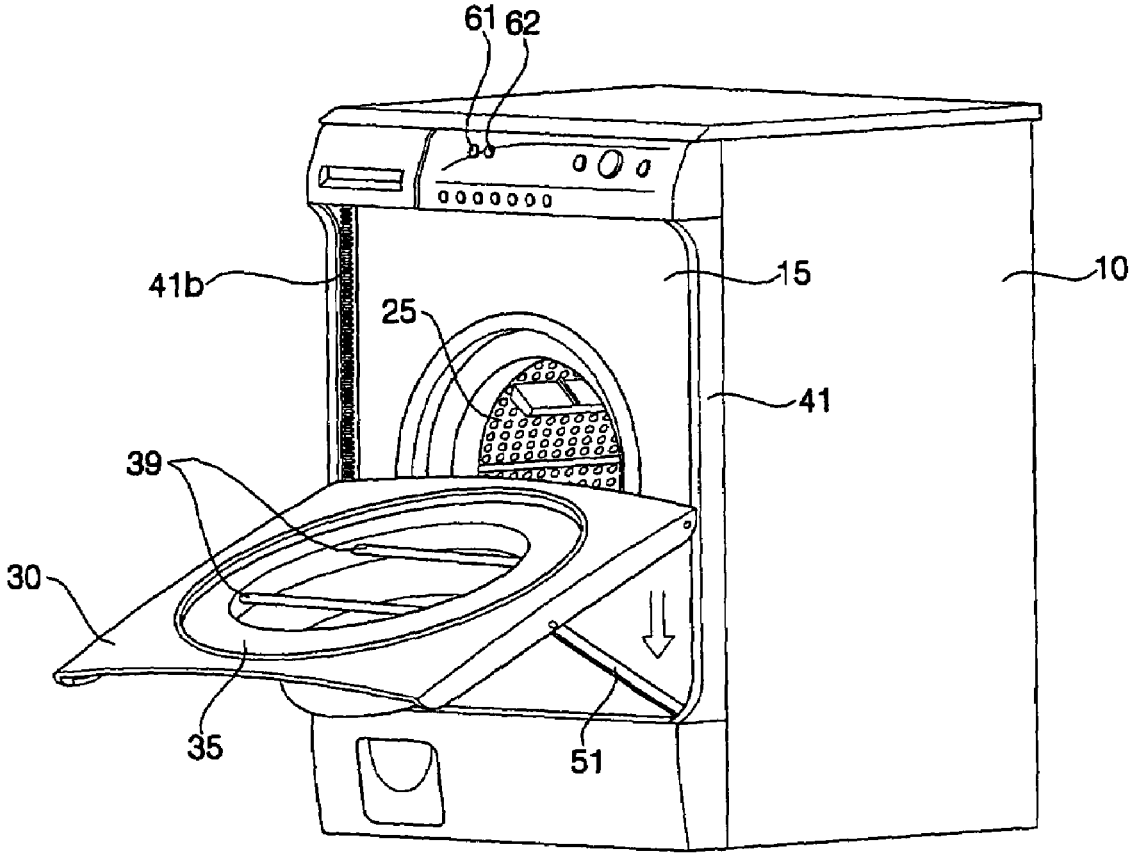
Figure 33E:
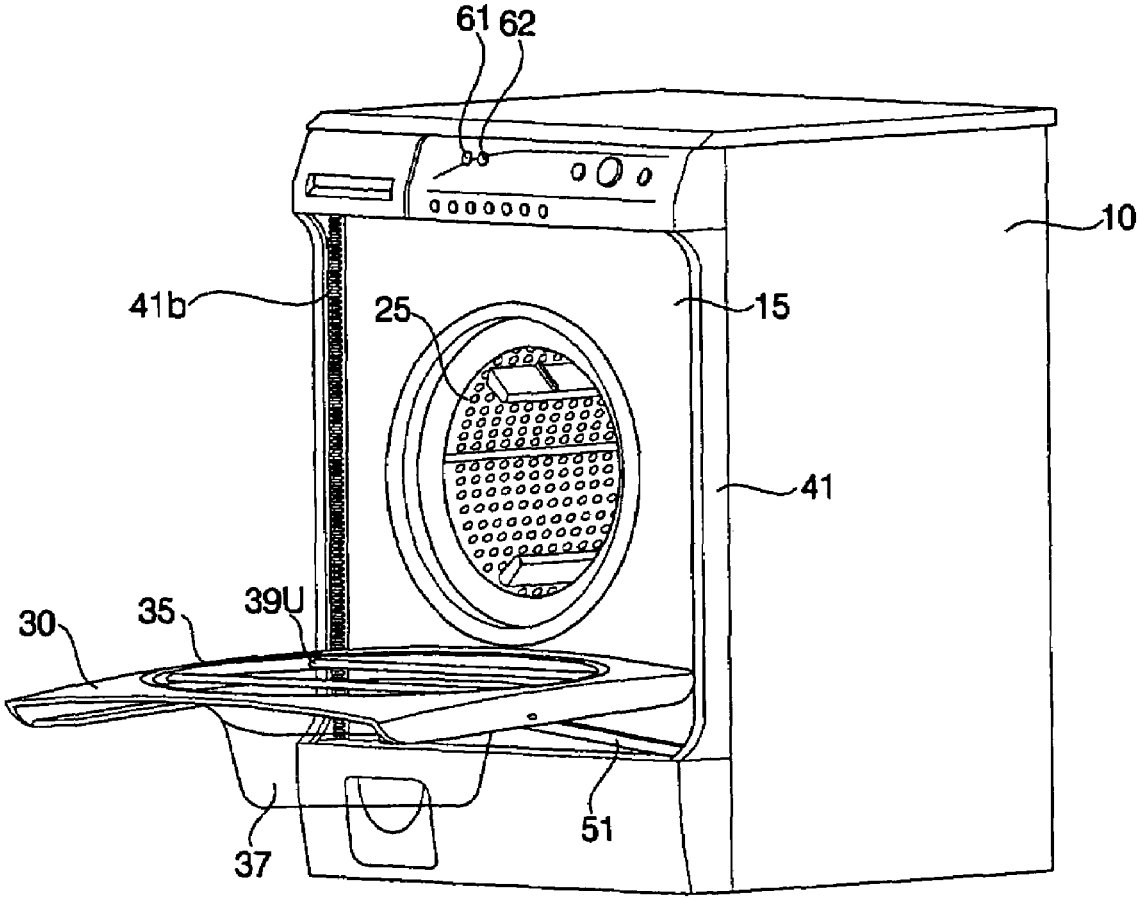

When the user presses the automatic door opening button 61 arranged on the front wall of the cabinet 10 to automatically open the door 30, which is closed, a corresponding signal is sent to the motor controller 67. In response to the signal, the motor controller 67 controls the electric motor 66 to rotate the pinion 47. Accordingly, the pinion 47 moves downwardly along the rack 41*b* of the associated vertical guide 41, thereby causing the door 30 to be opened while being moved automatically downward. At this time, the opening of the door 30 is achieved through procedures of FIGS. 33B through 33E such that the upper end of the door 30 is moved downward, and the lower end of the door 30 is moved horizontally and forwardly away from the cabinet 10. As a result, the door 30 is opened as shown in FIG. 33E.

For example, the upper end of the door 30 moves downward as the pinion 47 moves downward along the rack 41*b* of the associated vertical guide 41 in accordance with the operation of the electric motor 66. At this time, each support rod 51 hinges about its lower end from a vertical state in accordance with the movement of the door 30, such that the upper end of the support rod 51 moves both horizontally and downwardly to be forwardly spaced away from the cabinet 10. In accordance with this movement, the support rod 51 supports the door 30 during the opening of the door 30 to enable the lower end of the door 30 to be moved horizontally and forwardly.

The laundry, which may be taken out of the drum 25 when the door 30 is open, and temporarily stored in the door window 35, may subsequently be taken out of the door window 35 and transferred to another place. When the user presses the automatic door closing button 62 to close the door 30, the electric motor 66 is driven reversely in accordance with a control signal generated by the motor controller 67 in response to the pressing of the automatic door closing button 62. As a result, the pinion 47 engaged with the rack 41*b* of the associated vertical guide 41 rotates reversely, thereby causing the door 30 to be automatically moved in an upward direction, and thus, to be closed.

At this time, the upper end of the door 30 may be upwardly moved along the associated vertical guides 41 in accordance with a procedure substantially reverse to the above-discussed procedure for opening the door 30. The lower end of the door 30 is moved substantially horizontally toward the cabinet 10, and comes into contact with the front cover 15, together with the upper end of the door 30, so that the door 30 is closed.

Although the opening and closing operations of the door 30 have been described as being automatically achieved using the automatic door opening button 61 and automatic door closing button 62, alternatively, the user can manually open or close the door 30 while grasping the handle 39, if desired.

Figure 34:
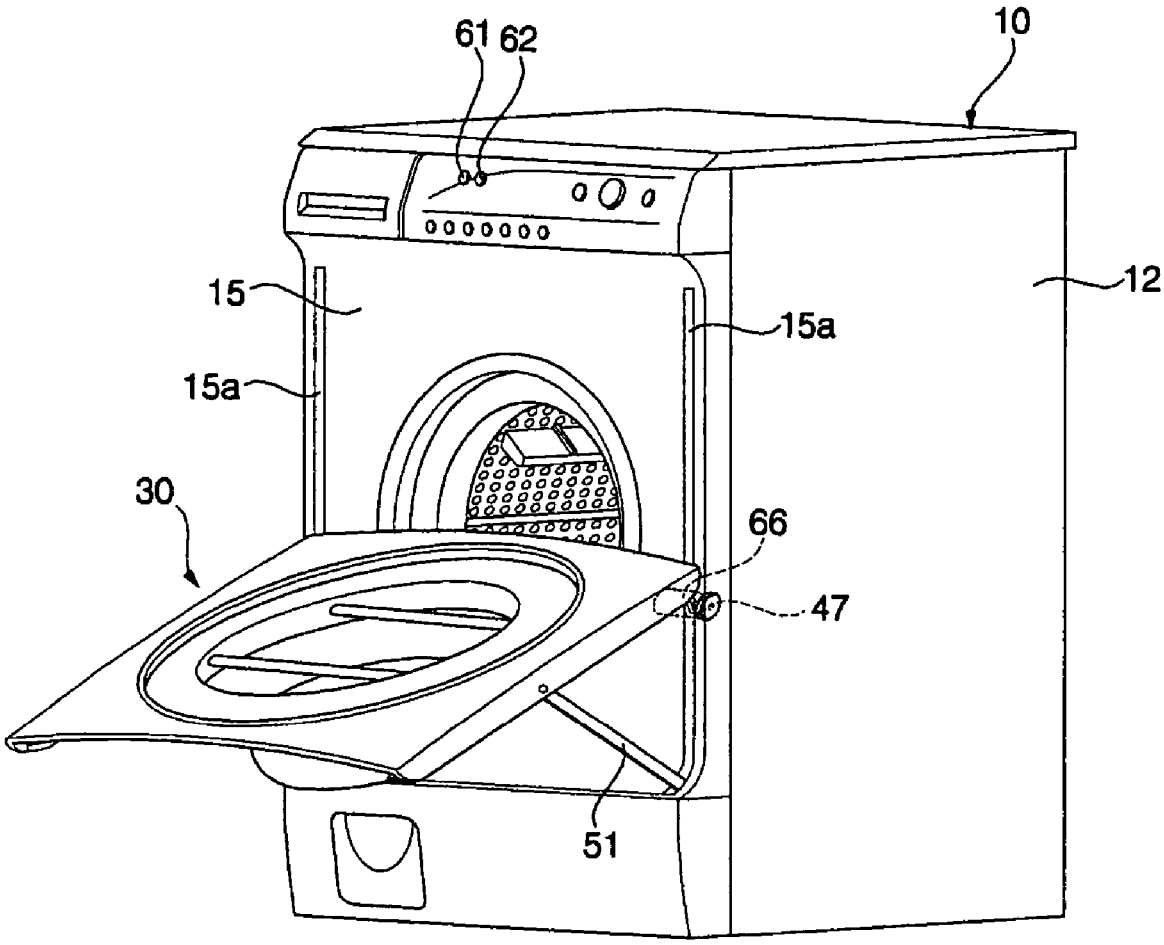
FIG. 34 is a perspective view illustrating a drum washing machine according to a twelfth embodiment of the present invention.
Figure 35:
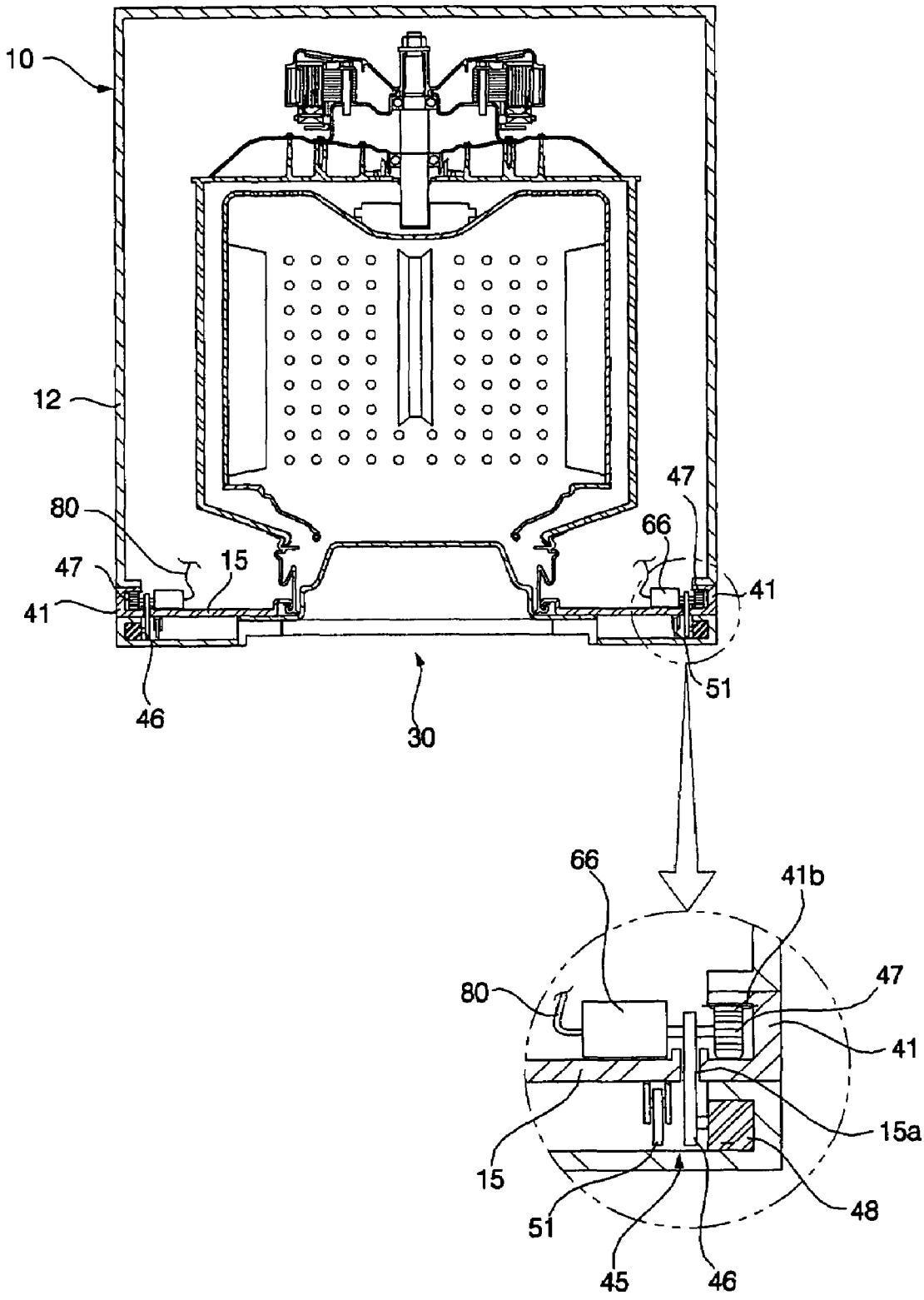
FIG. 35 is a transverse sectional view illustrating the drum washing machine according to the twelfth embodiment of the present invention.

FIGS. 34 and 35 illustrate a drum washing machine according to the twelfth embodiment of the present invention, motor brackets 46 may be mounted to the door 30 at opposite sides of the door 30, respectively. Each motor bracket 46 may extend through an associated one of the slits 15*a* into the interior of the cabinet 10 such that the motor bracket 46 is movable vertically along the associated slit 15*a* in accordance with a vertical movement of the door 30. An electric motor 66 and a pinion 47 may be mounted to each motor bracket 46.

An electrical wire 80 for supplying electrical power to each electric motor 66, may be directly connected to the electric motor 66 inside the cabinet 10, without necessarily extending through an associated support rod 51. In this case, it is preferred that the electrical wire 80 have a sufficient length, taking into consideration the moving distance of the electric motor 66.

In the above-described drum washing machine according to the twelfth embodiment of the present invention, when the automatic door opening button 61 or automatic door closing button 62 is operated to automatically open or close the door 30, the electric motor 66 is driven, thereby causing the door 30 to move downwardly or upwardly. At this time, the electric motors 66 and pinions 47 mounted to the associated motor brackets 46 extending through the associated slits 15*a* are moved along the associated vertical guides 41 in accordance with the vertical movement of the door 30. In this case, the support rods 51 support the opening or closing operation of the door 30, for example, as discussed in the eleventh embodiment.

Thus, in the above-described drum washing machine according to the twelfth embodiment of the present invention, the electric motors 66, pinions 47, and vertical guides 41 may be arranged inside the cabinet 10 without being outwardly exposed. Accordingly, the front surface of the drum washing machine may be kept attractive and clean.

Other configurations and/or operations of the twelfth embodiment may be identical or similar to those of the eleventh or any other suitable embodiment, for example.

Figure 36:
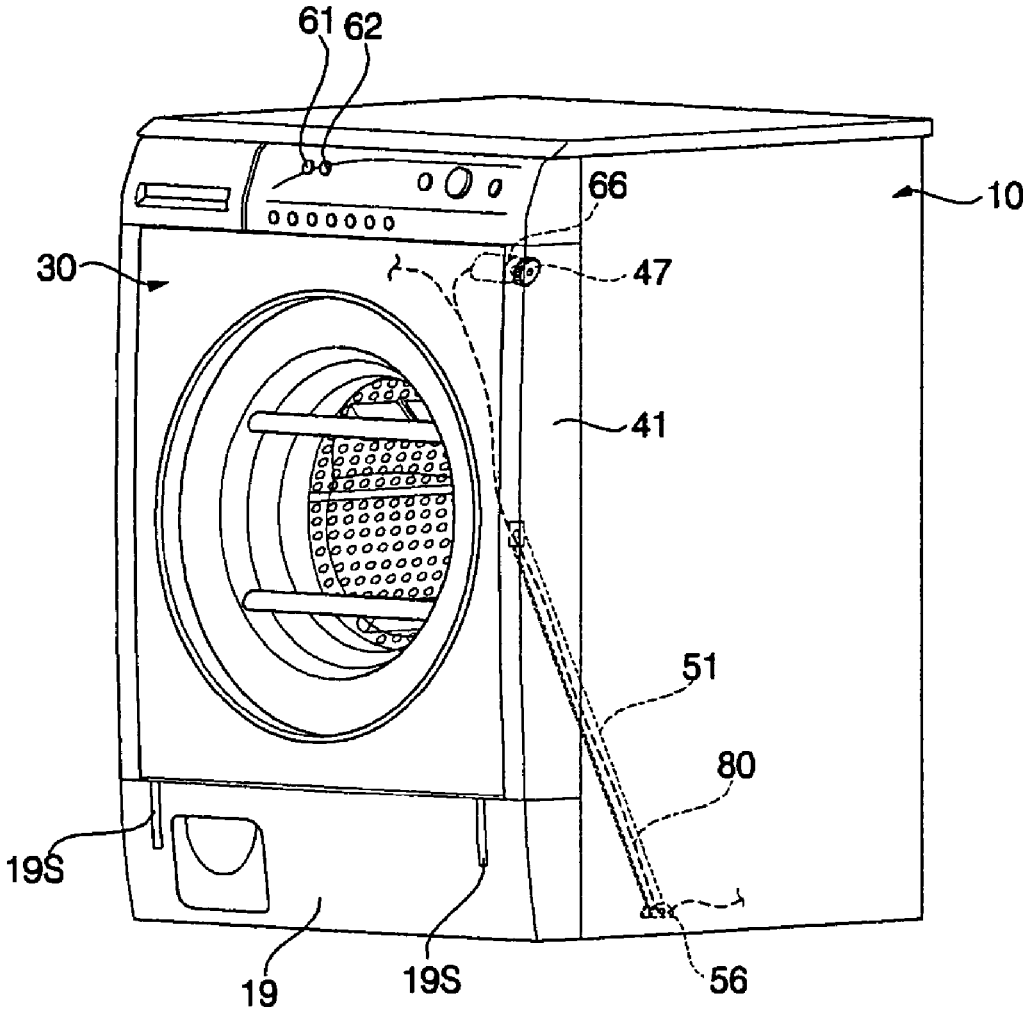
FIG. 36 is a perspective view of a drum washing machine according to a thirteenth embodiment of the present invention, illustrating a state in which a door of the drum washing machine is closed.
Figure 37:
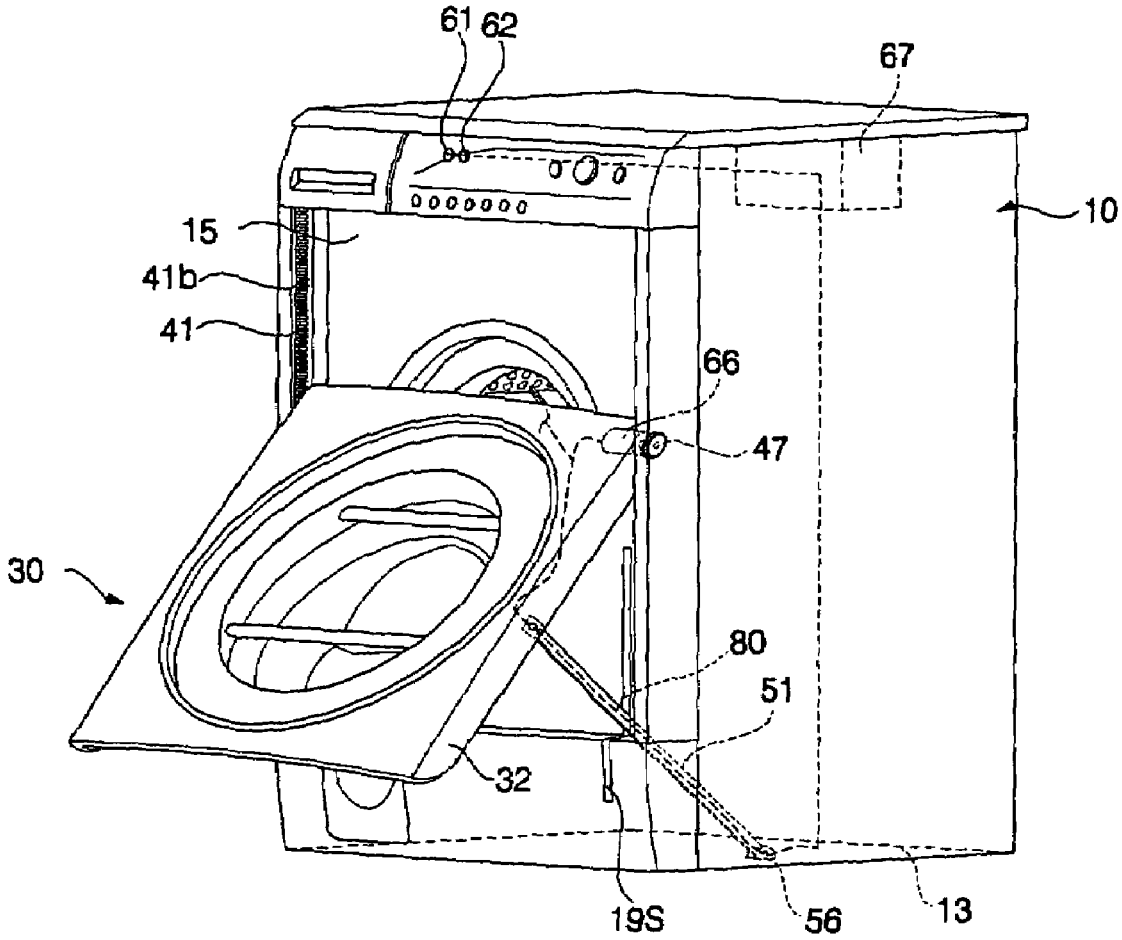
FIG. 37 is a perspective view of the drum washing machine according to the thirteenth embodiment of the present invention, illustrating a state in which the door is partially opened.

FIGS. 36 and 37 illustrate a drum washing machine according to a thirteenth embodiment of the present invention in which the drum washing machine may have a configuration in which electric motors 66 and pinions 47 are directly mounted to side portions 32 of a door 30, and support rods 51 are mounted to a bottom wall of a cabinet 10.

For example, vertical guide plates 41 may be arranged at opposite side ends of an outer surface of a front cover 15, respectively, such that the outer surface of each vertical guide 41 is substantially flush with the outer surface of the door 30.

The door 30 may be arranged between the vertical guides 41. The electric motors 66 and pinions 47 may be directly mounted to the associated side portions 32 of the door 30 at an upper end of the door 30, without using separate motor brackets, such that the electric motors 66 and pinions 47 are movable along the racks 41*b* of the associated vertical guides 41. Each electric motor 66 and each pinion 47 associated therewith may be arranged inside and outside the associated side portion 32 of the door 30.

Each support rod 51 may have a hollow structure to allow an electrical wire 80 for supplying electric power to an associated electric motor 66 to pass through the support rod 51, similarly to the above-described eleventh embodiment, for example.

Figure 38:
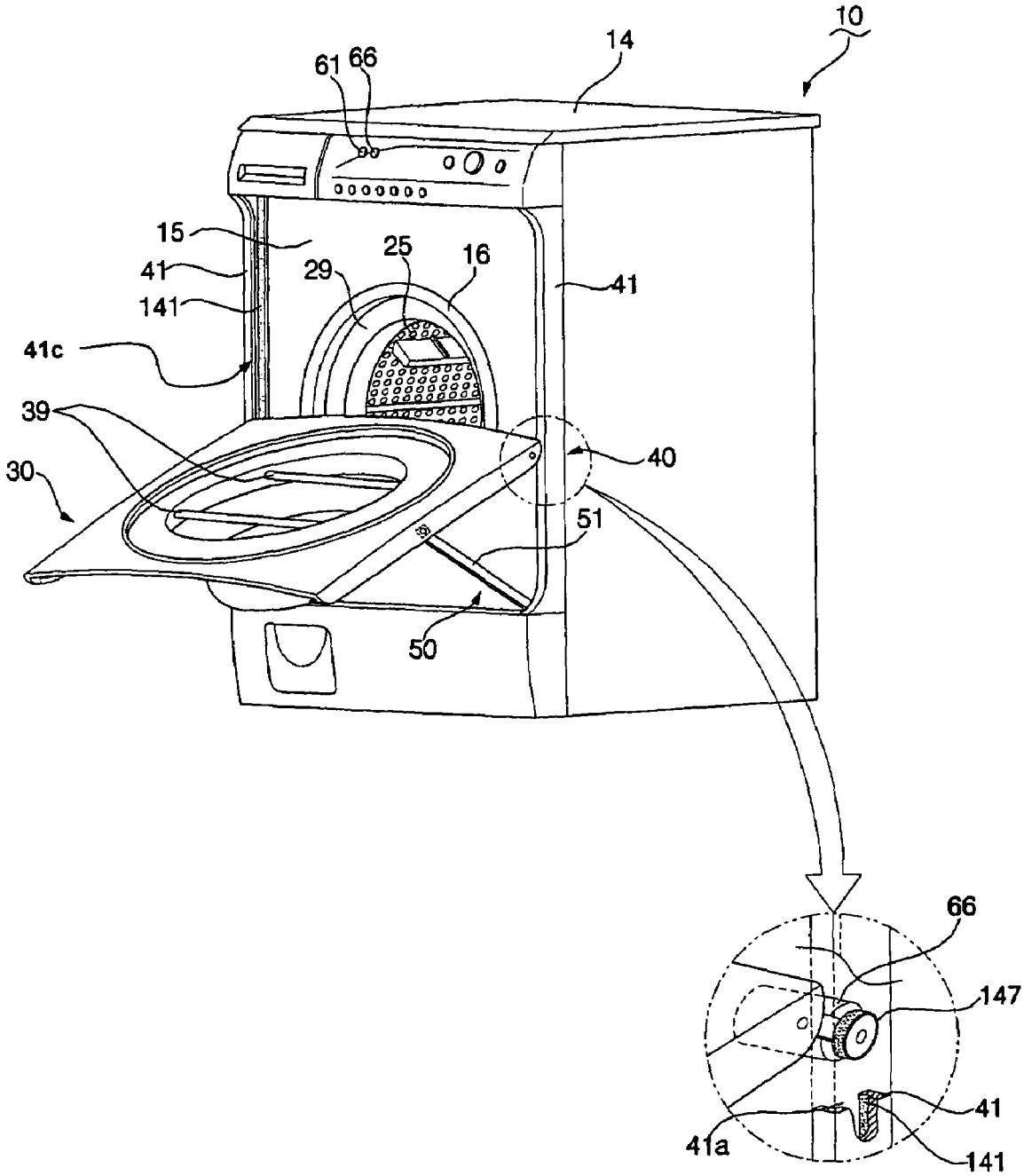
FIG. 38 is a perspective view of a drum washing machine according to a fourteenth embodiment of the present invention.
Figure 39:
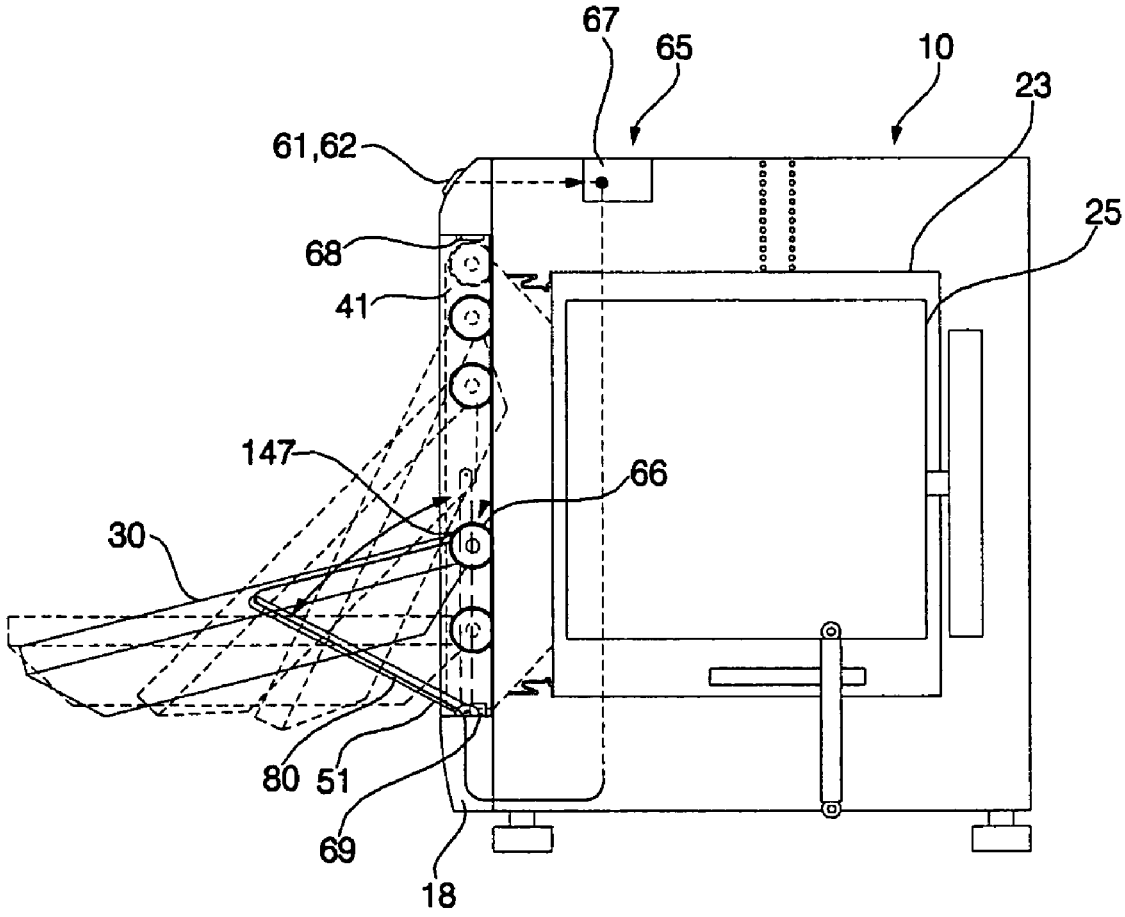
FIG. 39 is a schematic side view of the drum washing machine according to the fourteenth embodiment of the present invention.

FIGS. 38 and 39 illustrate a drum washing machine according to a fourteenth embodiment of the present invention, in which the drum washing machine may have a configuration including frictional rollers 147 as rotating members, and frictional members 141 as rotation/linear movement converting members, as compared to the eleventh embodiment in which the rotating members of the door moving mechanism 70 comprise the pinions 47.

In this case, each frictional member 141 may have an elongated sheet structure, and may be attached to one side portion of an inner surface of a vertical guide 41.

In the drum washing machine according to the fourteenth embodiment, each frictional roller 147 is rotated in accordance with an operation of an electric motor 66. At this time, the frictional roller 147 is moved vertically along the vertical guide 41 by virtue of a friction generated between the frictional roller 147 and the frictional member 141 of the vertical guide 41, so that the door 30 is moved vertically.

In particular, since the door may be automatically opened and/or closed, using pinions rotated by motors and racks, user convenience may be further improved.

The electrical power supplying apparatus for the door of the drum washing machine according to the present invention can supply electrical power to electrical power consuming devices provided at the door through the support rods connected between the door and the cabinet. Accordingly, electrical power required for the electric motors or the like installed on the door can be easily supplied.

Figure 41:
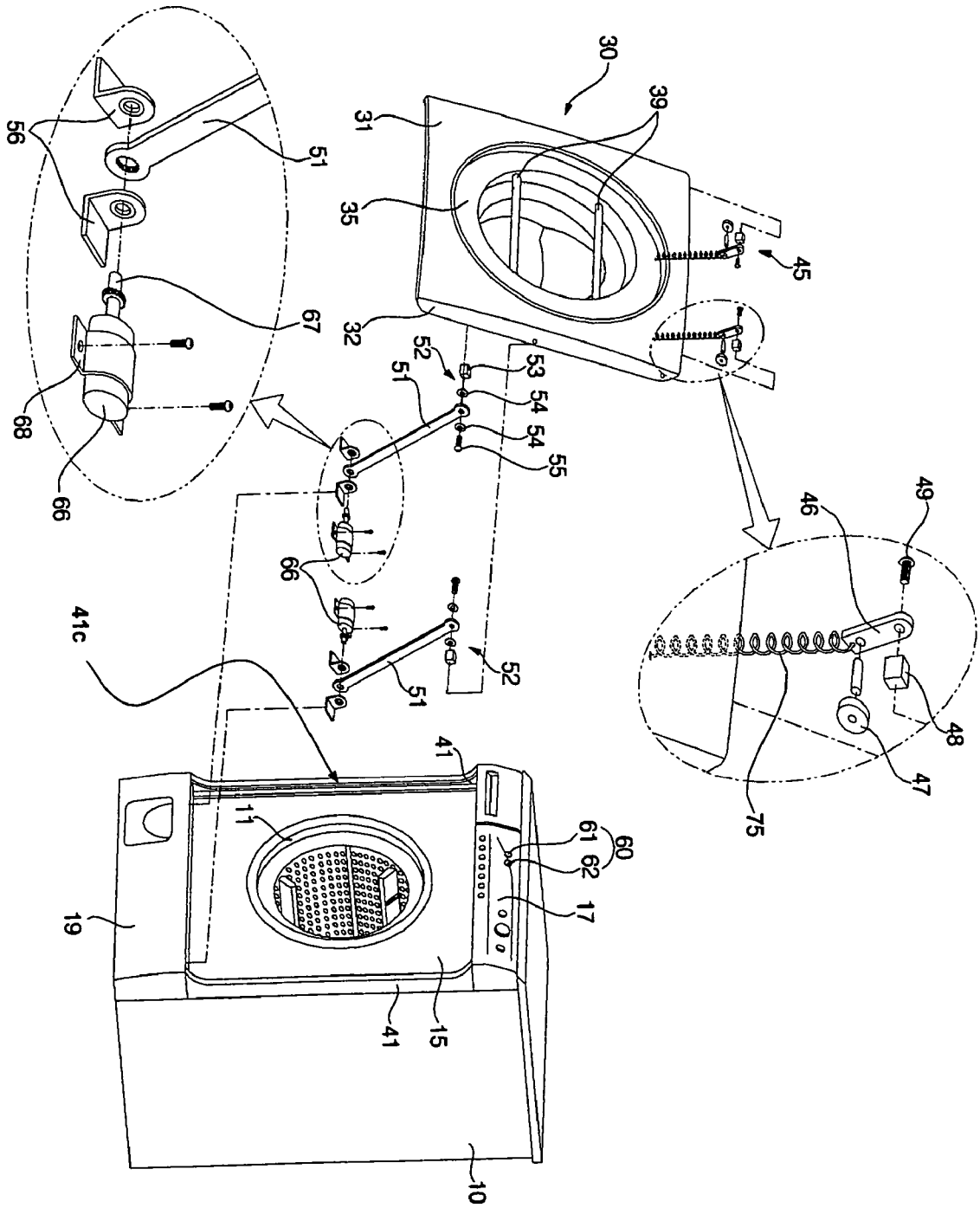
FIG. 41 is an exploded perspective view illustrating the drum washing machine in accordance with the fifteenth embodiment of the present invention with an automatically vertically openable/closable door separated from the drum washing machine.

FIGS. 40 through 43 illustrate a drum washing machine having an automatically vertically openable/closable door in accordance with a fifteenth embodiment of the present invention referring initially to FIGS. 40 and 41, the drum washing machine, which is provided with the automatically vertically openable/closable door in accordance with the present invention and similarly to various other embodiments described herein, may include a cabinet 10 to form an outer structure of the washing machine. An opening 11 is provided at a front wall of the cabinet 10 to allow laundry to be put into or taken out of the washing machine.

Figure 42:
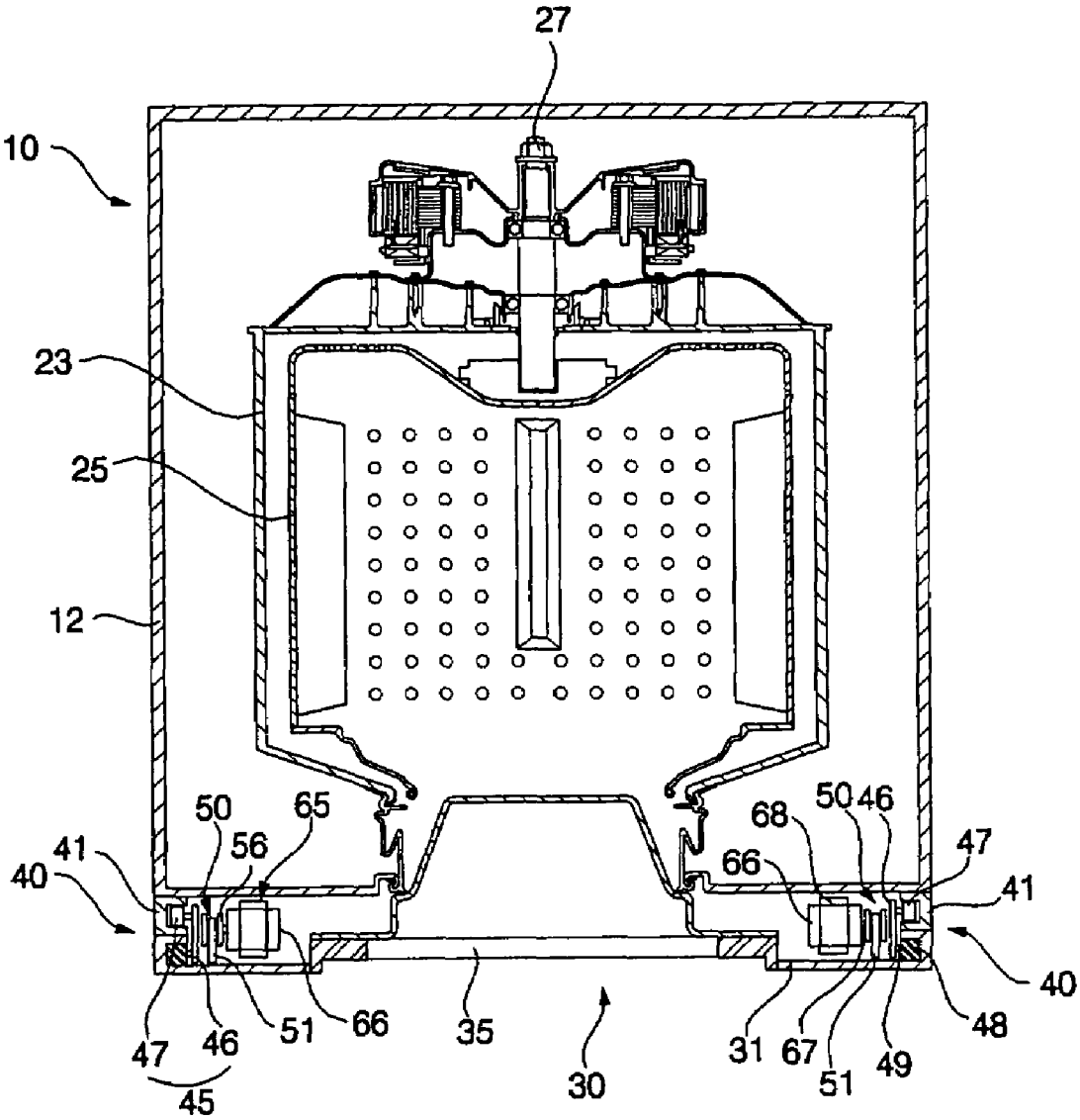
FIG. 42 is a transverse sectional view of the drum washing machine in accordance with the fifteenth embodiment of the present invention.
Figure 43:
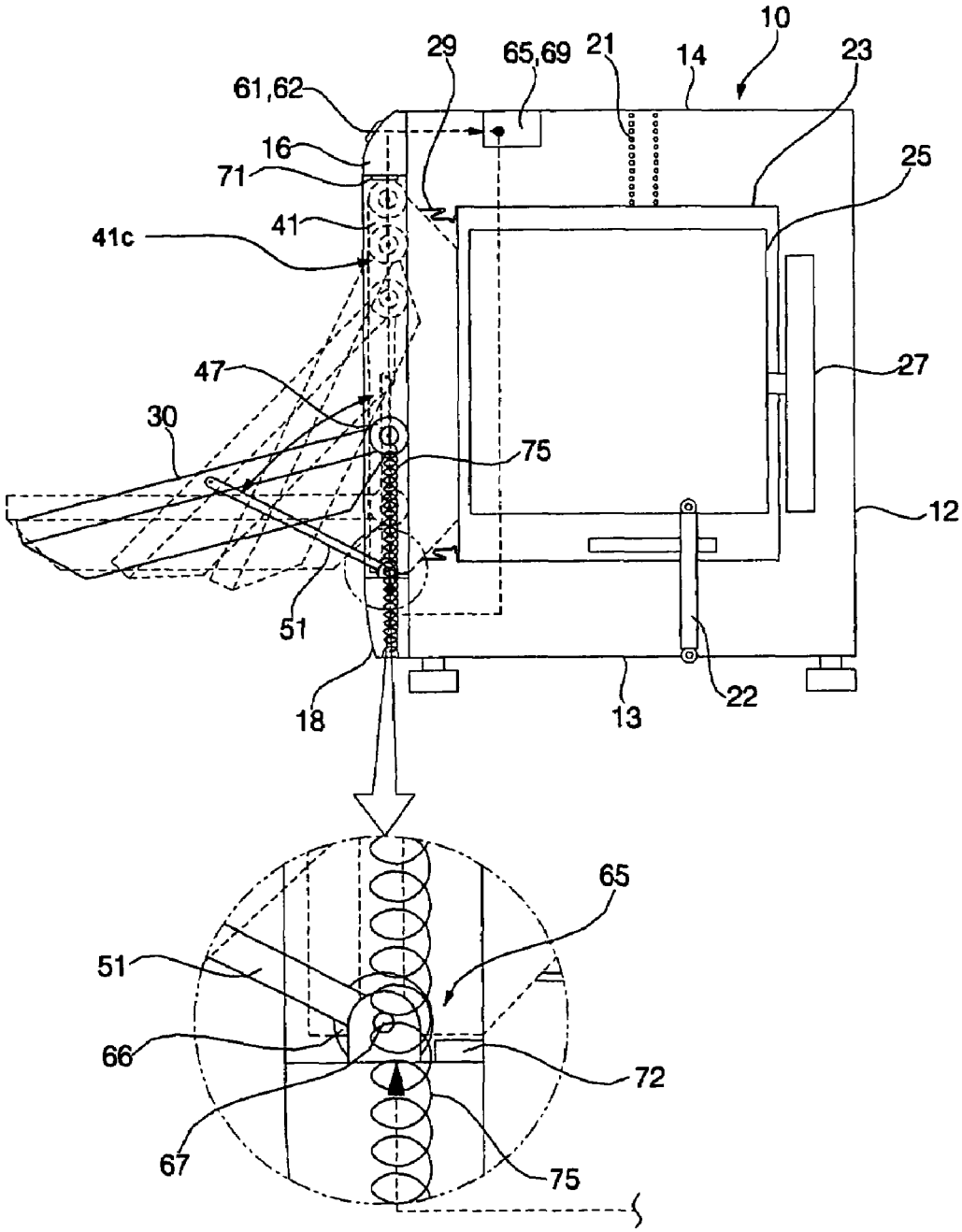
FIG. 43 is a schematic side view illustrating a door of the drum washing machine at various positions as the door opens, in accordance with the fifteenth embodiment of the present invention.

Devices to perform a washing operation may be installed in the cabinet 10. For such devices, as shown in FIGS. 42 and 43, the drum washing machine 1 may include a tub 23 supported by a spring 21 and a damper 22 in the cabinet 10 to contain washing water, a drum 25 arranged in the tub 23 to wash laundry while rotating, and a drive motor 27 to rotate the drum 25. Other features of the drum washing machine may be substantially similar to those described herein regarding the various other embodiments, or any other suitable configurations.

As shown in FIGS. 40 through 43, for example an automatic door-opening button 61 and an automatic door-closing button 62 operated to automatically open and close the door 30, which will be described later, are formed on the control panel 17.

Similarly to the other embodiments described above, for example, handle 39 may be provided at the door 30 to allow the user to open or close the door 30 while grasping the handle 39. The handle 39 may include upper and lower handles 39U and 39D installed in parallel.

In accordance with the fifteenth embodiment, the lower end of each support rod 51 may be connected to a shaft 67 of a corresponding electric motor 66 by a gear or spline connection (as shown in FIG. 41, not numbered), so that the support rods 51 are rotated by the driving force of the electric motors 66. Motor seats 68 for supporting the electric motors 66 may be installed on the upper portion of the lower cover 19, and hinge brackets 56 for rotatably supporting the shaft 67 of the electric motor 66 may be installed at both sides of each of the support rods 51.

As shown in FIG. 41, for example, drum washing machine having the above-described door opening/closing structure may include an automatic opening/closing unit for automatically moving the door 30 vertically using the electric motors 66.

The automatic opening/closing unit may include an automatic opening/closing operation unit 60 having the automatic door-opening button 61 and the automatic door-closing button 62, which may be installed on the control panel 17 and manipulated by a user, and rotary force generation units 65 for supplying electrical power to the electric motors 66 according to the manipulation of the automatic opening/closing operation unit 60 so that the support rods 51 move vertically and thus moving the door 30 vertically.

Preferably, the automatic opening/closing operation unit 60 may include the automatic door-opening button 61 and the automatic door-closing button 62. However, the automatic opening/closing operation unit 60 may alternatively include only one of either the automatic door-opening button 61 or the automatic door-closing button 62. Although FIGS. 40 through 43 show that the automatic opening/closing operation unit 60 is installed on the control panel 17 mounted on the front surface of the cabinet 10, the automatic opening/closing operation unit 60 may alternatively be installed on other positions of the washing machine, i.e., the upper or side surface of the cabinet 10, for example.

Each of the rotary force generation units 65, as shown in FIG. 43, for example, may include the electric motor 66 for moving the support rod 51 vertically, and a motor control unit 69 for turning the corresponding electric motor 66 on or off or for controlling the electric motor 66 to rotate in a regular or reverse direction according to the manipulation of the automatic opening/closing operation unit 60.

Preferably, the motor control units 60 may be installed in a controller for controlling the overall operation of the drum washing machine 1. Other devices, such as, for example, a motor-driving circuit (not shown) for driving the electric motors 66, may also be installed in the controller.

Preferably, the electric motors 66 generate a rotary force in a regular or reverse direction according to the manipulation of the motor control units 69.

Further, preferably, limit switches 71 and 72, for sensing when the door 30 is completely opened or closed and supplying a signal indicating such to the motor control units 69 so as to stop the electric motors 66, may be installed on door-movement routes of the upper and/or lower portions of the front cover 15.

An elastic member 75 for supplying an elastic force to facilitate the vertical movement of the door 30 according to the operation of the electric motors 66 may be installed between the roller bracket 46 of the guide coupler 45 placed at the upper end of the door 30 and the lower portion of the cabinet 10. Preferably, the elastic member 75 may be a compression spring for supplying an elastic force in the direction toward which the door closes.

Alternatively, for example, an elastic member (not shown) may be installed between the roller bracket 46 of the door 30 and the upper end of the cabinet 10. Here, preferably, the elastic member may be a tension spring for supplying an elastic force in the direction toward which the door is closed.

The elastic members 75 may be operated by the electric motors 66, which may in this case be one-directional motors rather than bidirectional motors. That is, when opening the door 30, the door 30 is opened by the driving force of the electric motors 66, and when closing the door 30, the door 30 is closed by the elastic force of the elastic members 75 while the electric motors 66 do not provide the driving force.

Hereinafter, the operation of the drum washing machine with the automatically vertically openable/closable door in accordance with the fifteenth embodiment of the present invention will be described in view of FIGS. 44A through 44E, illustrate a sequence of positions of the door 30 of the drum washing machine 1 as the door opens.

Figure 44A:
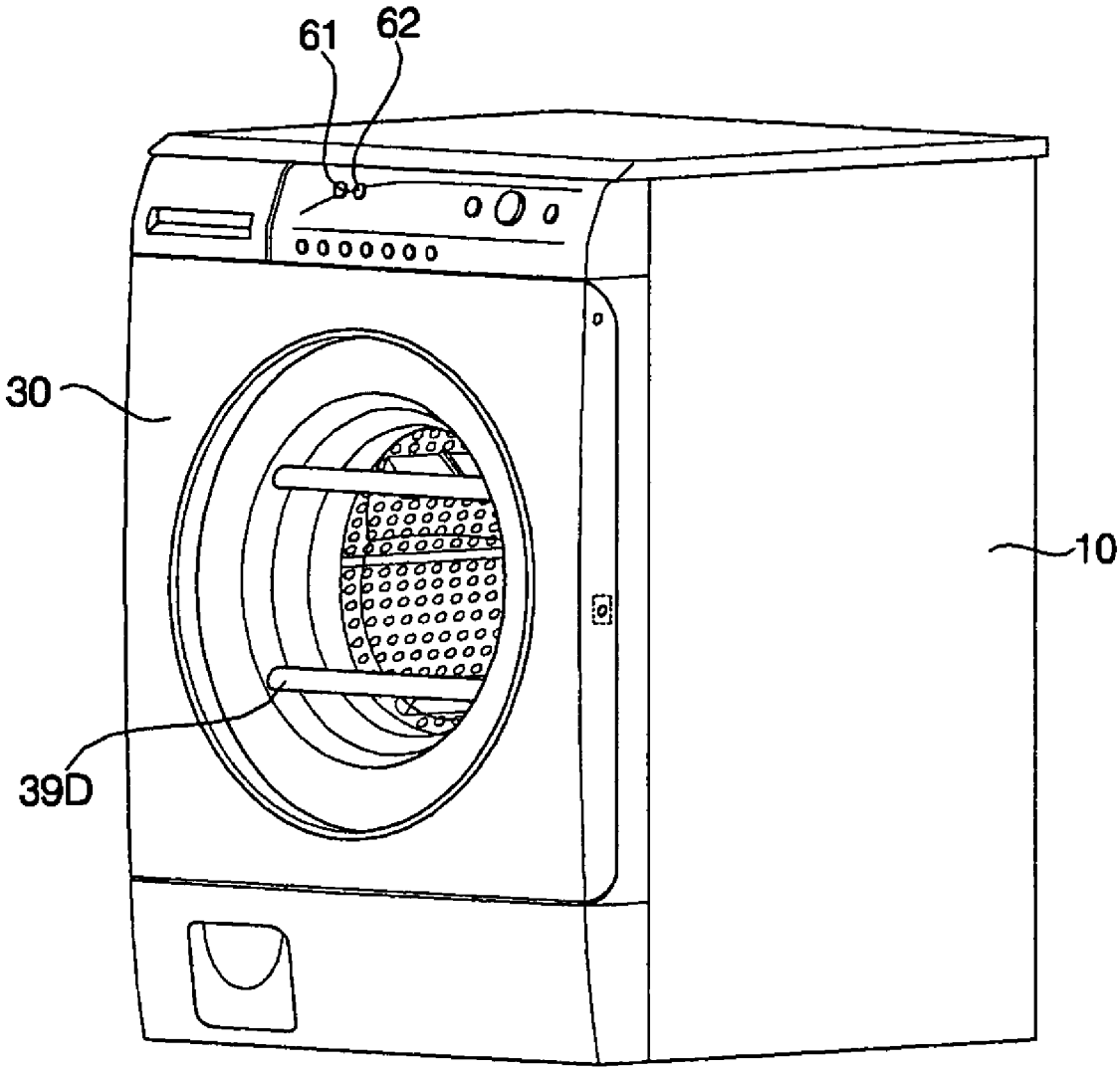
FIGS. 44A through 44E are respective perspective views illustrating a sequence of door positions of the drum washing machine in accordance with the fifteenth embodiment of the present invention as the door opens.
Figure 44B:
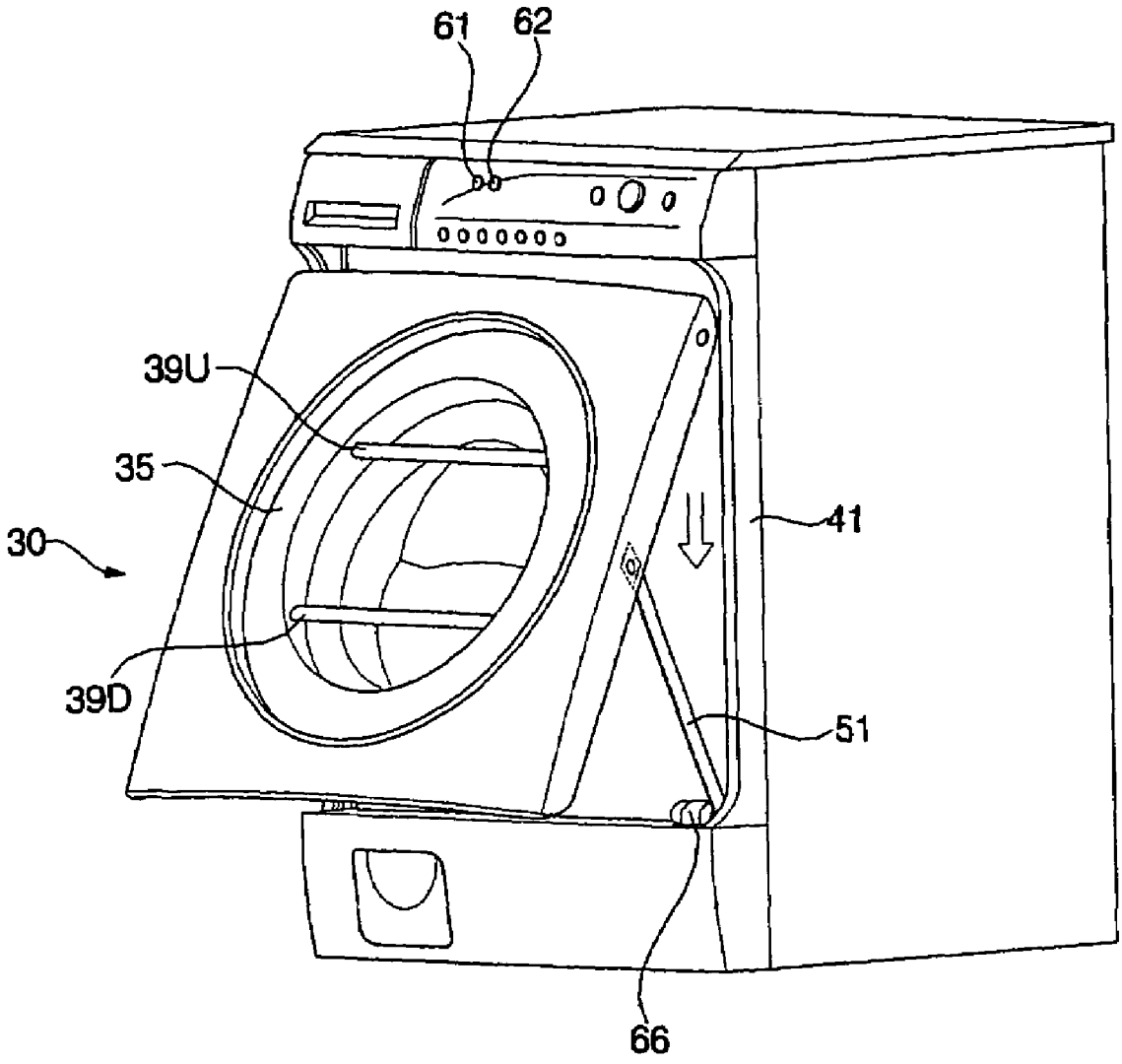
Figure 44C:
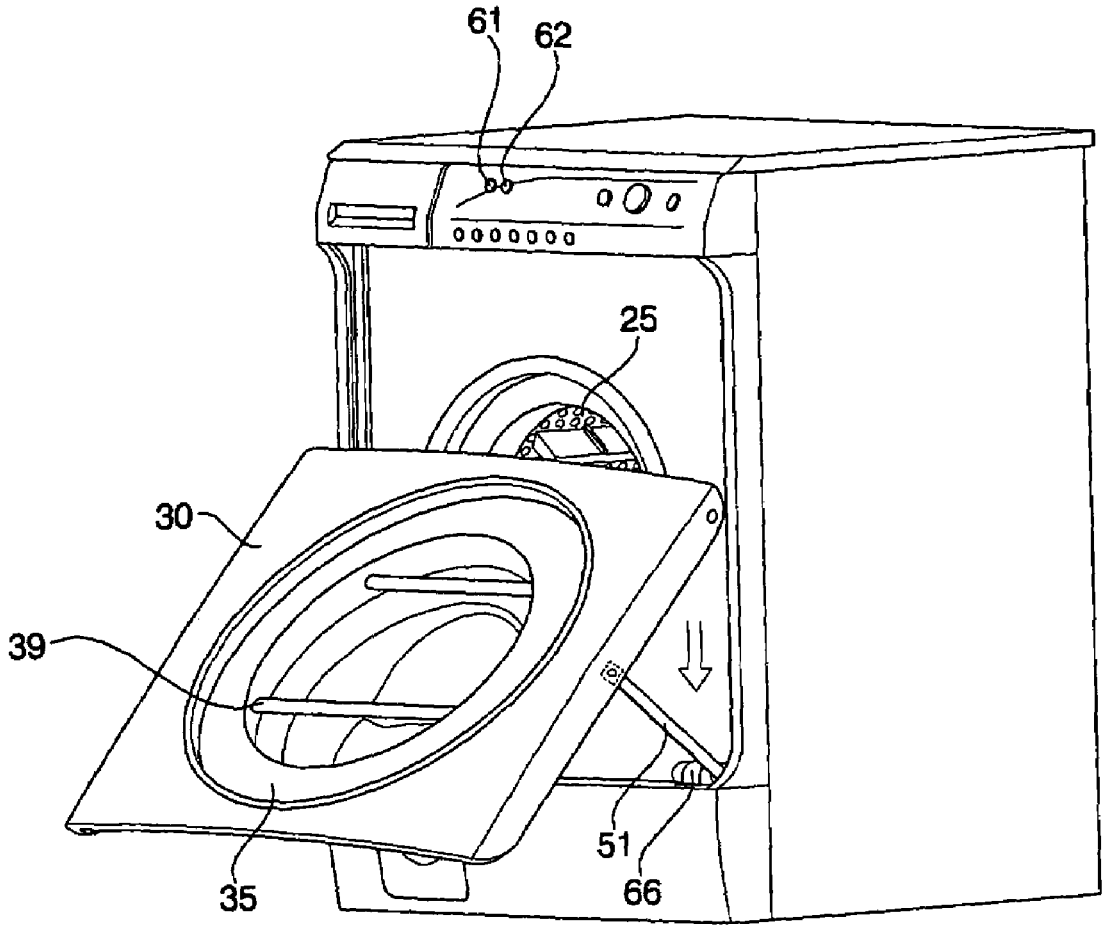
Figure 44D:
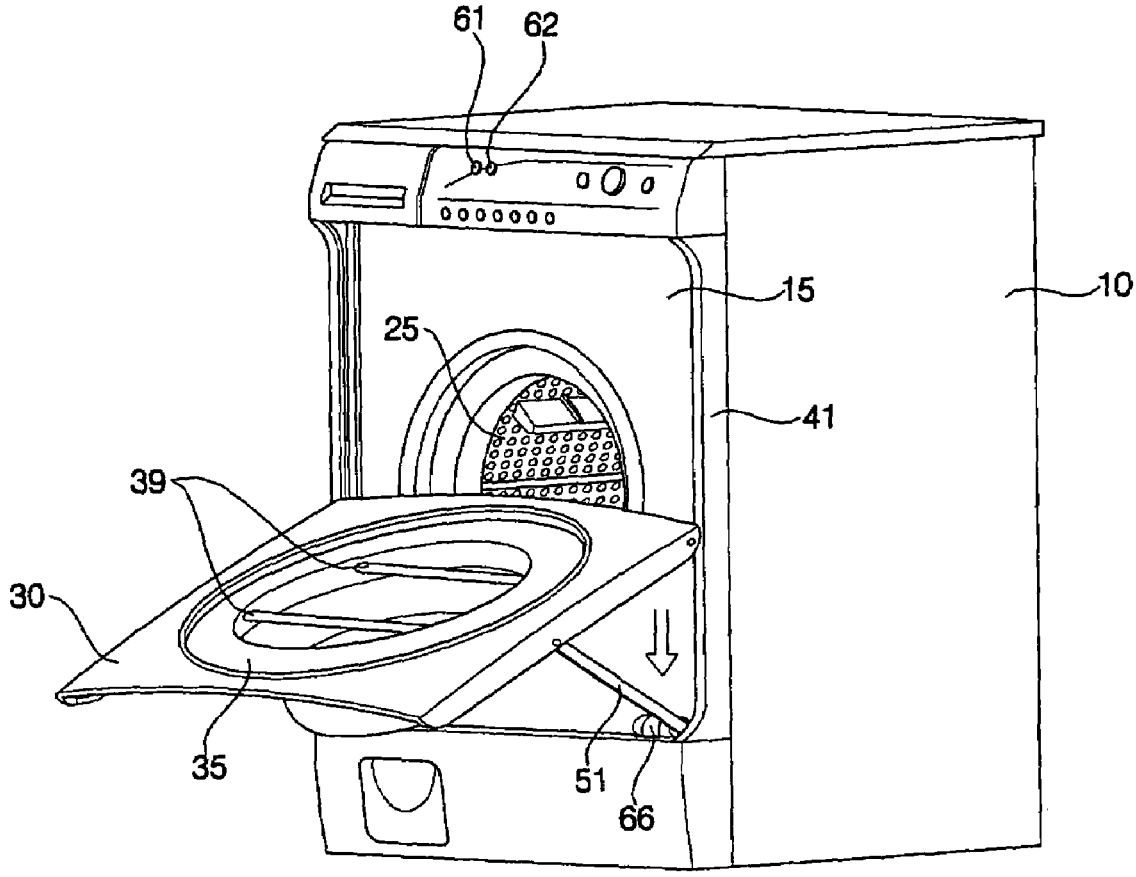
Figure 44E:
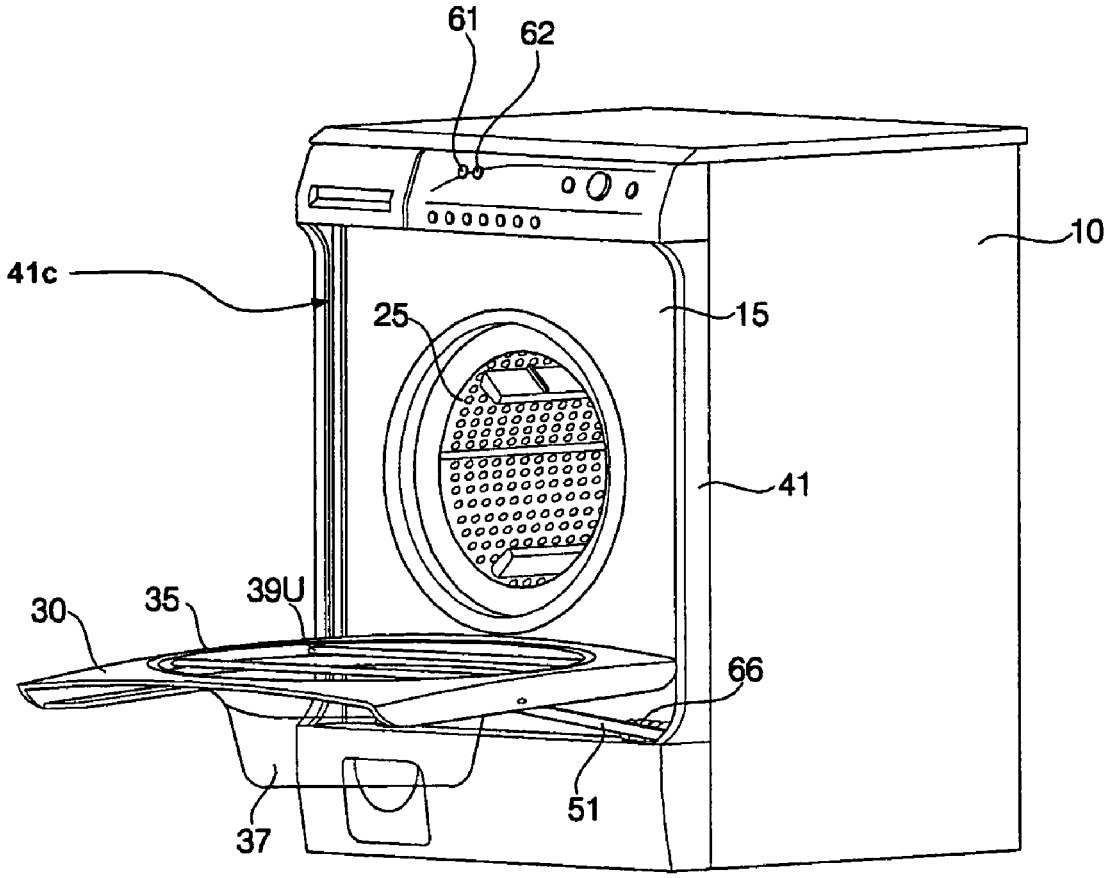

For example, when a user presses the automatic door-opening button 61 installed on the front surface of the cabinet 10 in order to automatically open the door 30 from the closed state, as shown in FIG. 44A for example, the electric motors 66 are operated according to the control signal of the motor control units 69, which receive a corresponding signal, thereby rotating the support rods 51 and automatically opening the door 30 downwardly. The door 30 may then move through the positions illustrated in FIGS. 44B through 44E such that the upper end of the door 30 is moved downwardly, and the lower end of the door 30 is horizontally and forwardly moved away from the cabinet 10. As a result, the door 30 may be opened as shown in FIG. 44E for example.

When the electric motors 66 are operated, the support rods 51 may hinge about the portion thereof connected to the motor shafts 67 from a vertical state to a horizontal state, and the upper end of the door 30 moves downwardly as the rollers 47 roll downwardly along the associated vertical guides 41. Thus the door 30 is opened such that the door 30 lies flat in a substantially horizontal orientation, relative to the typically vertical orientation of the door 30 when closed.

The laundry, which is taken out of the drum 25 in the opened state of the door 30 (by the user for example), and temporarily stored in the door window 35, is subsequently taken out of the door window 35 and transferred to another place. When the user presses the automatic door-closing button 62, the electric motors 66 are operated in the reverse direction according to the control signal of the motor control units 69, thereby rotating the support rods 51 upwardly and automatically moving the door 30 upwardly and closing the door 30 by the driving force of the electric motors 66 and the elastic force of the elastic members 75.

Then substantially in reverse of the opening procedures of the door 30 described above, the upper end of the door 30 is moved upwardly along the vertical guides 41, and the lower end of the door 30 is moved horizontally toward the cabinet 10. As a result, the door 30 is closed.

Although the door 30 described in the fifteenth embodiment may be opened and/or closed by the automatic door-opening button 61 and the automatic door-closing button 62, the door 30 may alternatively be opened and/or closed by the handle 39 provided on the door in accordance with the user's preference, for example.

Figure 45:
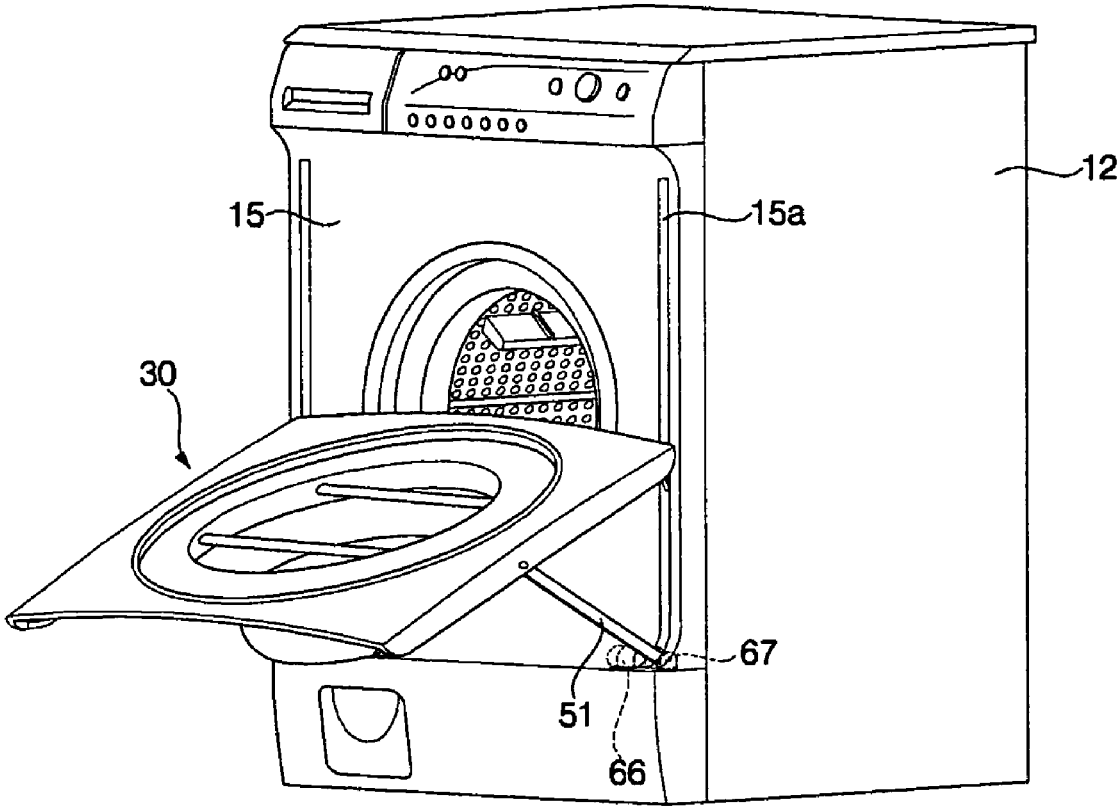
FIG. 45 is a perspective view of a drum washing machine in accordance with a sixteenth embodiment of the present invention.
Figure 46:
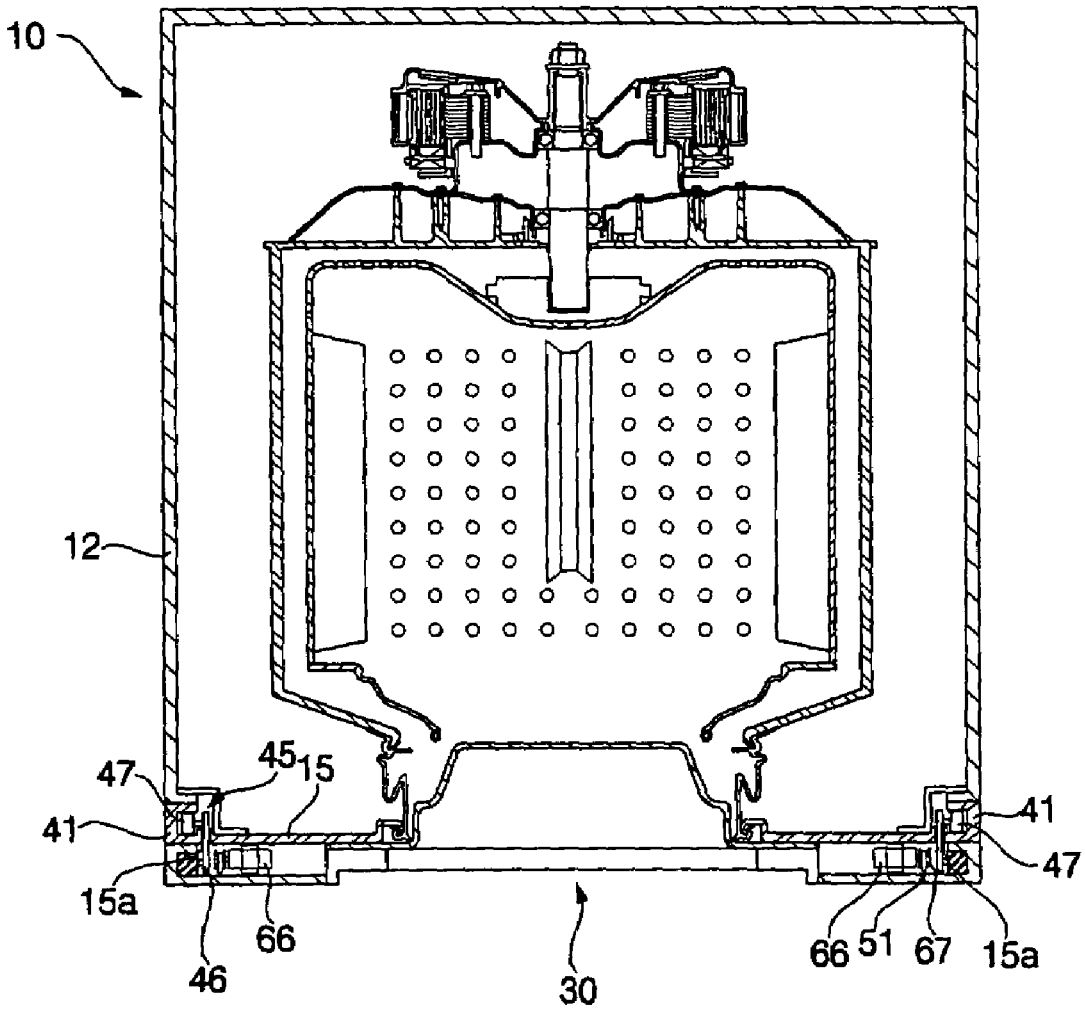
FIG. 46 is a transverse sectional view of the drum washing machine in accordance with the sixteenth embodiment of the present invention.

Here a sixteenth embodiment (which may include features or configurations substantially similar to the fifteenth embodiment, for example) of the present invention will be described in view of FIGS. 45 and 46. More particularly, FIG. 45 is a perspective view of a drum washing machine 1 in which a door is partially opened, and FIG. 46 is a transverse sectional view of the drum washing machine 1.

For example, similarly to the fifteenth embodiment, the lower end of each support rod 51 for supporting the door 30 may be connected to the shaft 67 of the corresponding electric motor 66, so that the support rods 51 are rotated by the driving force of the electric motors 66 to automatically vertically move the door 30.

When the door 30 of the drum washing machine 1 in accordance with the sixteenth embodiment is automatically opened or closed by manipulating the automatic door-opening button 61 or the automatic door-closing button 62, the door 30, together with the support rods 51, move vertically of the driving of the electric motors 66, and thus the rollers 47 inserted into the slits 15*a* move vertically along the vertical guides 41.

Because the rollers 47 and the vertical guides 41 are not exposed to the outside but rather are placed inside the cabinet 10, the drum washing machine 1 in accordance with the sixteenth embodiment may have a simple external appearance.

Figure 47:
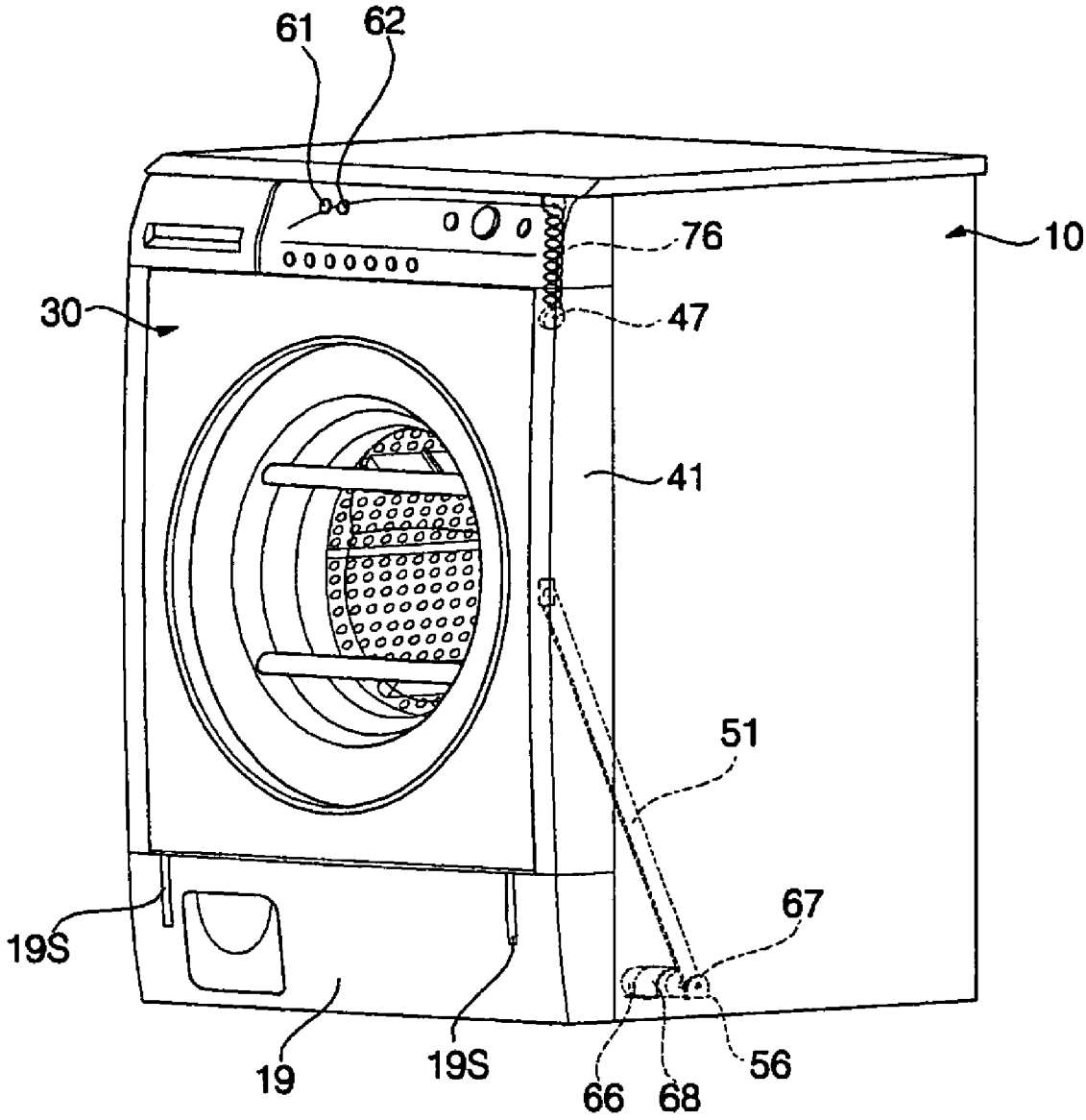
FIG. 47 is a perspective view of a drum washing machine in accordance with a seventeenth embodiment of the present invention, illustrating a state in which a door of the drum washing machine is closed.
Figure 48:
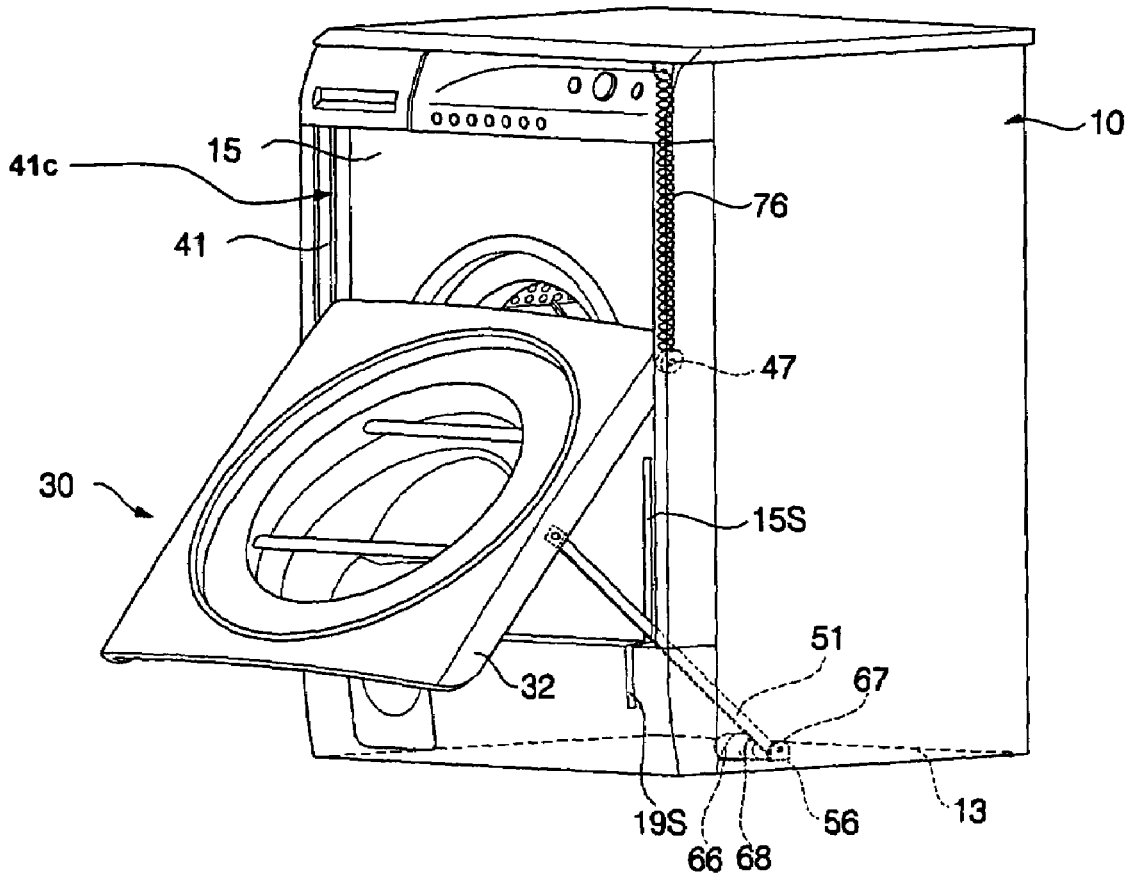
FIG. 48 is a perspective view of the drum washing machine in accordance with the seventeenth embodiment of the present invention, illustrating the door of the drum washing machine opened

FIGS. 47 and 48 illustrate a drum washing machine 1 in accordance with a seventeenth embodiment of the present invention, for example, in which the drum washing machine 1 may have a configuration such that the rollers 47 are directly mounted to side portions 32 of the door 30, and the support rods 51 and the electric motors 66 are mounted to a bottom wall of the cabinet 10.

According to one aspect of the seventeenth embodiment, the vertical guides 41 may be arranged at opposite side ends of an outer surface of the front cover 15, respectively, such that the outer surface of each vertical guide 41 is flush with the outer surface of the door 30. The door 30 may be arranged between the vertical guides 41. The rollers 47 are mounted directly to the associated side portions 32 of the door 30 at an upper end of the door 30, without necessarily using separate roller brackets, such that the rollers 47 are movable along the associated vertical guides 41.

Each support rod 51 may have an upper end hingably connected to an associated one of the side portions 32 of the door 30, and a lower end extending into the cabinet 10 through the front cover 15 and the lower cover 19. The extended end of each support rod 51 may be connected to the shaft 67 of the corresponding electric motor 66, and vertically rotated by the driving force of the electric motor 66.

The electric motors 66 may be mounted on the motor seats 69 formed on the base 13 forming the bottom of the cabinet 10, and the shafts 67 of the electric motors 66 may be rotatably supported by the hinge brackets 56.

An elastic member 76 may be interposed between the corresponding roller bracket 46 of the door 30 and the upper end of the cabinet 10. Preferably, the elastic member 76 is a tension spring for supplying an elastic force to the door 30 in the direction toward which the door 30 is closed.

In a manner similar to the fifteenth or sixteenth embodiments, the support rods 51 of the drum washing machine 1 of the seventeenth embodiment may be rotated by the driving force of the electric motors 66, and the door 30 may be moved downwardly to be opened, or moved upwardly to be closed.

As discussed above regarding the drum washing machine of the fifteenth through seventeenth embodiments, the support rods may vertically move by use of the electric motors so that the door is automatically opened and/or closed. Accordingly, it is possible to achieve enhanced convenience for the user when opening or closing the door of the drum washing machine.

Figure 49:
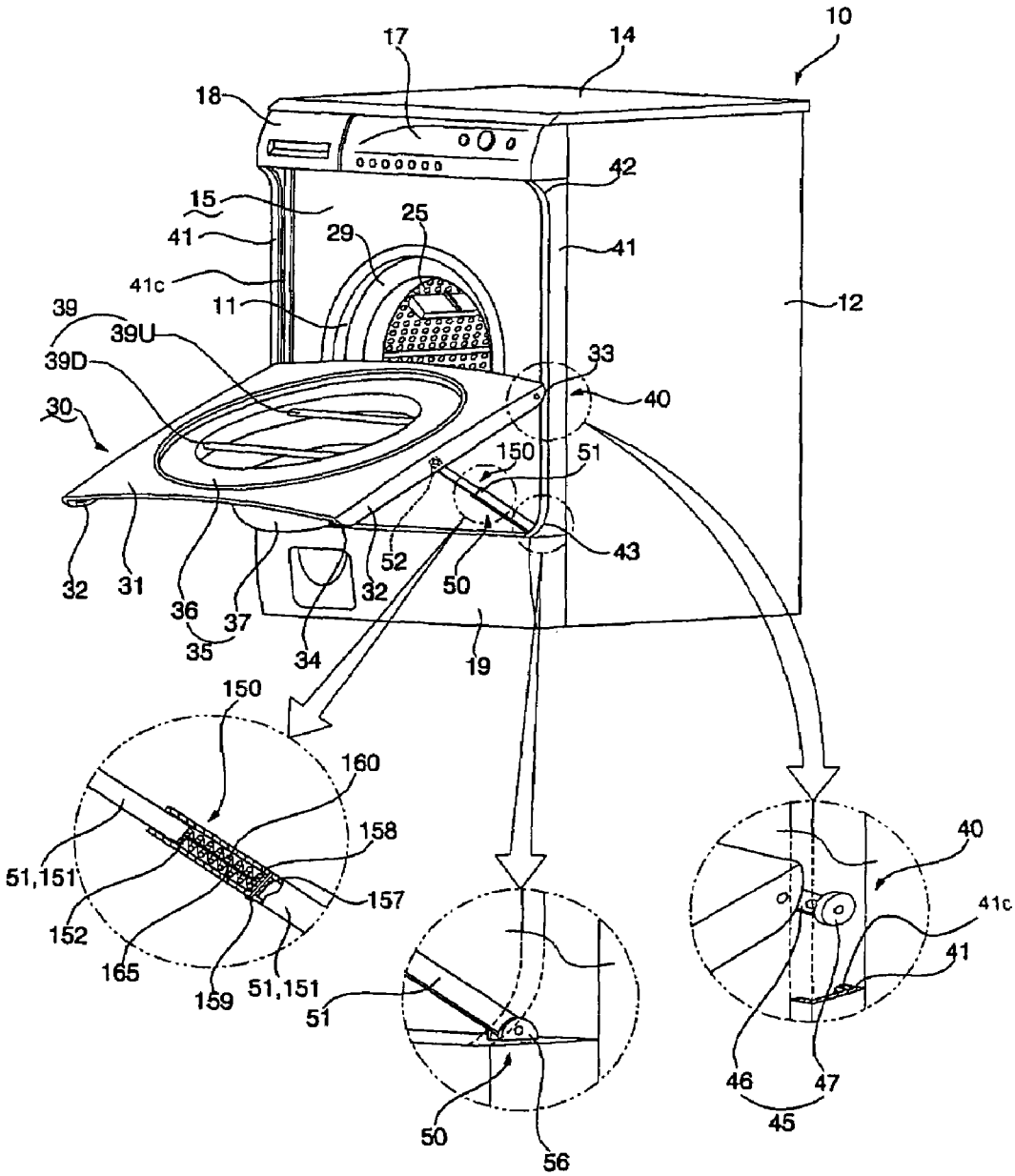
FIG. 49 is a perspective view of a drum washing machine in accordance with an eighteenth embodiment of the present invention, together with enlarged views of particular sections thereof.
Figure 50:
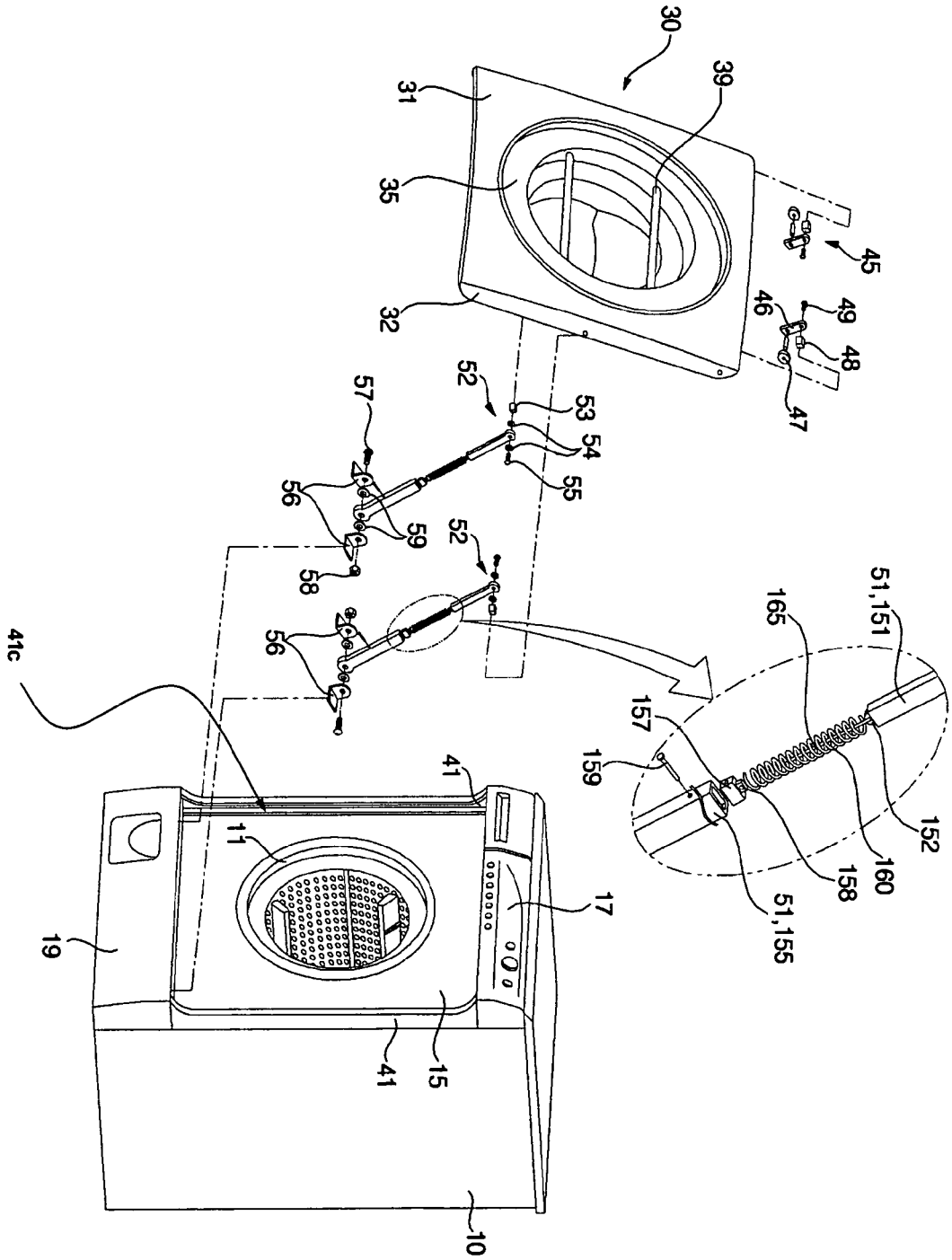
FIG. 50 is an exploded perspective view illustrating the drum washing machine in accordance with the eighteenth embodiment of the present invention with a door separated from the drum washing machine.
Figure 51:
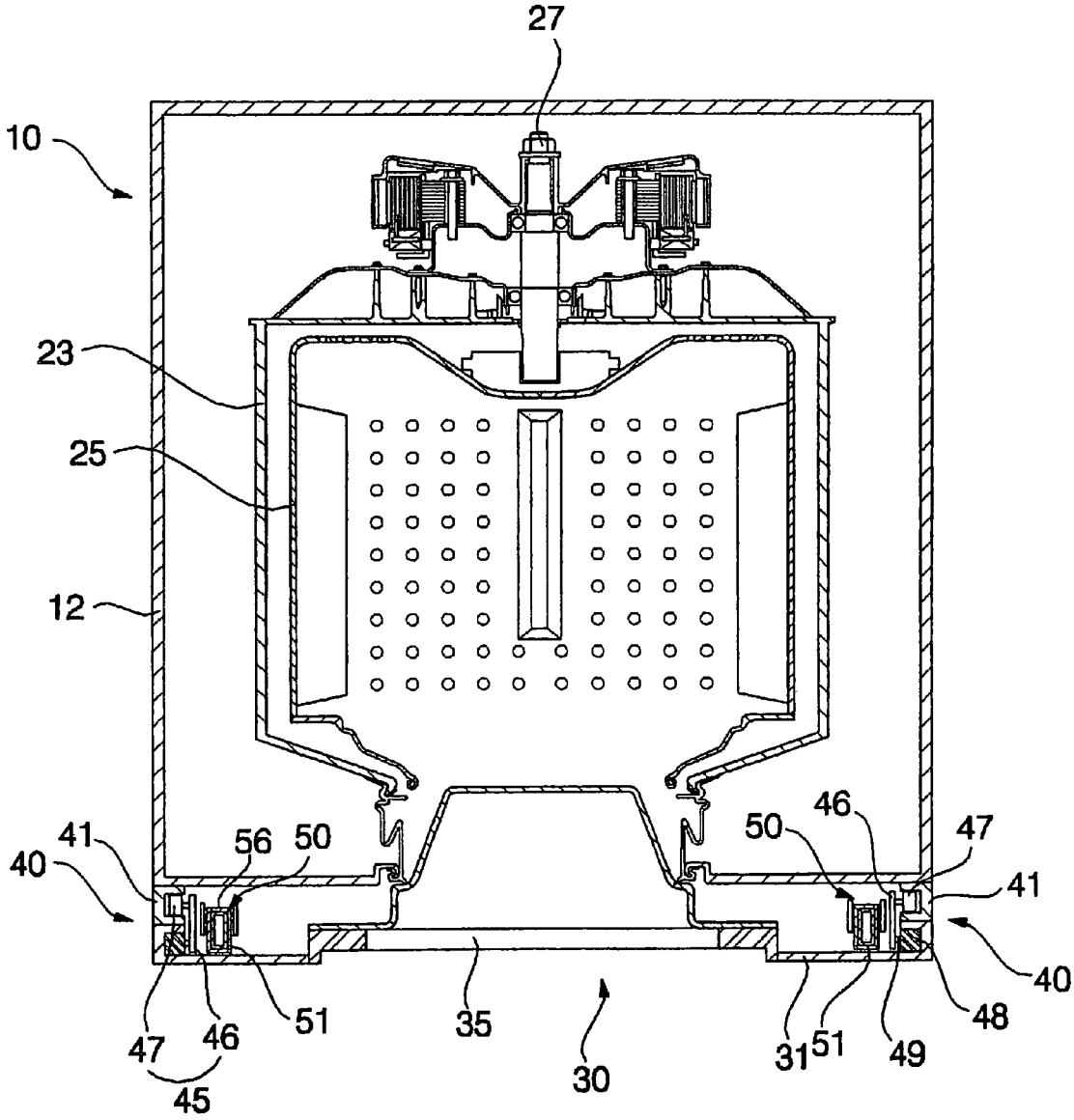
FIG. 51 is a transverse sectional view of the drum washing machine in accordance with the eighteenth embodiment of the present invention.
Figure 52:
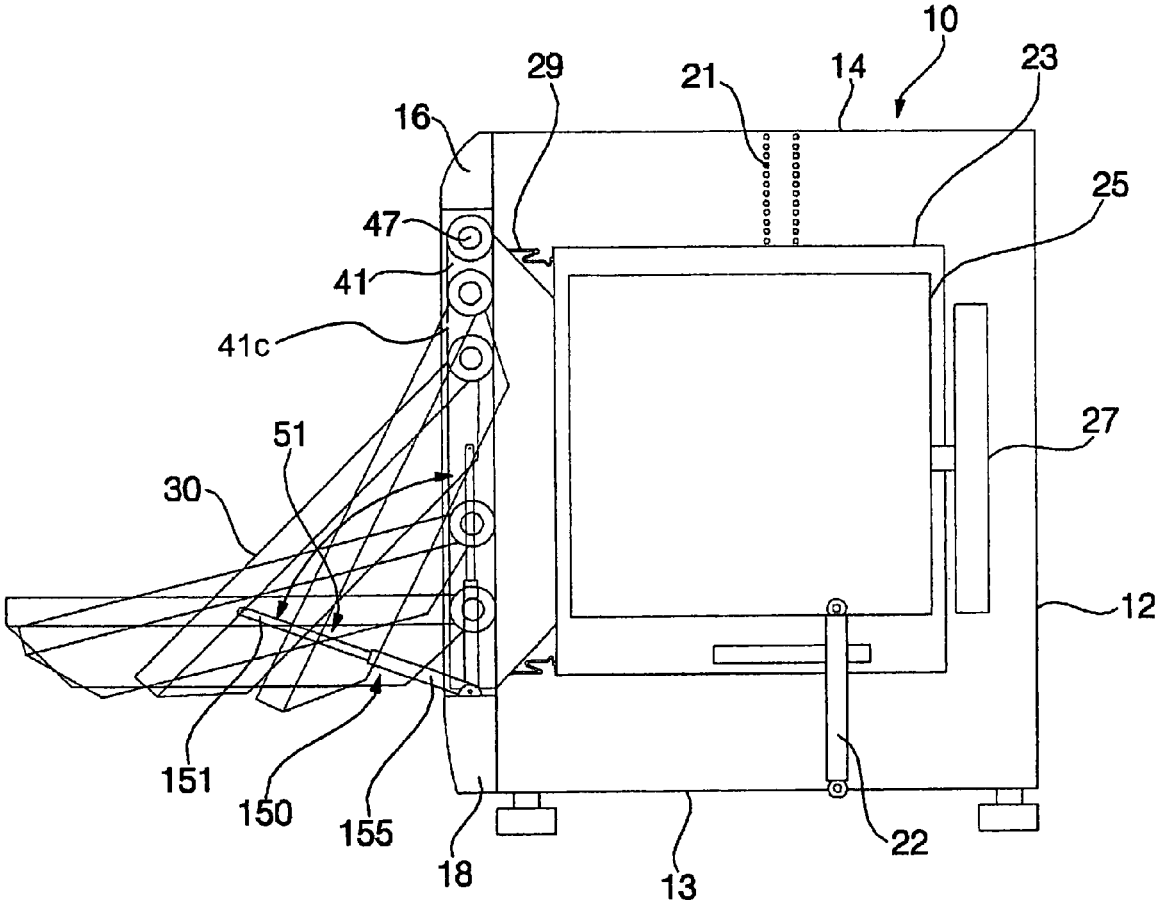
FIG. 52 is a schematic longitudinal sectional view of the drum washing machine at various positions as the door opens, in accordance with the eighteenth embodiment of the present invention.
Figure 53:
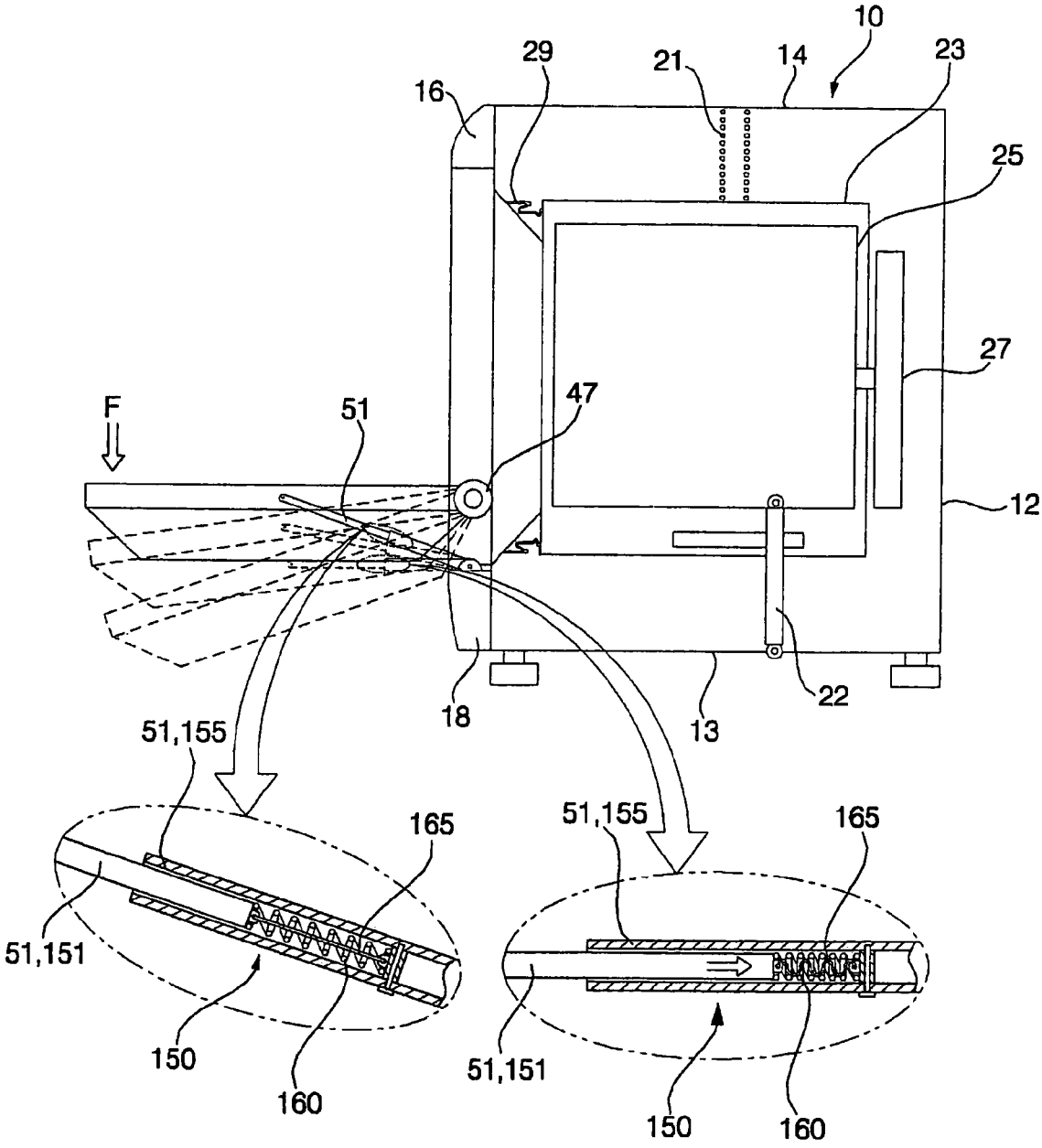
FIG. 53 is a schematic longitudinal sectional view of the drum washing machine, illustrating the door being supported by a variable support apparatus in accordance with the eighteenth embodiment of the present invention.

FIGS. 49 through 53 illustrate a drum washing machine in accordance with an eighteenth embodiment of the present invention. FIG. 49 illustrates the drum washing machine including, for example, shock absorbers 150; FIG. 50 illustrates certain features of the drum washing machine, such as the shock absorbers 150 in greater detail; FIG. 51 is a transverse sectional view of the drum washing machine; FIG. 52 illustrates, for example, two positions of the door 30 and shock absorber 150 of the drum washing machine in opened and closed positions; and FIG. 53 illustrates the door 30 of the drum washing machine fully extended, with a force (F) applied to the fully opened door 30.

With reference to FIGS. 49 and 50, and similarly to any of the other suitable embodiments described herein, for example, a drum washing machine, which is provided with the variable support apparatus in accordance with the eighteenth embodiment of the present invention, may include a cabinet 10 to form an outer structure of the washing machine. An opening 11 is provided at a front wall of the cabinet 10 to allow laundry to be put into or taken out of the washing machine. The door frame 31 may have opposite side portions 32, each of which is formed by bending a corresponding side end portion of the door frame 31 into a generally "L" shape. The side portions 32 form opposite side walls of the door 30, respectively. Each side portion 32 may be formed, at upper and lower ends thereof, with round surfaces 33 and 34 to prevent the side portion 32 from interfering with the lower cover 19 and vertical guides 41 during the opening or closing of the door 30.

For example, in a configuration similar to other embodiments of the present invention, the door 30 is vertically movable such that it is opened when it moves downwardly, and is closed when it moves upwardly. When the door 30 is opened, the outer surface of the door 30 faces upwardly, so that during the process of taking laundry out of the drum 25, the laundry taken out may be temporarily stored in the interior of the door 30. Further, for example, the door support unit 50 may include an elongated support rod 51 rotatably connected to the cabinet 10 and door frame 31 at opposite ends of the support rod 51, respectively. The door support unit 50 may include two support rods 51 arranged at opposite sides of the door 30, respectively, as shown in FIGS. 49 and 50 (and similarly to other embodiments discussed above).

As shown in FIGS. 49, 50 and 53, for example, a shock-absorber 150, for varying the length of the support rod 51 to effect a shock-absorbing function according to an external force (F) applied to the door 30 when the door 30 is opened, may be installed on each of the support rods 51.

The shock-absorber 150 may include several rods (two rods 151 and 155 are illustrated in the example shown in FIG. 53), obtained by dividing the support rod 51, and one rod 151 may be slidably inserted into the other rod 155. The shock-absorber 150 may further include elastic members 160, each of which is formed on the connection portion between the inner and outer rods for supplying an elastic force to vary the length of the support rod 51 when a force exceeding a designated strength is applied to the support rod 51.

For example, the shock-absorber 150 may include the inner rods 151, each of which is connected to the door 30 by the hinge 52 for forming one portion of the corresponding support rod 51, the outer rods 155, each of which connected to the cabinet 10 so that the lower end of the corresponding inner rod 151 is inserted into the outer rod 155 for forming the other portion of the corresponding support rod 51, the elastic members 160 supported in the outer rod 155 for supplying the elastic force to the inner rod 151, and linear members 165, each of which is placed between the inner rod 151 and the outer rod 155 for preventing the inner and outer rods 151 and 155 from being disconnected from each other so that the length of the support rod 51 is constantly maintained.

A spring seat 157 (see FIG. 49), which is fixed by a seat pin 159 passing through the spring seat 157 and serves to support the elastic member 160, may be placed in the outer rod 155.

The elastic member 160, which may be made of a coiled spring, for example, may be placed between the spring seat 157 and the end of the inner rod 151, and supplies a compressed elastic force. Preferably, the elastic member 160 is not elastically deformed until a force having an excessive strength (that is, for example, a force of relatively high strength) is applied to the door 30, i.e., until a force exceeding a designated strength is applied to the door 30 through the inner rod 151. The elastic member 160 has a coefficient of elasticity such that the elastic member 160 is compressed and the inner rod 151 is inserted into the outer rod 155 when the force exceeding the designated strength is applied to the door 30.

The linear member 165 (see FIG. 49), which is connected to the end of the inner rod 151 and the spring seat 157 and which has a designated length, may prevent the inner rod 151 from being separated from the outer rod 155, and may determine the maximum length of the support rod 51 when the linear member 165 between the inner rod 151 and the linear member 160 is tightly stretched. Preferably, rings 152 and 158 or holes for fixing the linear member 160 are respectively formed on the inner rod 151 and the spring seat 157.

The linear member 165 may be a string or wire. Preferably, the linear member 165 is made of a material having a tensile strength suitable to withstand the elastic force supplied from the elastic member 160 to the inner rod 151.

FIGS. 54A through 54E are respective perspective views of the drum washing machine, illustrating a sequence of door positions as the door opens, in accordance with the eighteenth embodiment of the present invention.

Figure 54A:
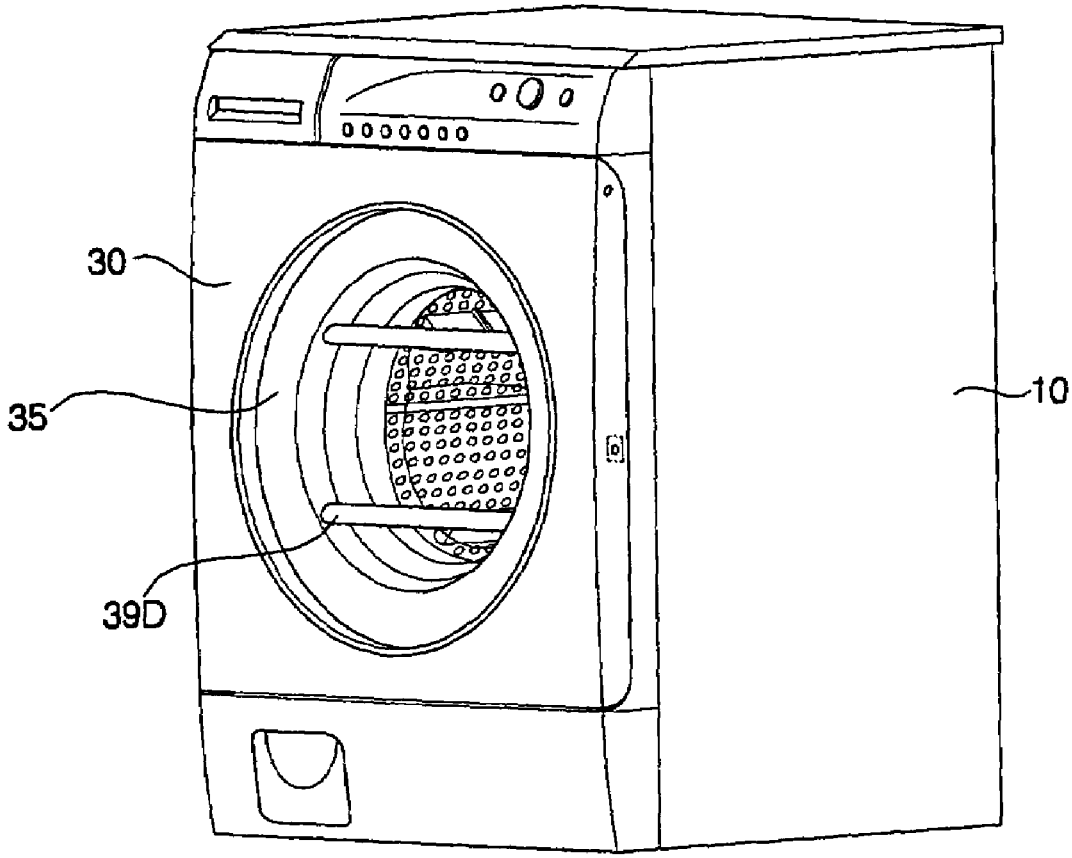
FIGS. 54A through 54E are respective perspective views illustrating a sequence of door positions of the drum washing machine in accordance with the eighteenth embodiment of the present invention as the door opens.
Figure 54B:
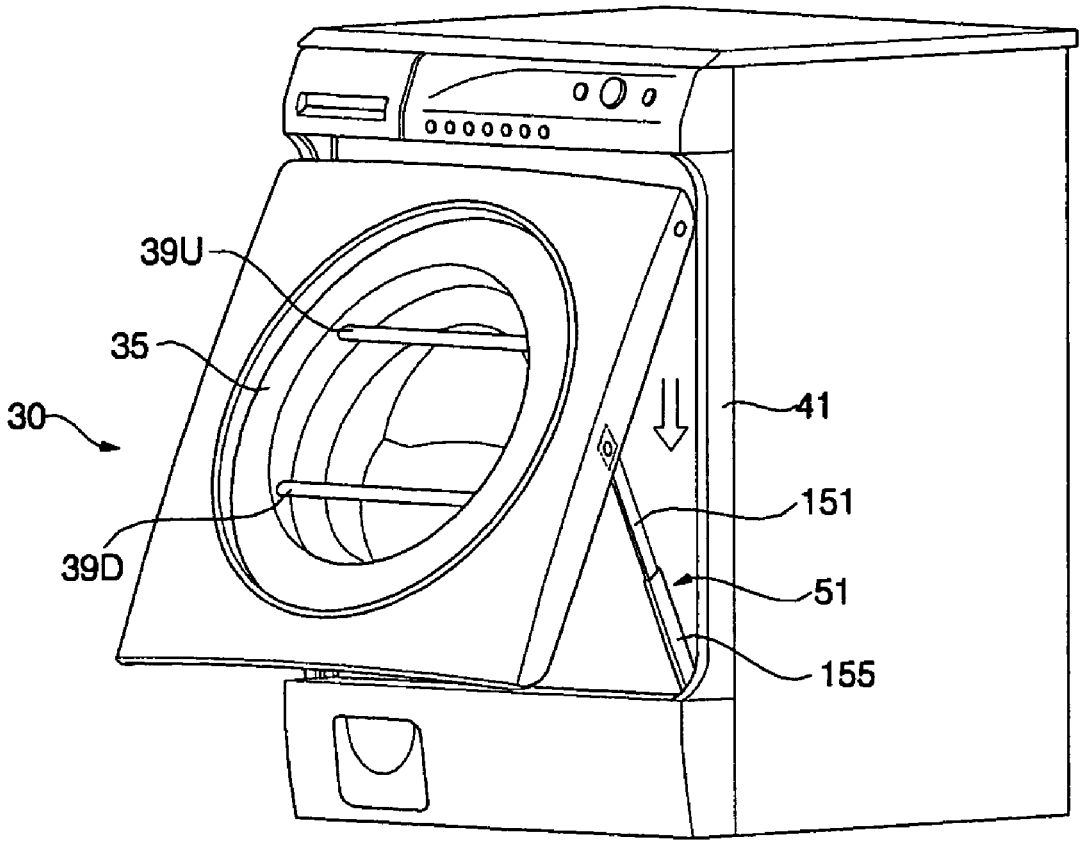
Figure 54C:
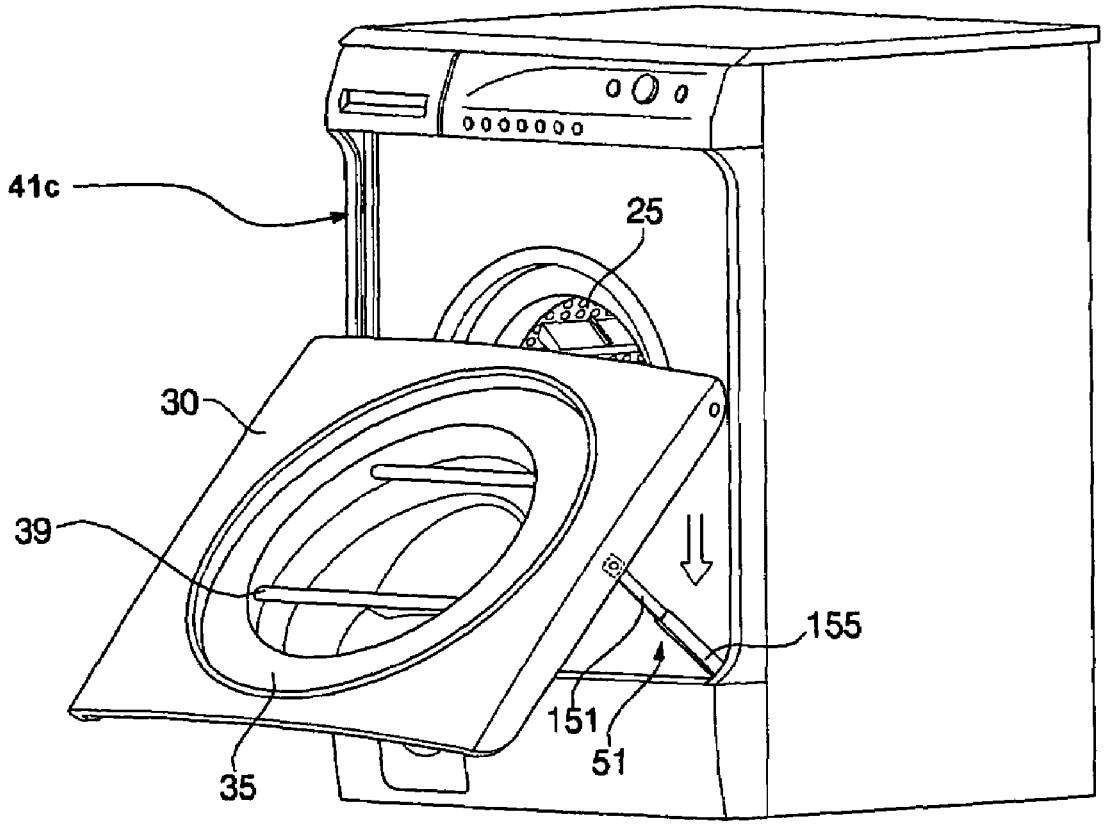
Figure 54D:
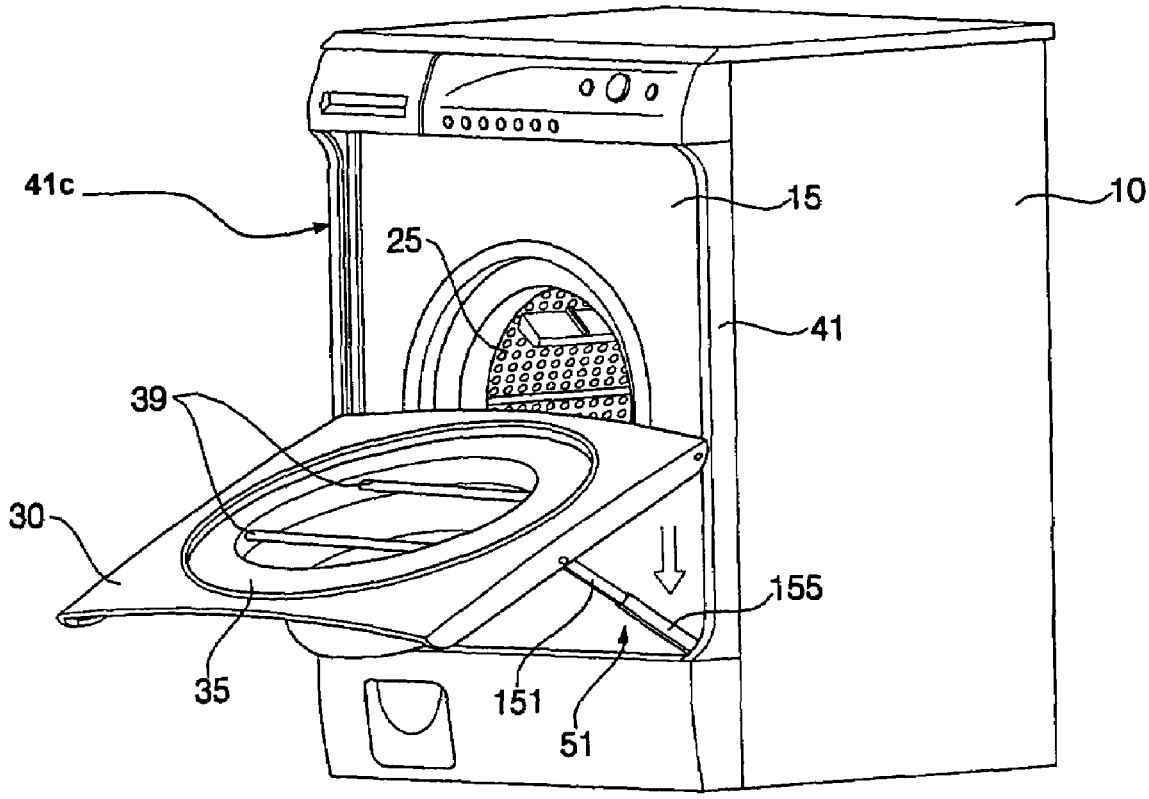
Figure 54E:
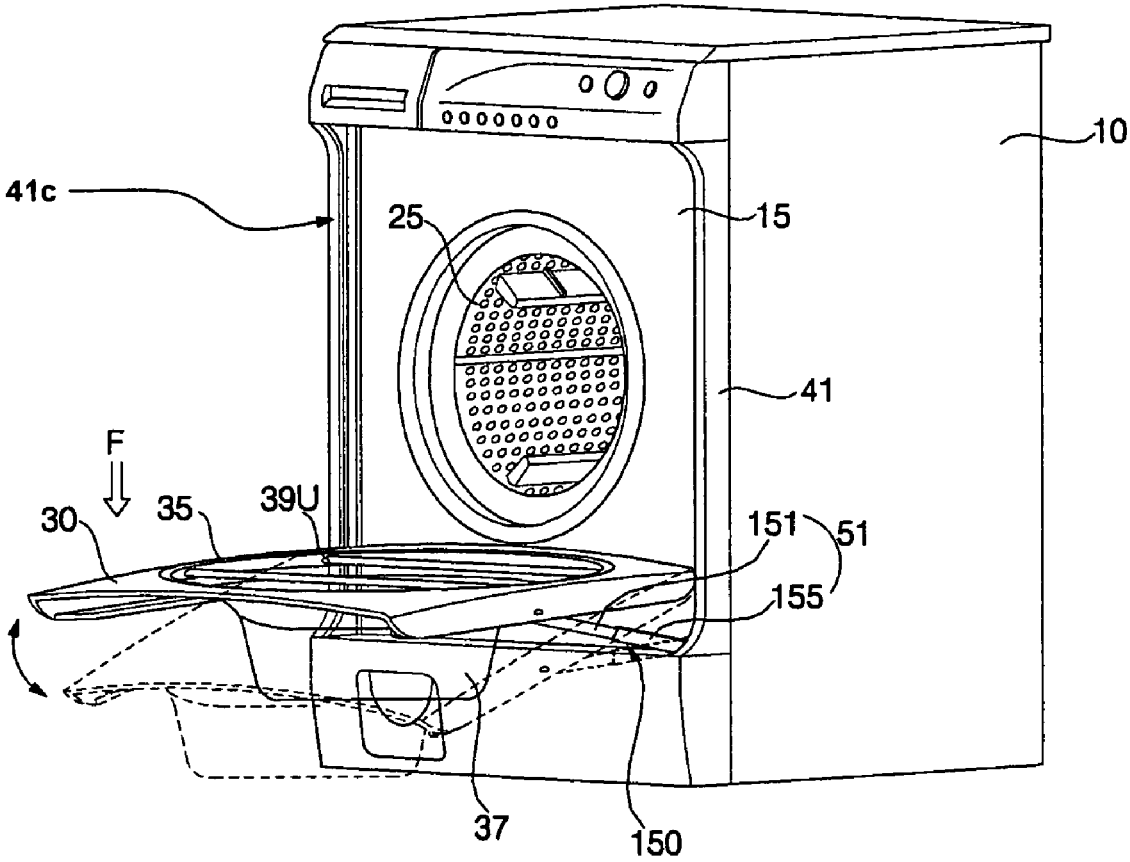

In order to open the door 30 from a closed state, as shown in FIG. 54A, for example, when a user grasps a lower handle 39D and pulls the lower handle 39D downward, the upper end of the door 30 moves downwardly through various positions as shown in FIGS. 54B, 54C, and 54D, for example, and then the lower end of the door 30 horizontally moves forward so that the door 30 is opened as shown in FIG. 54E, for example.

That is, the upper end of the door 30 moves downward by the movement of the rollers 47 along the vertical guides 41. When the support rods 51 extend perpendicularly, the upper ends of the support rods 51 are rotated toward the front surface of the washing machine by the movement of the door 30, and support the opened door 30 so that the lower end of the door 30 horizontally moves forward.

When the door 30 is opened, the user can put laundry into the drum 25, and simultaneously can take the laundry out of the drum 25. Here, if necessary, the user can store the laundry taken out of the drum 25 into the door window 35, for example.

The support rods 51, which are elongated to their maximal length by the elastic force of the elastic members 160, may stably support the door 30. When an external force (F) exceeding a designated strength is applied to the door 30, which is completely opened as shown in FIGS. 53 and 54E, for example, the inner rods 151 of the support rods 51 compress the elastic members 160 and move into the outer rods 155. The length of the support rods 51 is decreased, and the lower end of the door 30 is rotated centering on the upper end of the door 30 provided with the rollers 47. Here, the linear members 165 are stretched in the outer rods 155.

Thereafter, if the external force (F) applied to the door 30 is removed, the inner rods 151 are withdrawn from the outer rods 155 by the elastic force of the elastic members 160, and the correspondingly length-increased support rods 51 support the door 30. Here, the linear members 165 placed between the inner rods 151 and the outer rods 155 are tightly stretched, and determine the maximum movable displacement of the inner rods 151.

Accordingly, when a force having an excessive strength is applied to the door 30, which is completely opened (for example, by the user or some other load), the shock-absorber 150 varies the lengths of the support rods 51, thereby solving problems caused by breakdown or failure of members for supporting the door 30, such as the support rods 51.

Thereafter, when the user grasps an upper handle 39U of the door 30 and pulls the upper handle 39U upward, the upper end of the door 30 moves upward and the door 30 is closed.

For example, in reverse of the procedures described above for opening the door 30, the rollers 47 installed at the upper end of the door 30 move upwardly along the vertical guides 41, and the lower end of the door 30 moves horizontally toward the washing machine. Then, the lower and upper ends of the door 30 contact the front cover 15, and the door 30 is closed.

Now, nineteenth through twenty-second embodiments of the present invention will be described. Some features in these embodiments, which correspond to those in the eighteenth embodiment or other embodiments described herein, are denoted by the same reference numerals.

Figure 55:
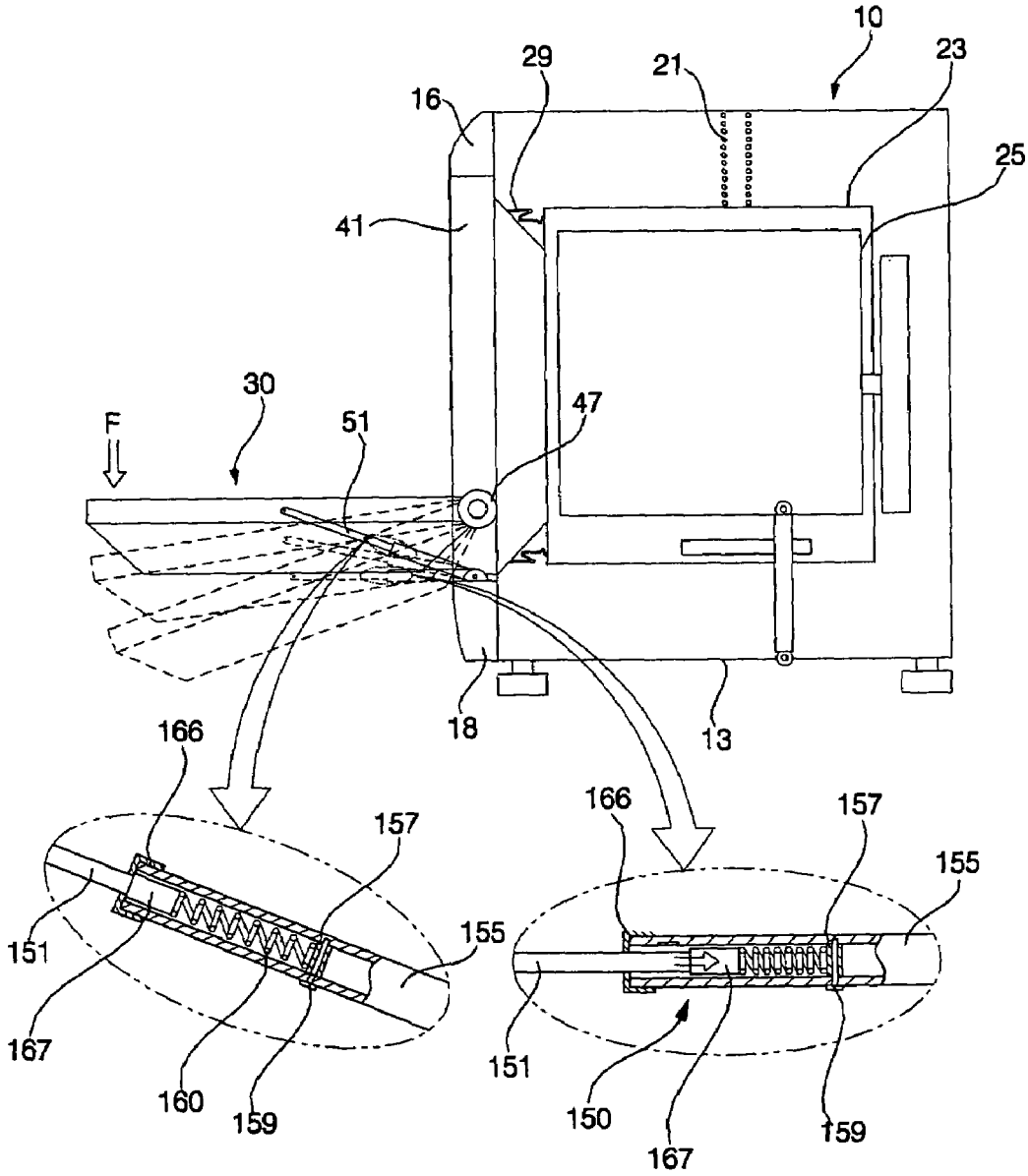
FIG. 55 is a schematic longitudinal sectional view of a drum washing machine, illustrating the door being supported by a variable support apparatus in accordance with a nineteenth embodiment of the present invention.

FIG. 55 is a schematic longitudinal sectional view of a drum washing machine, illustrating the door 30 being supported by a variable support apparatus, in accordance with a nineteenth embodiment of the present invention.

The shock-absorber of the drum washing machine in the nineteenth embodiment as shown in FIG. 55 may be substantially similar to that discussed regarding the eighteenth embodiment. However, members for engaging the inner and outer rods 151 and 155 with each other may alternatively be used to maintain the length of the support rod 51 instead of the linear member 160.

For example, the shock-absorber 150 may include the inner rods 151, the outer rods 155 into which the corresponding inner rods 151 are inserted, the elastic members 160 placed in the outer rods 155, and the spring seats 157 placed in the outer rods 155 for supporting the elastic members 160. Also, a stopper cap 166 for preventing the inner rod 151 from being separated from the outer rod 155 may be fixedly connected to the upper end of the outer rod 155, and an expanded portion 167 caught by the stopper cap 166 may be formed on the lower end of the inner rod 151, for maintaining the length of the support rod 51.

The engagement of the inner and outer rods 151 and 155 may be achieved not only by the stopper cap 166 and the expanded portion 167, but alternatively may be achieved by various structures suitable to engage the inner and outer rods 151 and 155 of the support rod 51 with each other when they are stretched to a designated length or beyond that designated length.

The structure for maintaining the length of the support rods 51 (for example, the stopper cap 166 and expanded portion 167) of the shock-absorber may prevent the support rods 51 from extending to excessively large lengths due to the elastic force of the elastic members 160, and may cause the support rods 51 to have appropriate designated lengths before an external force exceeding a designated strength is applied to the support rods 51 when the door 30 is opened or closed, thereby facilitating the stable supporting function of the support rods 51.

Figure 56:
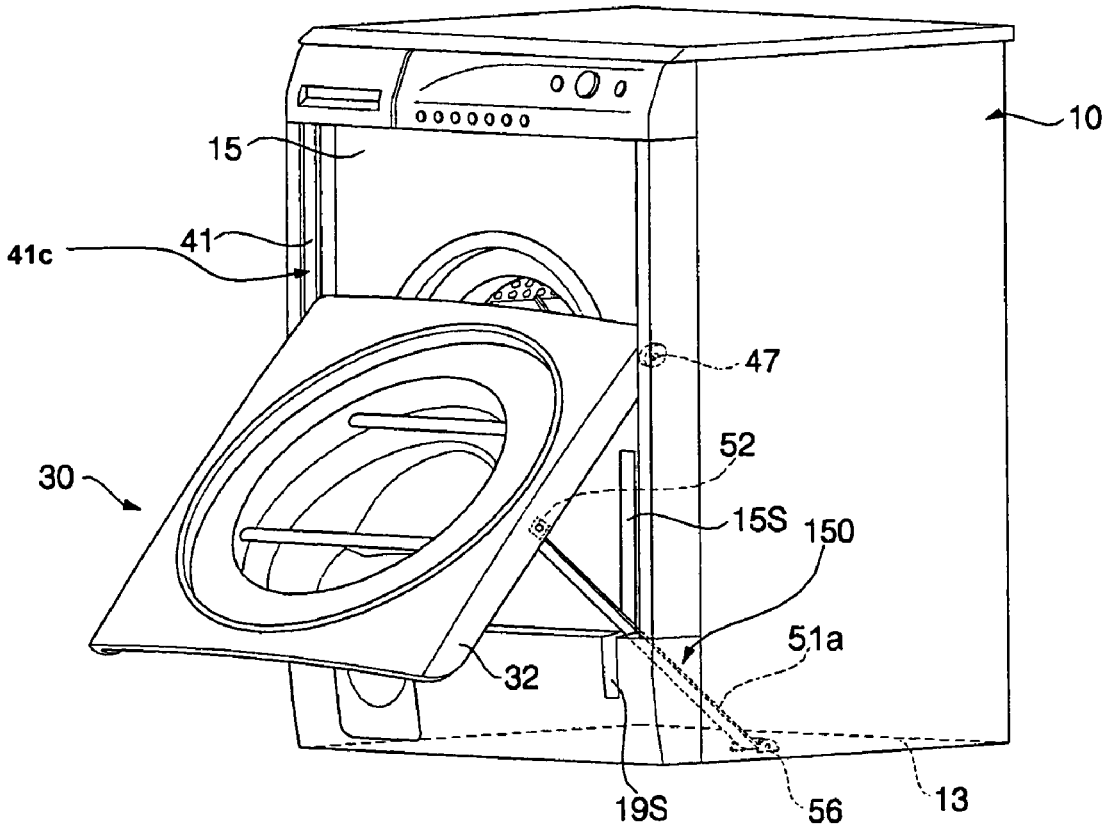
FIG. 56 is a perspective view of a drum washing machine in accordance with a twentieth embodiment of the present invention, in a state in which a door is being opened.
Figure 57:
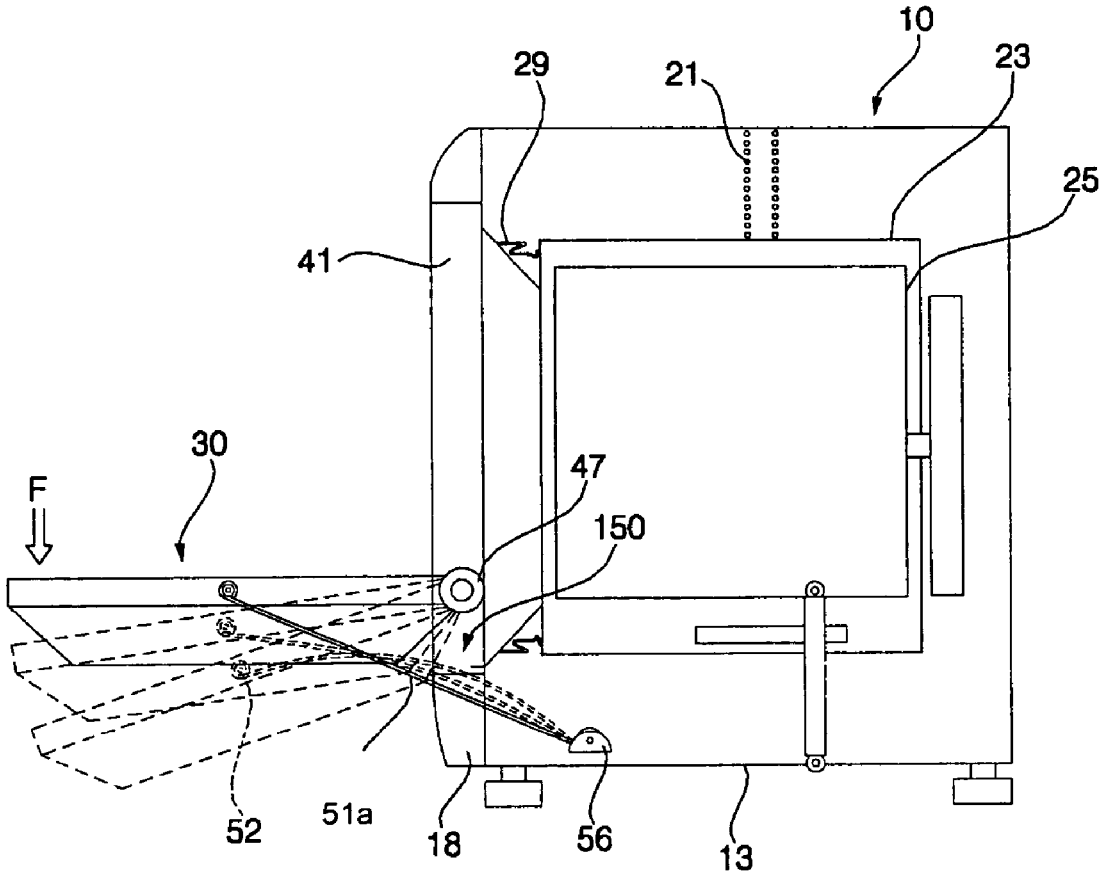
FIG. 57 is a schematic longitudinal sectional view of the drum washing machine, illustrating the door being supported by a variable support apparatus in accordance with the twentieth embodiment of the present invention.

FIGS. 56 and 57 illustrate a drum washing machine in accordance with a twentieth embodiment of the present invention, in which FIG. 56 shows a drum washing machine with its door opened, and FIG. 57 shows the drum washing machine in which the door is supported.

The drum washing machine according to the twentieth embodiment of the present invention, as shown in FIGS. 56 and 57, has rollers 47, which are directly mounted to the side portions 32 of the door 30, and the support rods 51*a* are mounted to a bottom wall of the cabinet 10.

Also, the vertical guides 41 may be arranged at opposite side ends of an outer surface of the front cover 15, respectively, such that the outer surface of each vertical guide 41 is flush with the outer surface of the door 30, for example. The door 30 may be arranged between the vertical guides 41. The rollers 47 may be mounted directly to the associated side portions 32 of the door 30 at an upper end of the door 30, without using separate roller brackets, such that the rollers 47 are movable along the associated vertical guides 41. As shown in FIG. 56, for example, a guide groove 41*c* may be formed at an inner surface of each vertical guide 41 to receive the associated roller or rollers 47.

Each support rod 51*a* may have an upper end hingably connected to an associated one of the side portions 32 of the door 30, and a lower end extending into the cabinet 10 through the front cover 15 and the lower cover 19 and hingably connected to the base 13 forming the bottom wall of the cabinet 10.

A pair of hinge brackets 56 may be mounted to the base 13 to connect respective support rods 51*a* to the base 13. Vertically-elongated slits 15S and 19S may be formed at the front cover 15 and the lower cover 19, respectively, so that the support rods 51*a*are freely movable while extending through the associated slits 15S and 19S.

In contrast to the shock-absorbing units of the eighteenth and nineteenth embodiments, for example, the support rods 51*a* of the shock-absorber 150 of the twentieth embodiment are not necessarily divided into two portions. However, when a force exceeding a designated strength is applied to the support rods 51*a*, the support rods 51*a* are deformed (as shown in FIG. 57, for example), thereby providing supporting and shock-absorbing functions.

For example, as illustrated in FIGS. 56 and 57, the support rods 51*a* of the twentieth embodiment may be structured as plate springs, and are typically not elastically deformed when the door 30 is normally opened or closed. However, when an external force (F) exceeding a designated strength is applied to the door 30 and the door 30 moves horizontally and is completely opened, as shown if FIG. 57, the support rods 51*a* may be elastically deformed. Thus, when the external force (F) is removed from the door 30 and the door 30 moves downward centering on the rollers 47, the support rods 51*a* may be returned to their original positions by the restoring elastic force of the support rods 51*a*.

As described above, in the same manner as the preceding embodiments, the ends of the support rods 51*a* of the twentieth embodiment may be connected to the door 30 by the hinges 52, and the other ends of the support rods 51 are connected to the cabinet 10 by the hinge brackets 56.

Figure 58:
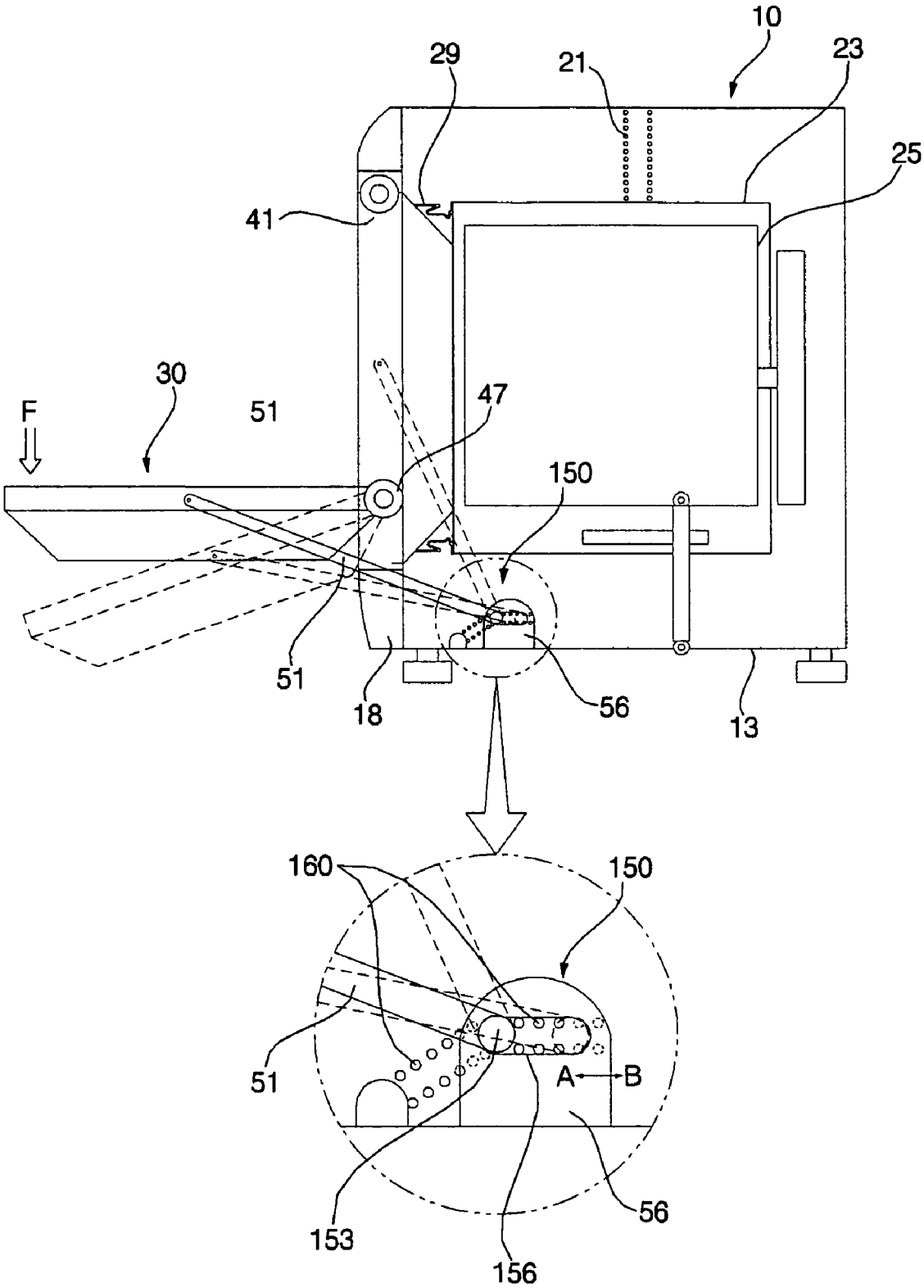
FIG. 58 is a schematic longitudinal sectional view of a drum washing machine, illustrating the door being supported by a variable support apparatus in accordance with a twenty-first embodiment of the present invention.

FIG. 58 illustrates a drum washing machine, having a door which is supported in accordance with a twenty-first embodiment of the present invention.

The drum washing machine of the twenty-first embodiment, as shown in FIG. 58, for example, may include features similar to the twentieth embodiment. However, the support rods 51 of the shock-absorber 150 of the drum washing machine of the twenty-first embodiment may be connected to the cabinet 10 by the hinge brackets 56.

For example, a slot 156 having a designated length, along which a hinge shaft 153 of the support rod 51 moves, may be formed approximately horizontally or upwardly in the hinge bracket 56, and elastic members 160, for limiting the movement of the hinge shaft 153 before a force exceeding a designated strength is applied to the support rod 51, may be formed on the hinge shaft 153 and the hinge bracket 56, or the cabinet 10.

Accordingly, when the door 30 is normally opened, the hinge shafts 153 are placed at initial positions in the corresponding slots 156 by the elastic force of the elastic members 160, and when the door 30 is completely opened and horizontally oriented, and an external force (F) exceeding a designated strength is applied to the door 30, the support rods 51 and the hinge shafts 153 move backwardly in the direction of "B" against the elastic force of the elastic members 160. Here, as the hinge shafts 153 move backwardly, the door 30 moves downwardly centering on the rollers 47. Therefore, it is possible to prevent the door 30 or support structures, such as the support rods 51 for supporting the door 30, from being damaged by the external force (F) applied to the door 30.

Also, when the external force (F) is removed from the door 30, the support rods 51 may stably support the door 30 when the hinge shafts 153 move again in the direction of "A" along the slots 156 by the elastic force of the elastic members 160.

Although FIG. 58 illustrates elastic members 160 which include two types of springs, such as tension springs and compression springs, the elastic members 160 may alternatively include only one type of spring (or even more than two types of springs) when suitable.

Figure 59:
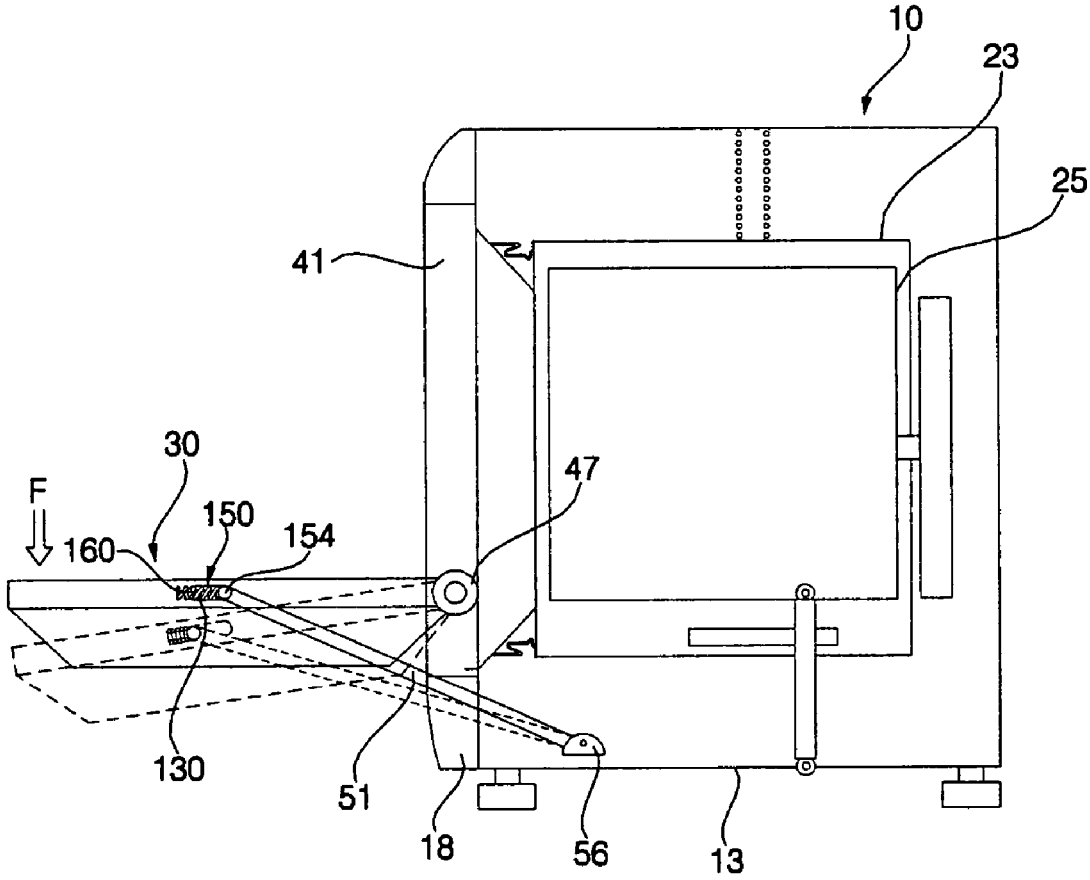
FIG. 59 is a schematic longitudinal sectional view of a drum washing machine, illustrating the door being supported by a variable support apparatus in accordance with a twenty-second embodiment of the present invention.

FIG. 59 illustrates a drum washing machine having a door is supported, in accordance with a twenty-second embodiment of the present invention.

The drum washing machine 1 of the twenty-second embodiment, as shown in FIG. 59, for example, may have features substantially similar to the twenty-first embodiment. However, the shock-absorber 150 of the drum washing machine 1 of the twenty-second embodiment may be installed at the hinges 52 for connecting the support rods 51 to the door 30, in contrast to the twenty-first embodiment.

For example, the slots 130, along which hinge shafts 154 of the support rods 51 move, may be formed directly in the door 30, or formed in brackets (not shown) installed on the door 30 and connected to the hinges 52, and elastic members 160, for limiting the movement of the hinge shafts 154 along the slots 130 before an external force (F) exceeding a designated strength is applied to the door 30, may be formed between the hinge shafts 154 and the door 30.

Accordingly, when the external force (F) exceeding the designated strength is applied to the door 30, in a similar manner as described above regarding the twenty-first embodiment, the hinge shafts 154 move along the slots 130, thus preventing the door 30 or support structures, such as the support rods 51 for supporting the door 30, from being damaged by the external force (F) applied to the door 30.

In view of the above-described embodiments of the present invention, the variable support apparatus of the door of the drum washing machine of the present invention can support the door so that the door can move vertically to be opened and/or closed, and can vary the door or members for supporting the door when an external force of an excessively high strength is applied to the door when the door is completely opened and horizontally oriented so that the door or the members for supporting the door are not damaged, and may thus provide a stable supporting structure for the door of the drum washing machine.

Although several embodiments of the invention have been disclosed for illustrative purposes, those skilled in the art will appreciate that various modifications, additions and substitutions are possible, without departing from the spirit of the invention, the scope of which is set forth in the accompanying claims and their equivalents.

What is claimed is:

1. A drum washing machine comprising:

a cabinet including an opening at a front wall of the cabinet and configured to allow laundry to be put into or taken out of the cabinet;

a door provided to the opening of the cabinet; and an opening/closing guide mechanism connected between the cabinet and the door, configured to guide the door downwardly when opening the door such that the door is opened with a front surface of the door upwardly directed, and configured to guide the door upwardly when closing the door; and wherein the opening/closing guide mechanism comprises a vertical guide mechanism configured to guide an upper end of the door vertically along a front wall of the cabinet; and a door support mechanism configured to support the door when opening the door.

2. The drum washing machine according to claim 1, wherein the door comprises:

a door frame mounted to a front wall of the cabinet; and a container-shaped door window mounted to the door frame, the container-shaped door window having a convex structure extending into the opening of the cabinet when the door is closed.

3. The drum washing machine according to claim 2, further comprising:

a hinge mechanism configured to hingably mount the door having the container-shaped door window to the door frame, wherein the door window is hingably movable with respect to the door frame.

4. The drum washing machine according to claim 1, wherein the vertical guide mechanism comprises:

first and second vertical guides respectively provided at first and second opposite side portions of the cabinet and configured to extend vertically; and first and second guide couplers respectively protruding from first and second opposite side portions of the door, and configured to move vertically along the first and second vertical guides.

5. The drum washing machine according to claim 4, wherein each guide coupler comprises a roller configured to roll along an associated one of the vertical guides.

6. The drum washing machine according to claim 1, wherein the door support mechanism comprises at least one support rod having first and second opposite ends hingably connected to the cabinet and the door, respectively.

7. A drum washing machine comprising:

a cabinet including an opening at a front wall of the cabinet and configured to allow laundry to be put into or taken out of the cabinet;

a door provided to the opening of the cabinet;

a vertical guide mechanism connected between an upper end of the door and the cabinet, and configured to guide the upper end of the door vertically along a front wall of the cabinet when opening or closing the door; and a door support mechanism connected between the door and the cabinet, and configured to guide a lower end of the door substantially horizontally when opening, wherein the door is openable or closable along a generally vertical direction.

8. A drum washing machine comprising:

a cabinet including an opening at a front wall of the cabinet configured to allow laundry to be put into or taken out of the cabinet;

a door configured to open or close the opening of the cabinet, the door having a basket detachably attached to the door and configured to contain laundry; and an opening/closing guide mechanism connected between the cabinet and the door and configured to guide the door downwardly when opening the door such that the door is opened with a front surface of the door upwardly directed, and to guide the door upwardly when closing the door, wherein the door comprises:

a door frame mounted to the front wall of the cabinet; and a container-shaped door window mounted to the door frame, the container-shaped door window having a convex structure configured to extend into the opening of the cabinet when the door is closed, wherein the basket is detachably attached to the container-shaped door window.

9. The drum washing machine as set forth in claim 8, wherein the door is provided with a locking mechanism configured to prevent the basket from separating from the door window.

10. The drum washing machine as set forth in claim 9, wherein the basket includes at least one handle, and wherein the locking mechanism cooperates with the handle of the basket.

11. The drum washing machine as set forth in claim 10, wherein the locking mechanism comprises:

a locking release lever disposed within the handle and configured to move linearly;

a locking pin disposed within the basket, extending toward the container-shaped door window, and configured to cooperate with the locking release lever; and a locking spring configured to provide an elastic force to at least one of the locking release lever or the locking pin such that the locking pin is movable to a locking position.

12. A drum washing machine comprising:

a cabinet including an opening at a front wall of the cabinet and configured to allow laundry to be put into or taken out of the cabinet;

a door configured to open or close the opening of the cabinet;

a vertical guide mechanism connected between an upper end of the door and the cabinet, and configured to guide the upper end of the door vertically along a front wall of the cabinet when opening or closing the door;

a door support mechanism connected between the door and the cabinet, and configured to guide the door to a substantially horizontal alignment when opening the door; and an automatic opening/closing mechanism configured to move the door vertically along the vertical guide mechanism automatically when opening or closing the door.

13. The drum washing machine according to claim 12, wherein the vertical guide mechanism includes at least first and second vertical guides respectively provided at first and second opposite side portions of the cabinet and extending vertically, and first and second guide couplers respectively protruding from first and second opposite side portions of the door, and configured to move vertically along the first and second vertical guides, and wherein the automatic opening/closing mechanism includes a rotating power generator provided at the door and configured to generate a rotating power, at least one rotating member configured to be rotated along an associated one of the first and second vertical guides by the rotating power generator, and at least one rotation/linear movement converting member provided at the associated one of the first and second vertical guides and configured to be moved vertically when in contact with the at least one rotating member in accordance with a rotation of the at least one rotating member.

14. The drum washing machine according to claim 13, wherein the rotating member includes a pinion configured to be rotated by the rotating power generator, and wherein the rotation/linear movement converting member includes a rack provided at the associated one of the first or second vertical guides.

15. The drum washing machine according to claim 12, wherein the door support mechanism includes at least one hollow support rod having first and second opposite ends hingably connected to the cabinet and the door, respectively, wherein the automatic opening/closing mechanism includes a rotating power generator provided at the door and configured to generate a rotating power, using electrical power, and wherein at least one electrical wire passes through the support rod and is configured to supply the electrical power to the rotating power generator.

16. A drum washing machine comprising:

a cabinet including an opening at a front wall of the cabinet and configured to allow laundry to be put into or taken out of the cabinet;

a door configured to open or close the opening of the cabinet;

a vertical guide unit connected between an upper end of the door and the cabinet, and configured to guide the upper end of the door along a substantially vertical direction at a front wall of the cabinet when the door is opened or closed;

a door support unit connected to the door and the cabinet, and configured to support the door when opening the door; and an automatic opening/closing unit configured to vertically rotate the door support unit to automatically open or close the door.

17. The drum washing machine according to claim 16, wherein the door support unit includes a plurality of support rods, each having first and second opposite ends hingably respectively connected to the cabinet and to the door.

18. The drum washing machine according to claim 17, wherein the automatic opening/closing unit includes a plurality of rotary force generation units respectively installed at a plurality of corresponding connection portions between the support rods and the cabinet, and configured to rotate the support rods.

19. The drum washing machine according to claim 16, further comprising a plurality of elastic members configured to supply an elastic force to facilitate the vertical movement of the door, each respectively interposed between the upper end of the door and a lower portion of a door-movement route on the cabinet.

20. A drum washing machine comprising:

a cabinet including an opening at a front wall of the cabinet and configured to allow laundry to be put into or taken out of the cabinet;

the door provided to the opening of the cabinet;

a vertical guide unit connected between an upper end of the door and the cabinet, and configured to guide the upper end of the door along a substantially vertical direction at a front wall of the cabinet when the door is opened or closed; and a shock absorber connected to the door and the cabinet, and configured to support the door when opening the door so that the door moves toward a substantially horizontal orientation and to provide a shock-absorbing function when an external force is applied to the opened door.

21. The drum washing machine according to claim 20, wherein the shock-absorber includes a plurality of support rods respectively having opposite ends hingably connected to the cabinet and the door, the support rods providing the shock-absorbing function of the shock-absorber.

22. The drum washing machine according to claim 21, wherein each support rod includes an inner rod at a first side of each support rod, and an outer rod located at a second side of each support rod, into which the inner rod is at least partially inserted, and wherein the shock-absorber includes an elastic member supported in the outer rod, and configured to supply an elastic force to the inner rod.

23. The drum washing machine according to claim 21, wherein hinge brackets, to which the support rods are rotatably connected, are installed on the cabinet, and wherein the shock-absorber is positioned between the hinge bracket and the support rod.

* * * * *